US012392100B2

(12) United States Patent
Lessard et al.

(10) Patent No.: US 12,392,100 B2
(45) Date of Patent: Aug. 19, 2025

(54) REMOVABLE PLOWING SYSTEM FOR A VEHICLE WITH LATERAL PLOWING CAPABILITY

(71) Applicant: TENCO INC., St-Valerien-de-Milton (CA)

(72) Inventors: Charles Lessard, St-Valerien-de-Milton (CA); Jean-Sebastien Bissonnette, St-Valerien-de-Milton (CA); Robert Simard, St-Valerien-de-Milton (CA); Simon Champoux-Bouchard, St-Valerien-de-Milton (CA); Jean-Philippe Bourque, Quebec (CA); Yvon Archambault, St-Valerien-de-Milton (CA); Mathieu Bouchard, St-Valerien-de-Milton (CA)

(73) Assignee: TENCO INC., St-Valerien-de-Milton (CA)

( * ) Notice: Subject to any disclaimer, the term of this patent is extended or adjusted under 35 U.S.C. 154(b) by 0 days.

(21) Appl. No.: 18/264,915

(22) PCT Filed: Feb. 9, 2022

(86) PCT No.: PCT/CA2022/050186
§ 371 (c)(1),
(2) Date: Aug. 9, 2023

(87) PCT Pub. No.: WO2022/170427
PCT Pub. Date: Aug. 18, 2022

(65) Prior Publication Data

US 2024/0133141 A1 Apr. 25, 2024
US 2024/0229393 A9 Jul. 11, 2024

(30) Foreign Application Priority Data

Feb. 10, 2021 (CA) ..... CA 3108496

(51) Int. Cl.
*E01H 5/06* (2006.01)

(52) U.S. Cl.
CPC ..... *E01H 5/067* (2013.01); *E01H 5/061* (2013.01); *E01H 5/063* (2013.01); *E01H 5/066* (2013.01)

(58) Field of Classification Search
CPC ..... E01H 5/061; E01H 5/062; E01H 5/063; E01H 5/066; E01H 5/067
See application file for complete search history.

(56) References Cited

U.S. PATENT DOCUMENTS 3,503,144 A 3/1970 Stewart
4,045,892 A * 9/1977 Farrell ..... E01H 5/067 37/236

(Continued)

FOREIGN PATENT DOCUMENTS

CA 1147952 A 6/1983
CA 1147953 A 6/1983
CA 2508292 A1 11/2006

OTHER PUBLICATIONS

International Preliminary Report on Patentability received for PCT Application No. PCT/CA2022/050186 on Aug. 24, 2023, 10 pgs.

(Continued)

*Primary Examiner* — Joseph M Rocca
*Assistant Examiner* — Robert E Pezzuto
(74) *Attorney, Agent, or Firm* — Merchant & Gould P.C.

(57) ABSTRACT

A plowing system is removably mountable onto a vehicle in order to provide the vehicle with lateral plowing capability along a given lateral range of the vehicle. The plowing system includes a mounting assembly, a plowing assembly and corresponding plowing component. The plowing system also has associated first and second actuating assemblies cooperable with one another so as to selectively operate the plowing component between retracted and deployed con- (Continued)

figurations, and so as to provide the plowing system and associated plowing assembly and corresponding plowing component with an increased plowing resistivity within the lateral range of the vehicle, due to a combined effect of the first and second actuating assemblies. A corresponding vehicle is provided with such a plowing system.

20 Claims, 41 Drawing Sheets

(56) References Cited

U.S. PATENT DOCUMENTS

| | | | | |
|---|---|---|---|---|
| 4,096,652 | A | 6/1978 | Raines et al. | |
| 4,357,766 | A | 11/1982 | Croteau | |
| 4,969,280 | A | 11/1990 | Thorneloe | |
| 5,177,887 | A | 1/1993 | McGugan | |
| 6,249,992 | B1 | 6/2001 | Irving et al. | |
| 6,412,200 | B1 * | 7/2002 | Savard | E01H 5/067 37/232 |
| 7,000,338 | B2 | 2/2006 | Savard | |
| 7,107,710 | B2 | 9/2006 | Savard | |
| 7,523,569 | B2 | 4/2009 | Savard | |
| 8,776,406 | B2 | 7/2014 | Stephan | |
| 9,085,859 | B2 | 7/2015 | Andic | |
| 9,085,860 | B2 | 7/2015 | Dubiel | |
| 9,303,377 | B2 | 4/2016 | May et al. | |
| 9,353,495 | B2 | 5/2016 | Becicka | |
| 10,053,826 | B1 | 8/2018 | Null et al. | |
| 10,370,811 | B2 | 8/2019 | May | |
| 2005/0257406 | A1 | 11/2005 | Savard | |
| 2016/0362858 | A1 | 12/2016 | May | |

OTHER PUBLICATIONS

International Search Report and Written Opinion received for PCT/CA2022/050186 on May 10, 2022, 14 pgs.

Arctic Machine system provided with a deployable wing (ex. AM SHJ 218-218 J); www.arcticmachine.fi/en/products/snow-removal/side-ploughs/am-shj-218/, retrieved on Aug. 9, 2023., 5 pgs.

Mahlers Caway snow plow system; www.youtube.com/watch?v=BP1x0Hak9F4, retrieved on Aug. 9, 2023, 2 pgs.

Viking Cives system; www.vikingcives.com; www.vikingcives.com/product/73, retrieved on Aug. 9, 2023, 17 pgs.

Canadian Notice of Allowance received for CA Application No. 3,160,935 on Mar. 25, 2024, 1 pg.

Canadian Office Action received for CA Application No. 3,160,935 on Jun. 14, 2023, 4 pgs.

Canadian Office Action received for CA Application No. 3,160,935 on Jan. 17, 2023, 4 pgs.

* cited by examiner

REMOVABLE PLOWING SYSTEM FOR A VEHICLE WITH LATERAL PLOWING CAPABILITY

CROSS-REFERENCE TO RELATED APPLICATIONS

The present application is a National Stage Filing of PCT International Application No. PCT/CA2022/050186 filed on Feb. 9, 2022, which claims priority to Canadian Patent Application No. 3.108.496, filed on Feb. 10, 2021, which is incorporated herein by reference in its entirety.

FIELD OF THE INVENTION

The present invention relates to the field of plowing systems, vehicles and/or the like. More particularly, the present invention relates to a plowing system for use with a vehicle, such as a truck for example, and also relates to a vehicle provided with such a system, as well as to a kit with corresponding components for assembling the same (whether it be the plowing system itself and/or a resulting plowing vehicle), and to corresponding methods of manufacturing, assembling and/or operating associated thereto.

BACKGROUND

Plowing systems, vehicles, and the like, such as associated plowing accessories and devices (ex. plowing wings, moldboards, etc.), are well known in the art.

For example, known to the Applicant are the following examples of possible plowing systems:

a) Artic Machine™ system provided with a deployable wing (ex. AM SHJ 218-218 J—see for example, the following link: www.arcticmachine.fi/en/products/snow-removal/side-ploughs/am-shj-218/);

b) Mählers™ Caway snow plow system (see for example, the following link: www.youtube.com/watch?v=BP1x0Hak9F4); and c) Viking Cives™ system (see for example, the following link(s): www.vikingcives.com; www.vikingcives.com/product/73).

Despite these improvements over the years, there is always a need to continue innovating and finding better and/or different ways of plowing material, such as snow off the roads, for example, and to be able do so, in a quicker, easier, simpler, faster, more efficient, more convenient, more cost effective, more reliable, more secure, more versatile, more sustainable and/or more desirable manner.

Indeed, also known in the art are the various drawbacks and inconveniences associated with conventional plowing systems and associated vehicles. For example, and typically, the plowing component/wing is only activated by a single actuator (ex. a cylinder) having a distal end pivotably mounted to a rear end of the plowing component/wing and a proximate end pivotably mounted onto a fixed point/structure of the vehicle, and as result, a maximal angular range of the plowing component/wing is thus necessary delimited, and hence considerably "limited", by a corresponding deployable effective length of said a single actuator. This in turn results in additional drawbacks and inconveniences in that a single cylinder can only withstand a certain maximal threshold of plowing load/span, otherwise, it may be greatly damaged (ex. fluid leaks, etc.) and/or fail altogether, which is very undesirable for obvious reasons. One way of compensating could be to use a much longer and bigger cylinder, but this too in turn results in additional drawbacks and inconveniences (ex. added costs, added weight, uneven and undesirable lobsided weight distribution for the vehicle due to bending moment(s), etc.). Other considerable drawbacks and inconveniences associated with such conventional plowing systems and associated vehicles are that, in some cases, the plowing system itself is a very long, elaborate and heavy system, which is very undesirable for obvious reasons, in that, typically, it takes on the form of a separate and/or wheeled vehicle/device that needs to be "hauled" by another separate and main driving vehicle, and as a result, typically requires the use of specialized drivers, with special driving permits, etc., which prevents such plowing systems to be readily available and/or useable by many people. Furthermore, such long, elaborate and elongated systems, are also not optimal because the plowing action takes place very "remotely" from where the driver is placed and/or can see, thereby preventing the driver from following the side of the road adequately and operating the plowing component/wing in an "optimal" manner (ex. as close as to a given side edge as would be normally intended and/or required, etc.). Such long, elaborate and elongated systems, are also less desirable because they tend to be more "complicated" and "costly" to operated (greater fuel consumption, etc.) due to the long and considerable weight that needs to be hauled by the main/driving vehicle, which is also disadvantageous from an environmental point of view, etc.

Therefore, it would be particularly useful to be able to provide an improved plowing system which would be able to overcome or at the very least minimize some of known drawbacks associated with the conventional ways and devices used for plowing snow for example.

SUMMARY OF THE INVENTION

An object of the present invention is to provide a plowing system which, by virtue of its design and components, would be an improvement over other related conventional systems, devices and/or methods known in the prior art.

In accordance with the present invention, the above object is achieved, as will be easily understood from the present description, with a plowing system (also referred to herein simply as "product" and/or "system") such as the one briefly described herein and such as the one exemplified in the accompanying drawing(s). Furthermore, and in the context of the present description, the present plowing system may be referred to also as a "Wide Wing System" ("WWS"), which is one possible trademark name contemplated and/or owned by the Applicant/Assignee of the present application.

More particularly, according to one aspect of the present invention, an object is to provide a plowing system for removably mounting onto a vehicle in order to provide said vehicle with lateral plowing capability along a given lateral range of the vehicle, the plowing system comprising:

- a mounting assembly for removably and operatively mounting the plowing system onto the vehicle;
- a plowing assembly operatively mountable onto the vehicle via the mounting assembly, the plowing assembly comprising a plowing component pivotably mountable about a frontward portion of the mounting assembly, and being operable between retracted and deployed configurations within a given plowing angular range extending into the lateral range of the vehicle;
- a first actuating assembly operatively extendable between the plowing component and the mounting assembly, for selectively operating the plowing component between the retracted and deployed configurations, a proximate endof the first actuating assembly being operatively connectable onto a first base component of the plowing system, and a distal end of the first actuating assembly being operatively connectable to a rear portion of the plowing component, so that a corresponding movement of the first actuating assembly in turn operates the plowing component within the plowing angular range; and a second actuating assembly operatively extendable between the first actuating assembly and the mounting assembly, for cooperating with the first actuating assembly in order to selectively operate the first actuating assembly between the retracted and deployed configurations, a proximate end of the second actuating assembly being operatively connectable onto a second base component of the plowing system, and a distal end of the second actuating assembly being operatively connectable to a corresponding pivot component of the first actuating assembly, so as to provide the plowing system and associated plowing assembly and corresponding plowing component with an increased plowing resistivity within the lateral range of the vehicle, due to a combined effect of the first and second actuating assemblies.

According to yet another aspect of the invention, there is also provided a vehicle provided with the above-mentioned plowing system.

According to yet another aspect of the invention, there is also provided a method of manufacturing components of the above-mentioned plowing system and/or resulting vehicle.

According to yet another aspect of the invention, there is also provided a method of assembling components of the above-mentioned plowing system and/or corresponding vehicle.

According to yet another aspect of the invention, there is also provided a method of using the above-mentioned plowing system, corresponding vehicle and/or component(s) thereof.

According to yet another aspect of the invention, there is also provided a kit with components for assembling the above-mentioned plowing system and/or corresponding vehicle.

According to yet another aspect of the present invention, there is also provided a set of components for interchanging with components of the above-mentioned kit.

According to yet another aspect of the present invention, there is also provided a method of assembling components of the above-mentioned kit and/or set.

According to yet another aspect of the present invention, there is also provided a method of plowing a given road (ex. plowing snow off the road, etc.) with the above-mentioned plowing system, corresponding vehicle, component(s) thereof, kit, set and/or method(s).

According to yet another aspect of the present invention, there is also provided a method of doing business with the above-mentioned plowing system, corresponding vehicle, component(s) thereof, kit, set and/or method(s).

The objects, advantages, and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

Figure 1:
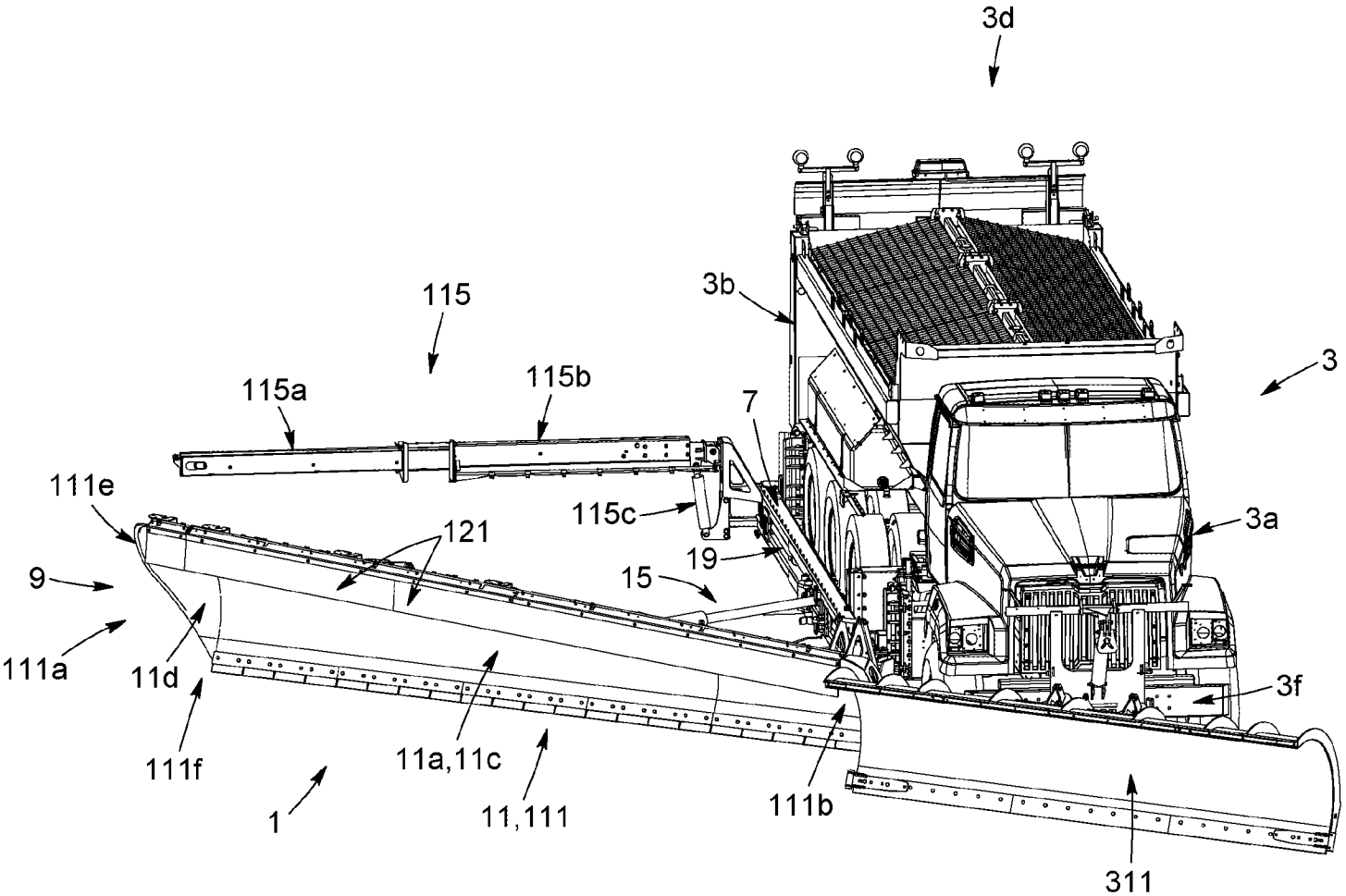
FIG. 1 is a front perspective view of a vehicle provided with a plowing system according to a possible embodiment of the present invention, the plowing being shown with its plowing assembly and associated plowing component in a given deployed configuration, and with its corresponding rearward blocking assembly being shown in a lowered (i.e. blocking) configuration.
Figure 2:
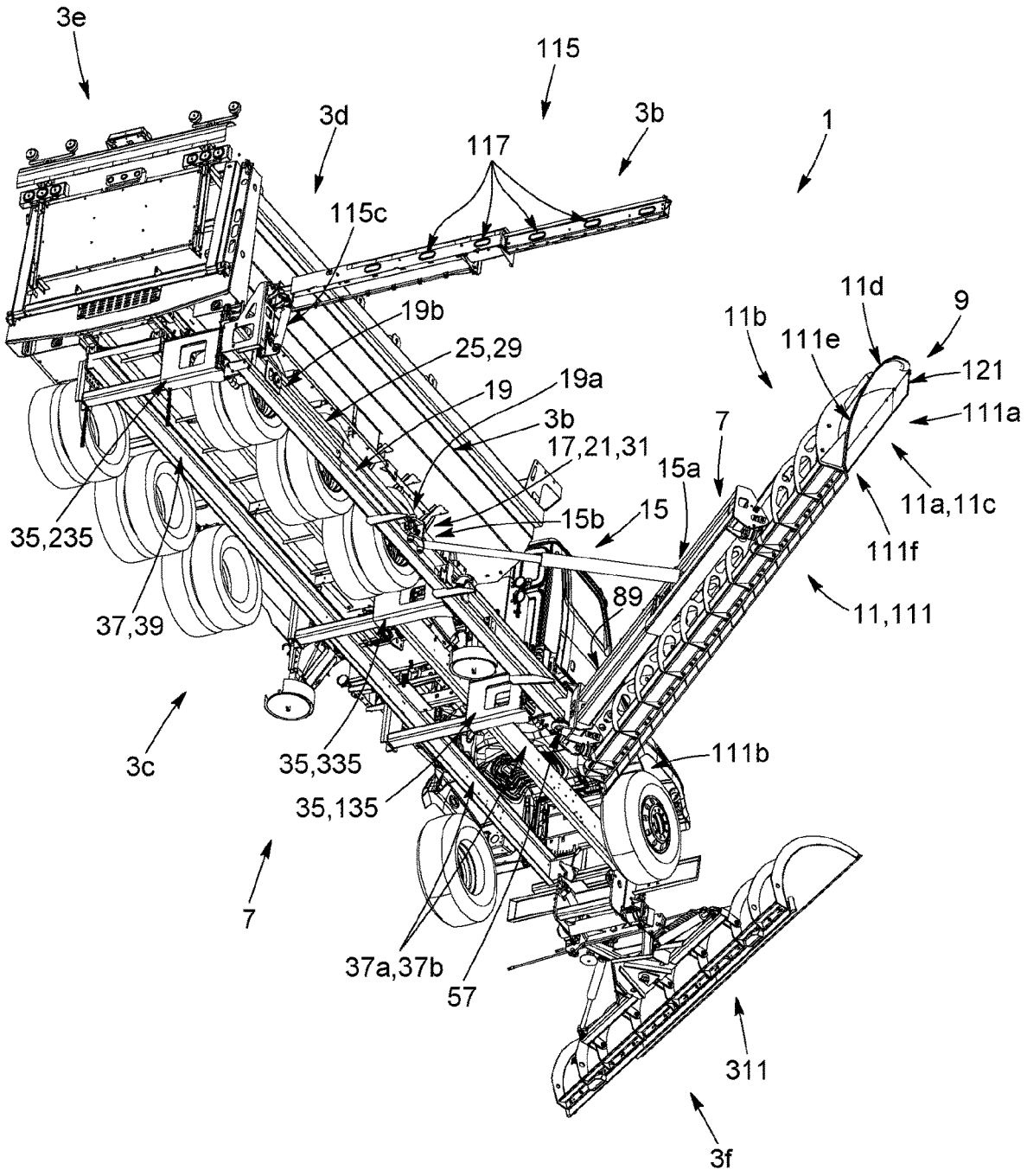
FIG. 2 is a bottom perspective view of what is shown in FIG. 1.
Figure 3:
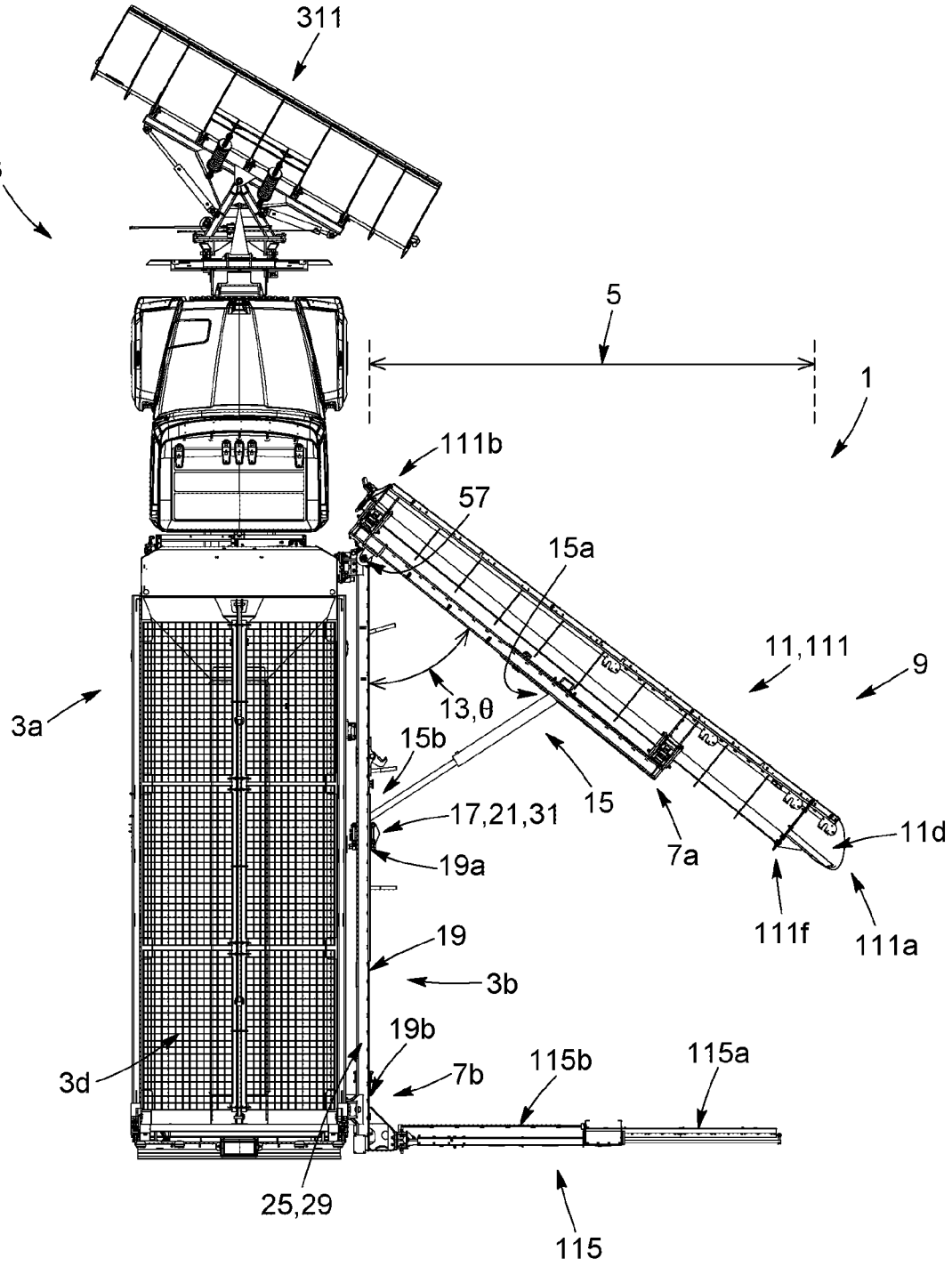
FIG. 3 is a top plan view of what is shown in FIG. 1.
Figure 4:
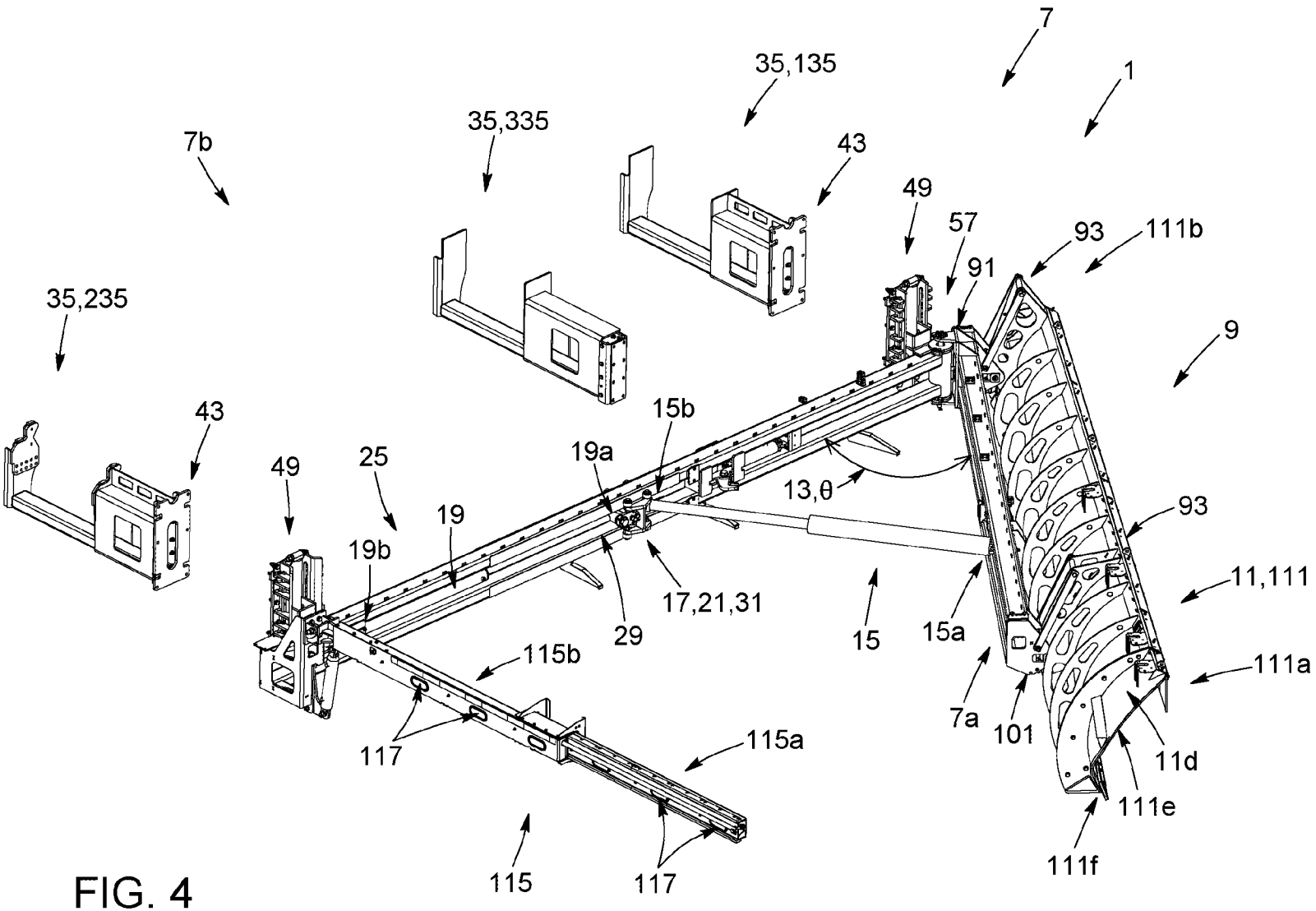
FIG. 4 is a top perspective view of a plowing system being shown with corresponding mounting components, as well as height-adjustment and vertical-adjustment assemblies, according to a possible embodiment of the present invention, the mounting components being shown in an exploded relation with respect to a corresponding track assembly of the plowing system according to a possible embodiment of the present invention.
Figure 5:
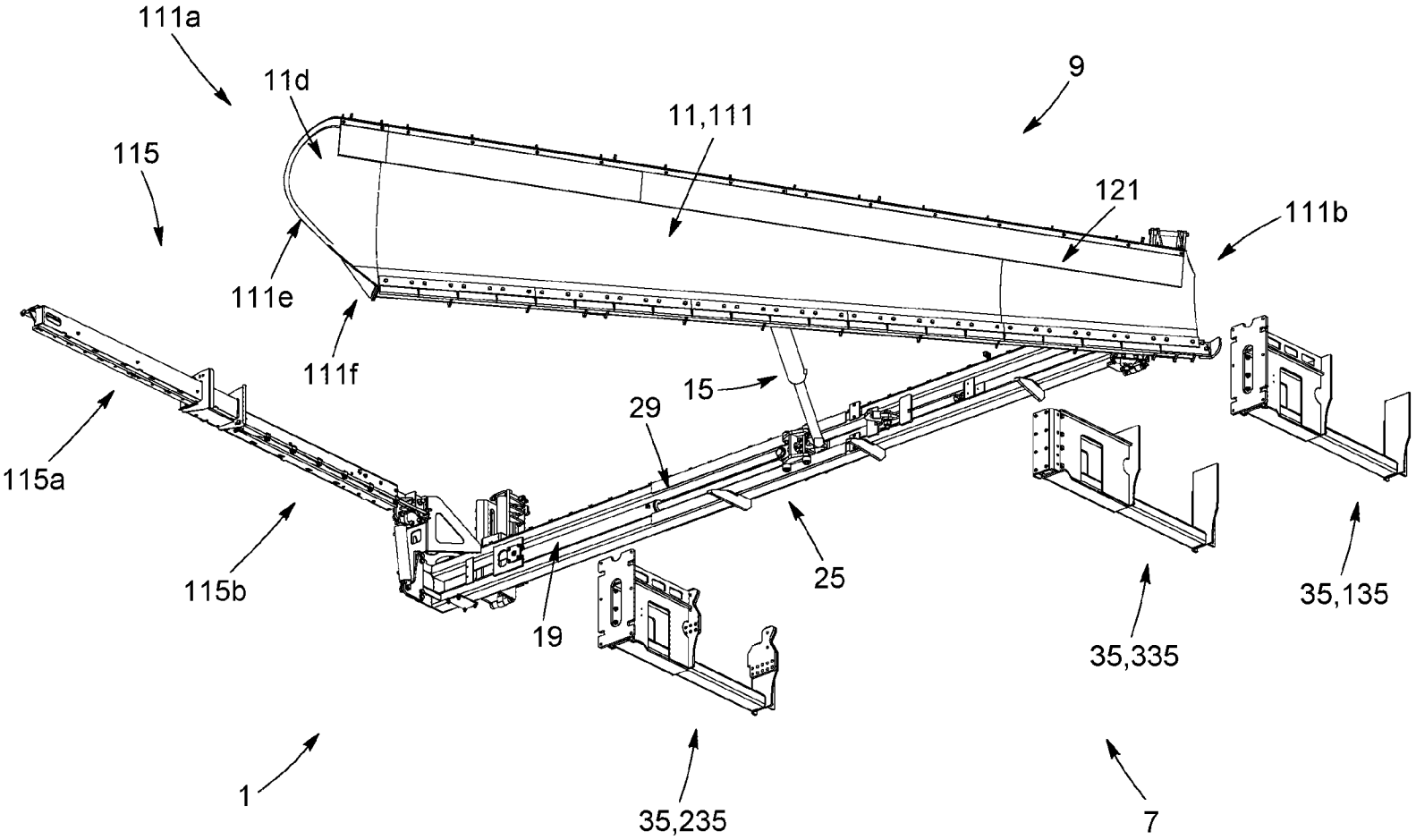
FIG. 5 is a bottom perspective view of what is shown in FIG. 4.
Figure 6:
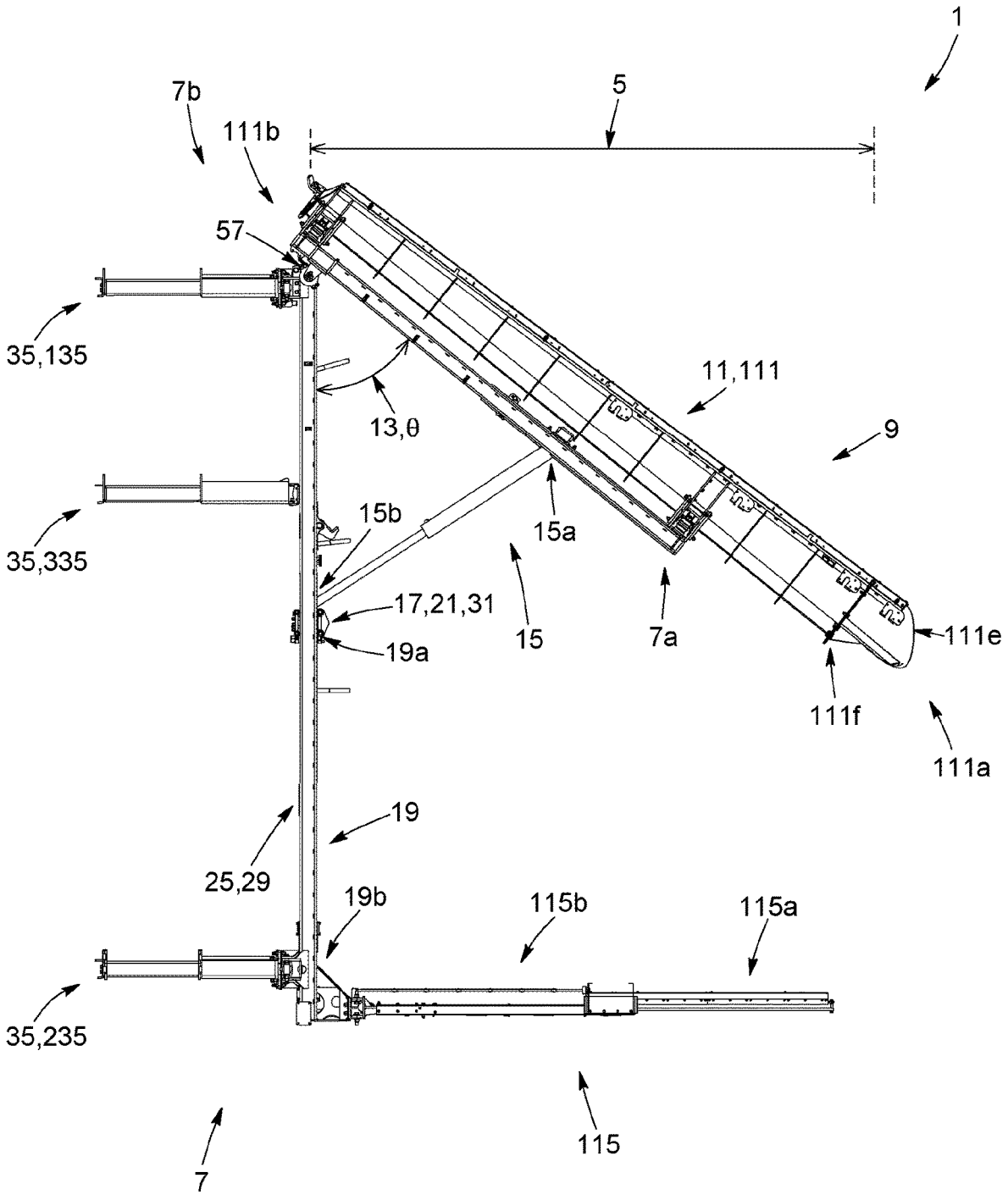
FIG. 6 is a top plan view of what is shown in FIG. 4, the mounting components of the mounting assembly being now show connected to the track assembly of the plowing system according to a possible embodiment of the present invention.
Figure 7:
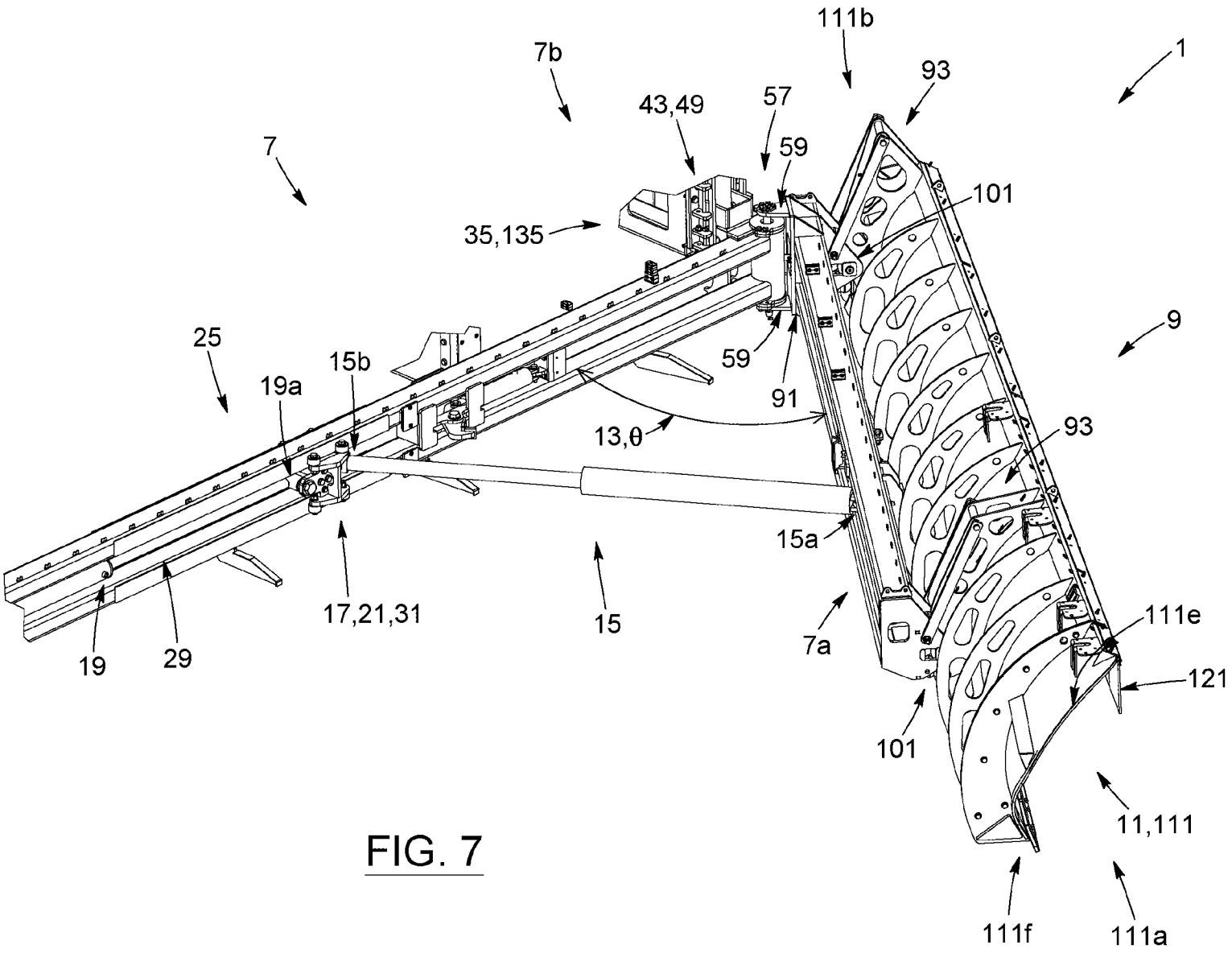
FIG. 7 is an enlarged view of a portion of what is shown in FIG. 4.
Figure 8:
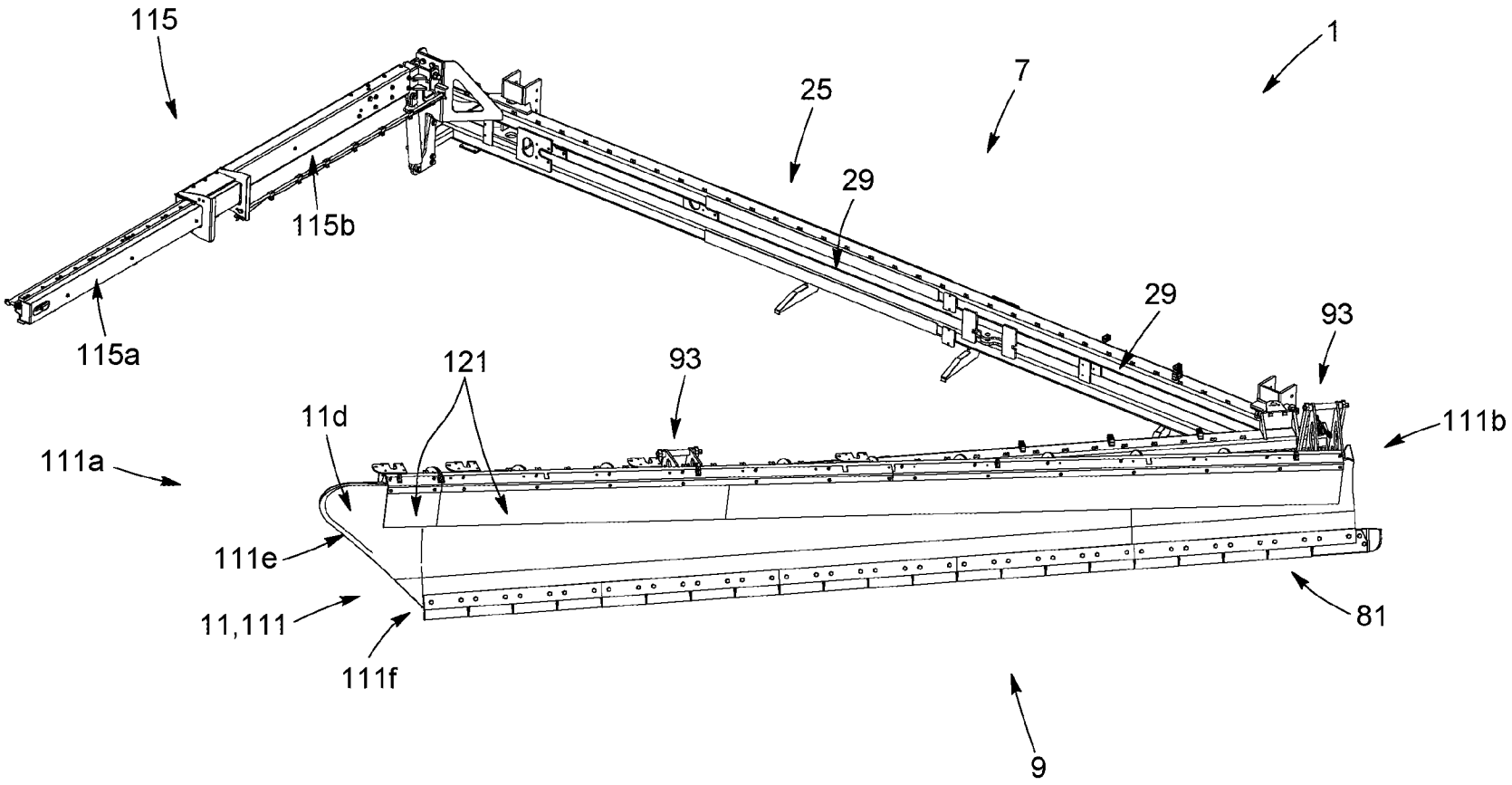
FIG. 8 is another top perspective view of what is shown in FIG. 4, the plowing system being shown now without its first and second actuating assemblies and mounting components, as well as height-adjustment and vertical-adjustment assemblies, to better illustrate remaining components of the plowing system, including the sidetrack of the track assembly.
Figure 9:
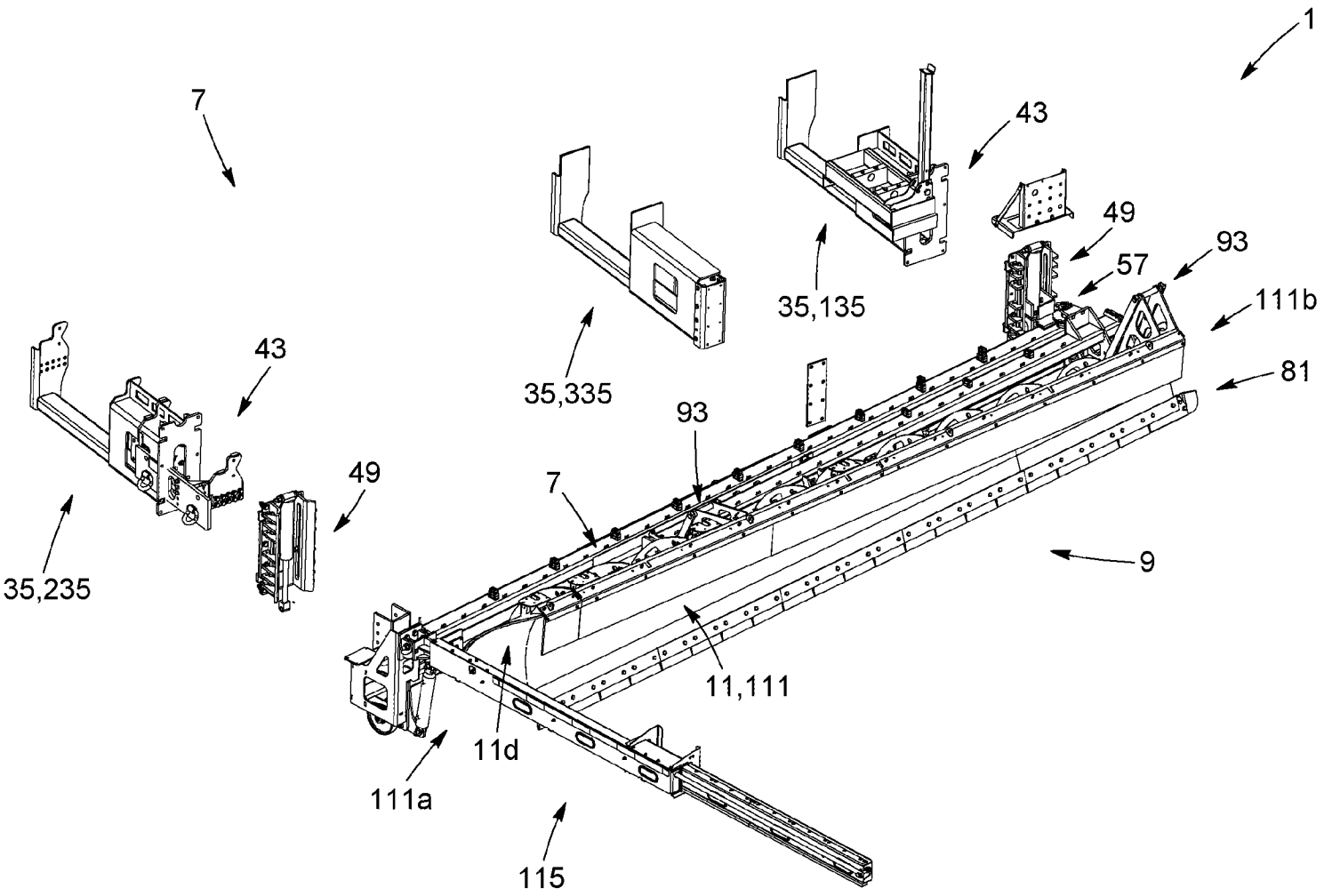
FIG. 9 is another top perspective view of what is shown in FIG. 4, the plowing system being now show with its plowing assembly and associated plowing component in a retracted configuration, according to a possible embodiment of the present invention, and the mounting components as well as part of the height-adjustment and vertical-adjustment assemblies being shown in an exploded relation with respect to a corresponding track assembly of the plowing system, to better illustrate cooperation between components of the plowing system.
Figure 10:
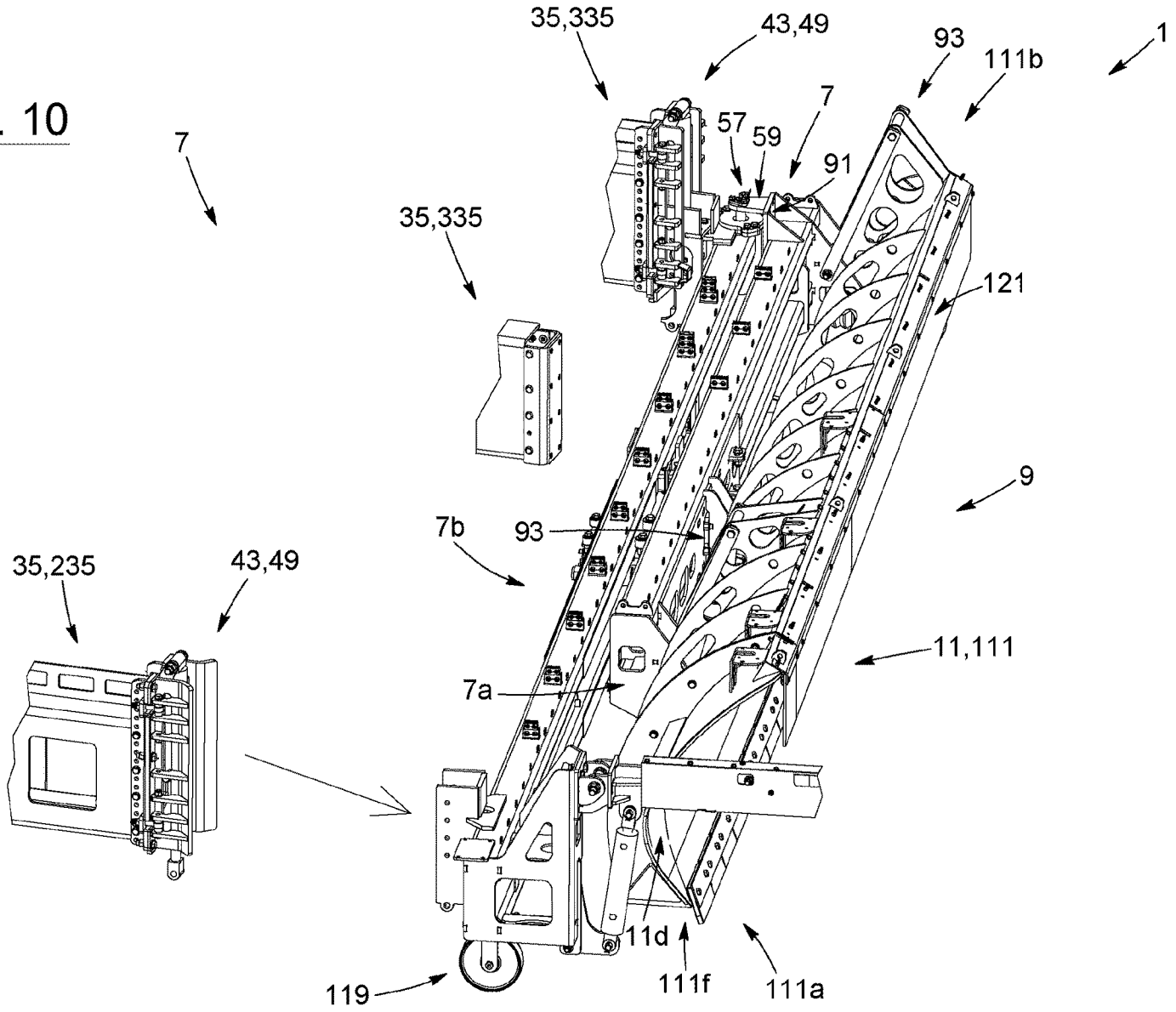
FIG. 10 is an enlarged rear end perspective view of a portion of what is shown in FIG. 9, to better illustrate the plowing assembly and associated plowing component of the plowing system in a retracted configuration.
Figure 11:
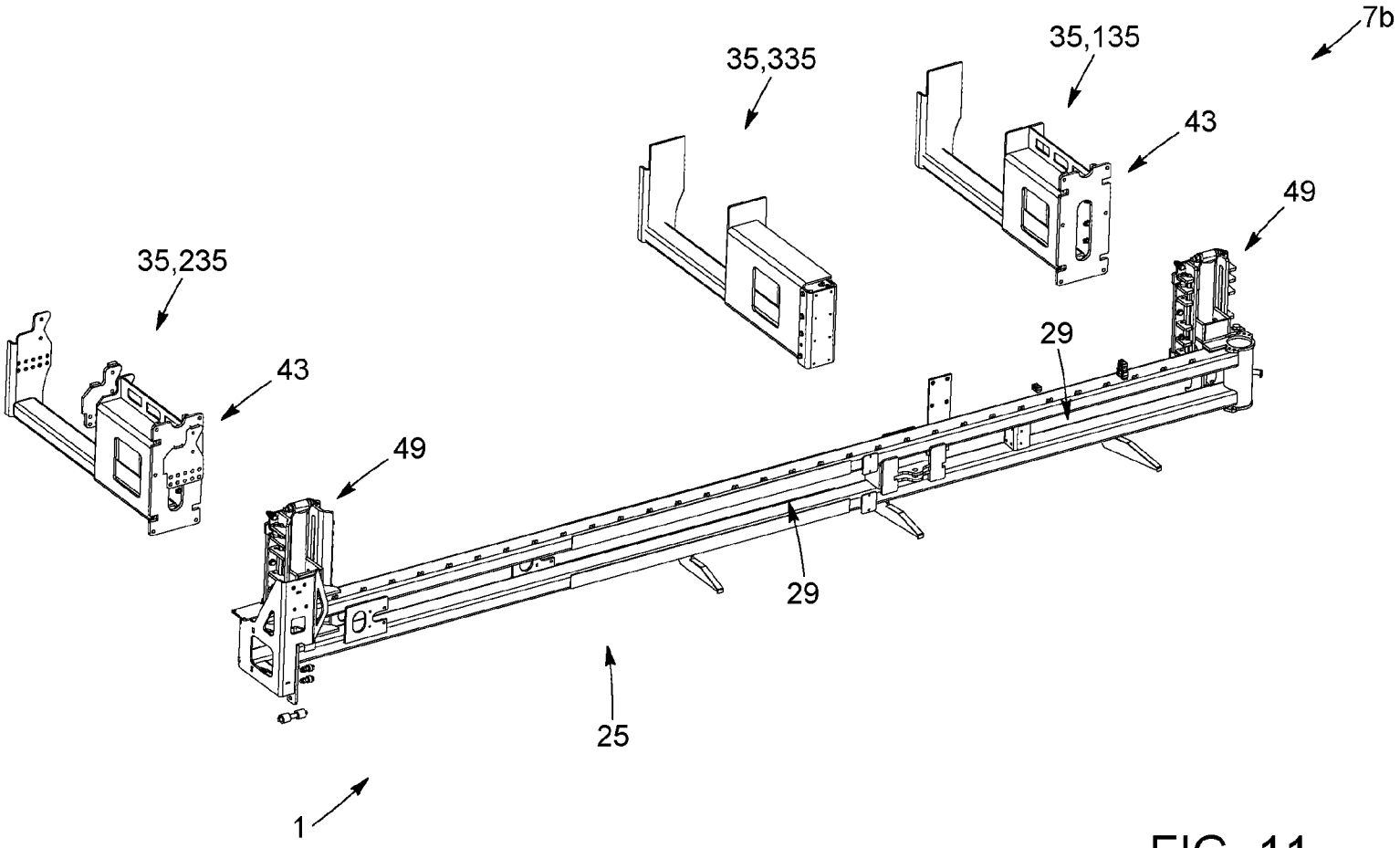
FIG. 11 is a top perspective view of a mounting assembly and associated track assembly being shown with corresponding mounting components, as well as height-adjustment and vertical-adjustment assemblies, according to a possible embodiment of the present invention, the mounting components being shown in an exploded relation with respect to a corresponding sidetrack of the track assembly of the plowing system according to a possible embodiment of the present invention.
Figure 12:
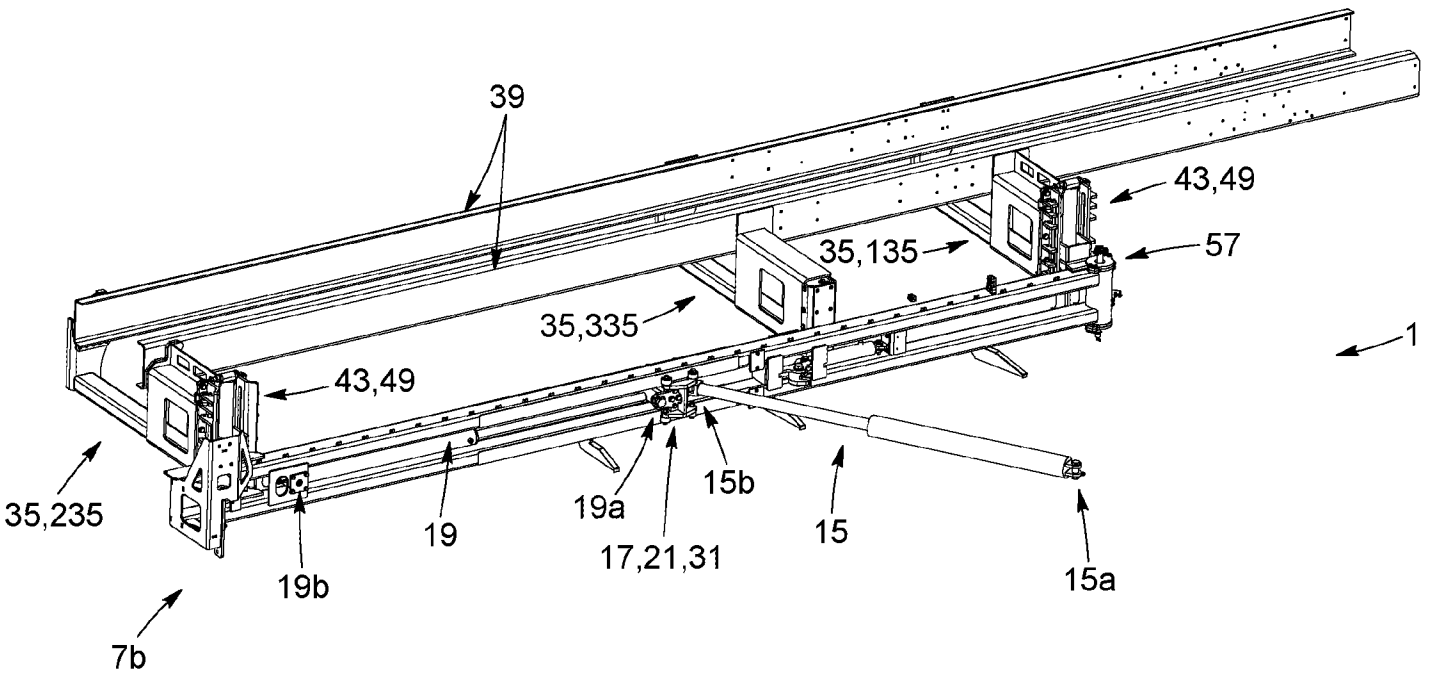
FIG. 12 is a top perspective view of what is shown in FIG. 11, the plowing system being shown with the sidetrack of the track assembly, and corresponding height-adjustment and vertical-adjustment assemblies, being operatively connected onto the mounting components, and with said mounting components being operatively mounted onto corresponding longitudinal beams of a vehicle according to a possible embodiment of the present invention, the plowing system being further shown with first and second actuation assemblies cooperating with one another according to a possible embodiment of the present invention.
Figure 13:
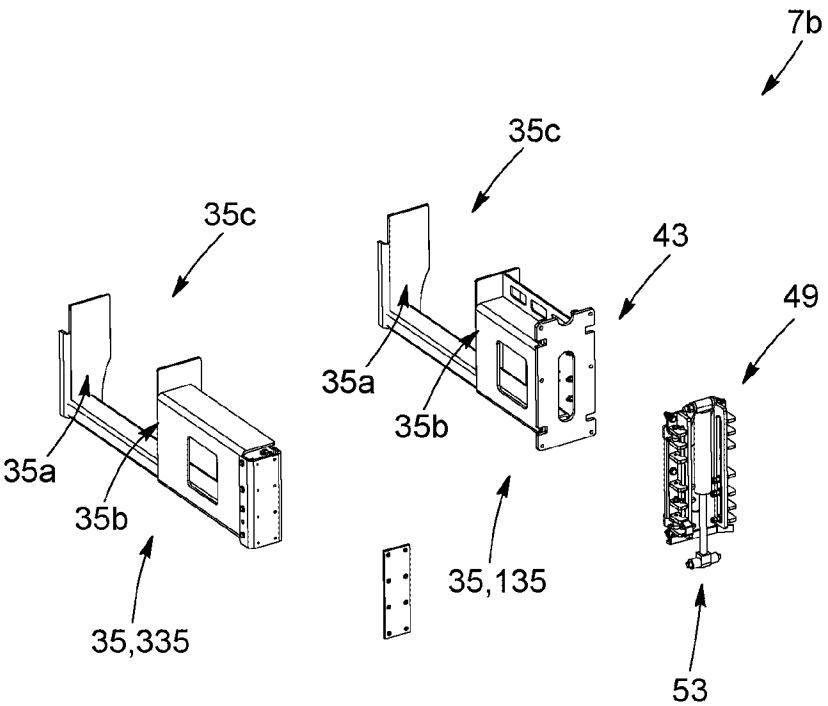
FIG. 13 is a top perspective view of front, intermediate and rear mounting components, as well as corresponding height-adjustment and vertical-adjustment assemblies, and other accessory components, according to a possible embodiment of the present invention, the vertical-adjustment assemblies and other components of the plowing system being shown in an exploded relation with respect to corresponding height-adjustment assemblies of the plowing system according to a possible embodiment of the present invention.
Figure 13:
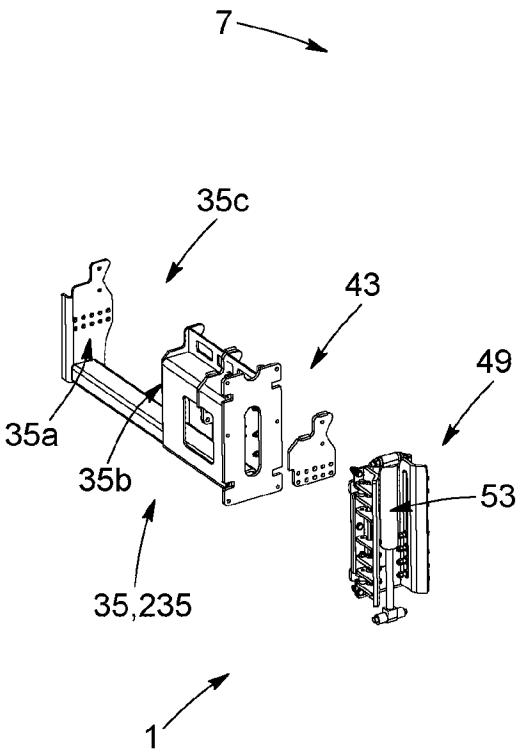
Figure 14:
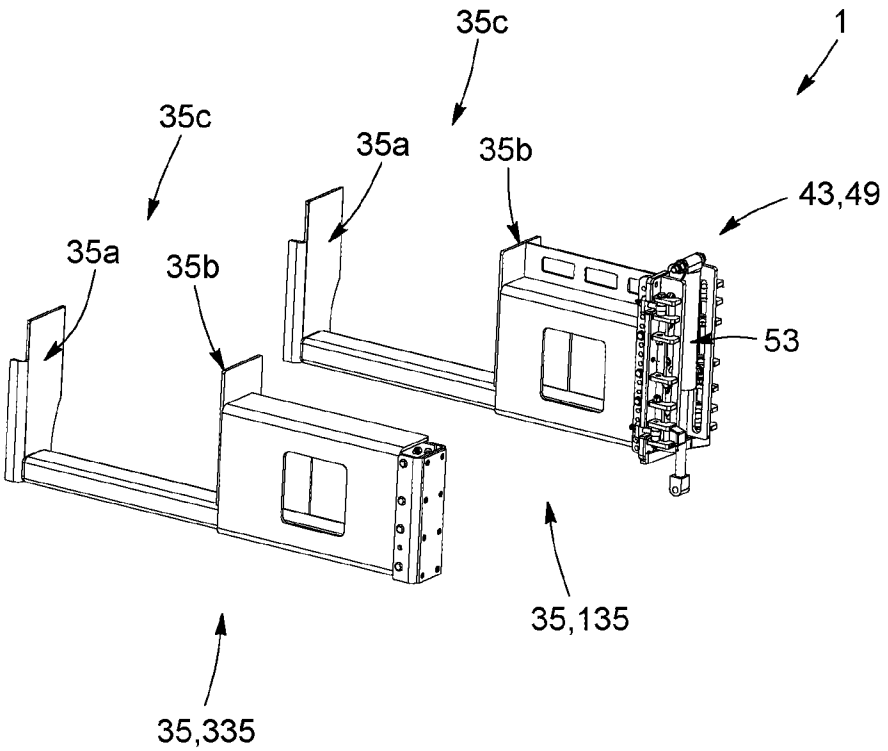
FIG. 14 is another top perspective view of what is shown in FIG. 13, the vertical-adjustment assemblies and other components being now shown connected to respective mounting components.
Figure 14:
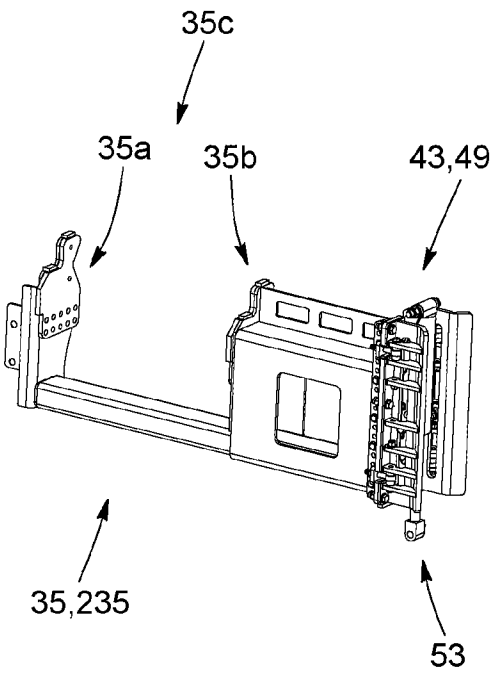
Figure 16:
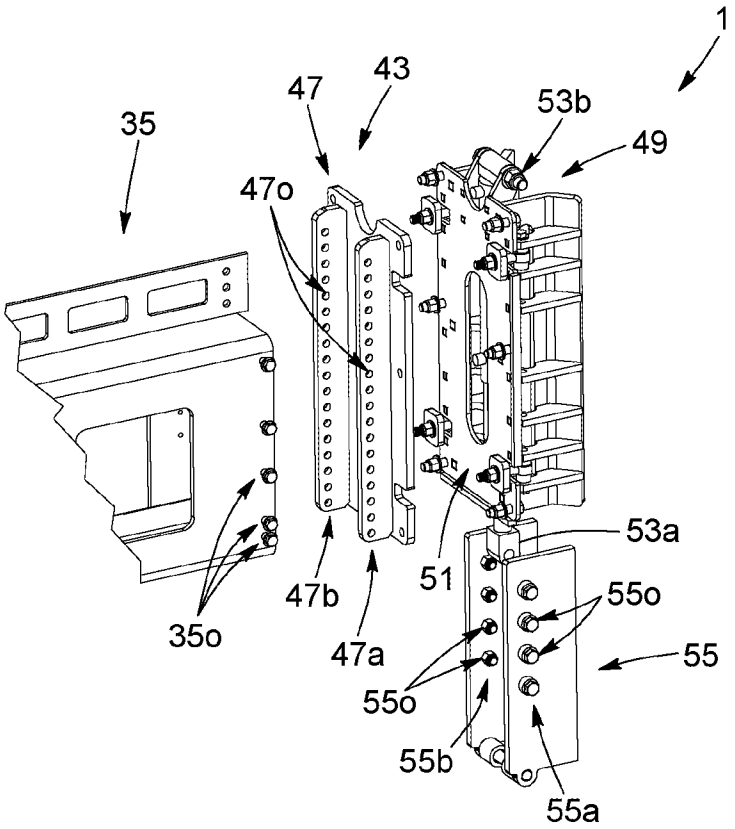
FIG. 16 is a side perspective view of what is shown in FIG. 15.
Figure 15:
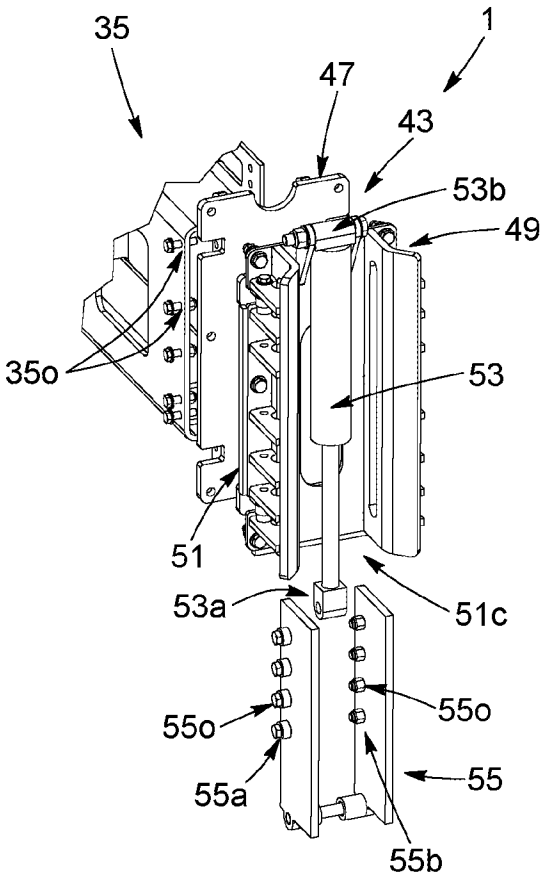
FIG. 15 is an enlarged view of a portion of one of the mounting components shown in FIG. 14, an end of the mounting component and associated height-adjustment and vertical-adjustment assemblies being shown in an exploded relation with respect to one another, along with corresponding fasteners, according to a possible embodiment of the present invention.
Figure 17:
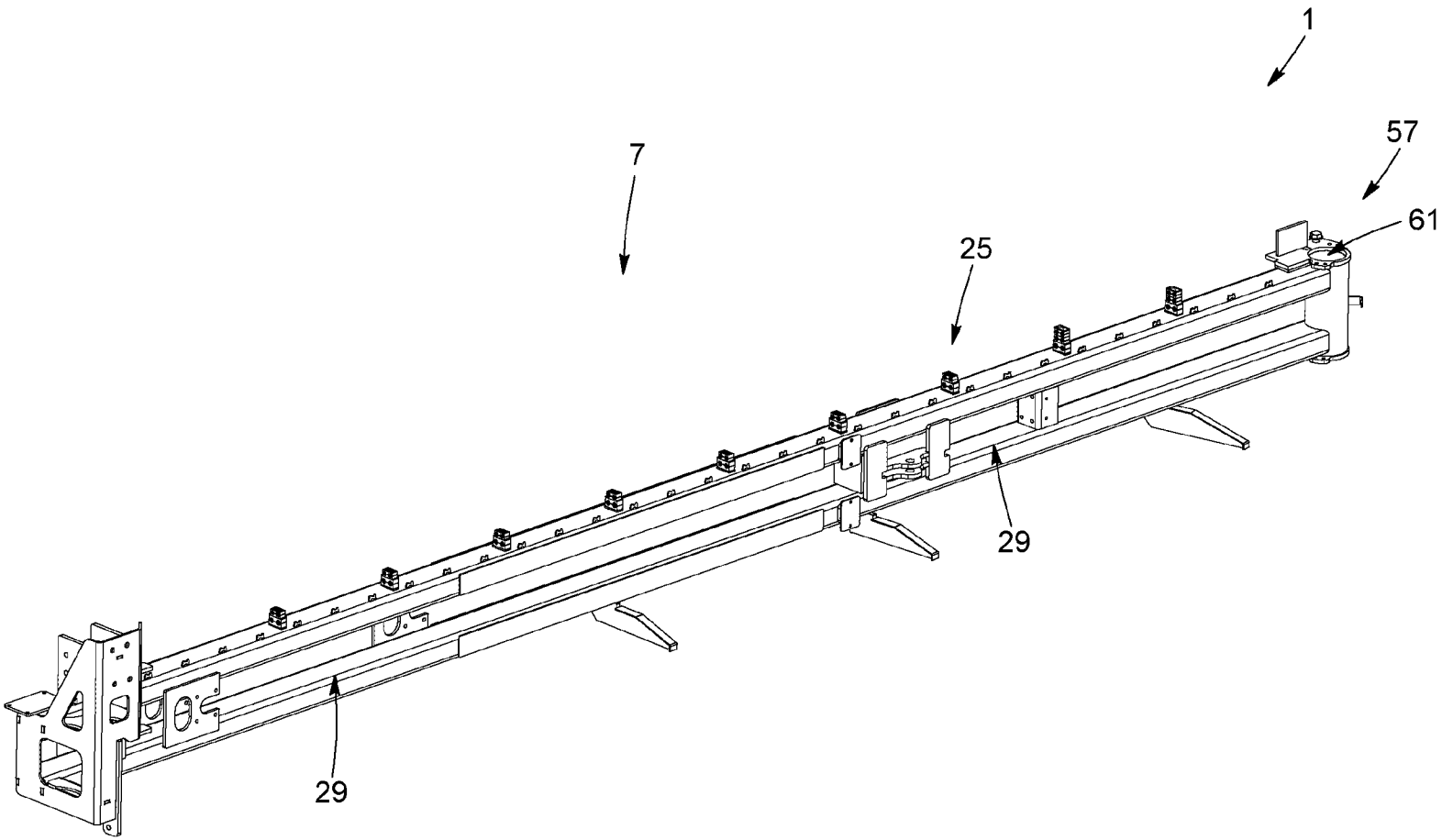
FIG. 17 is a perspective view of the track assembly and associated sidetrack shown in FIG. 4.
Figure 18:
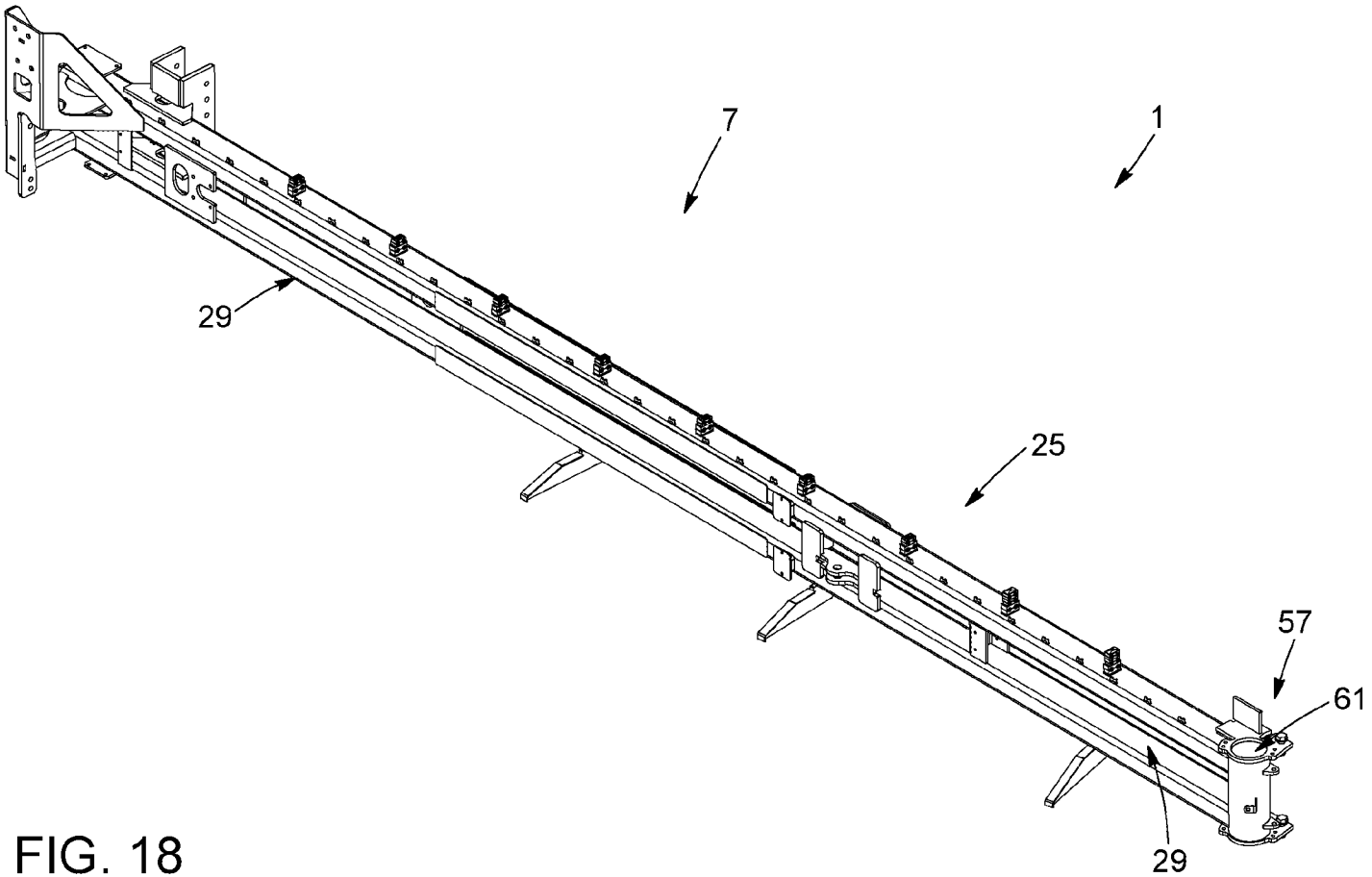
FIG. 18 is another perspective view of what is shown in FIG. 17.
Figure 20:
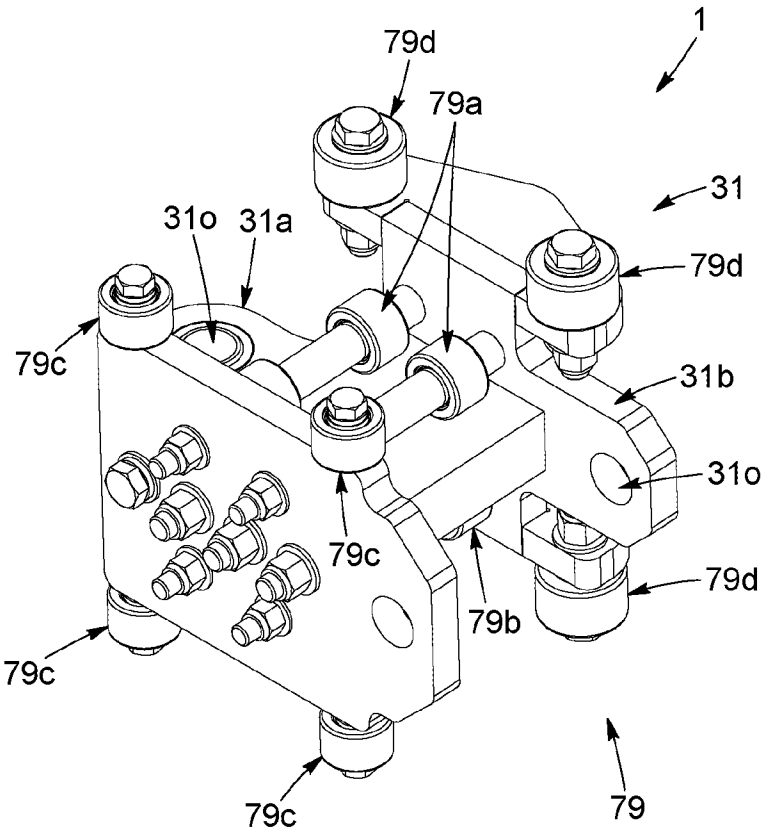
FIG. 20 is another top perspective view of what is shown in FIG. 19.
Figure 19:
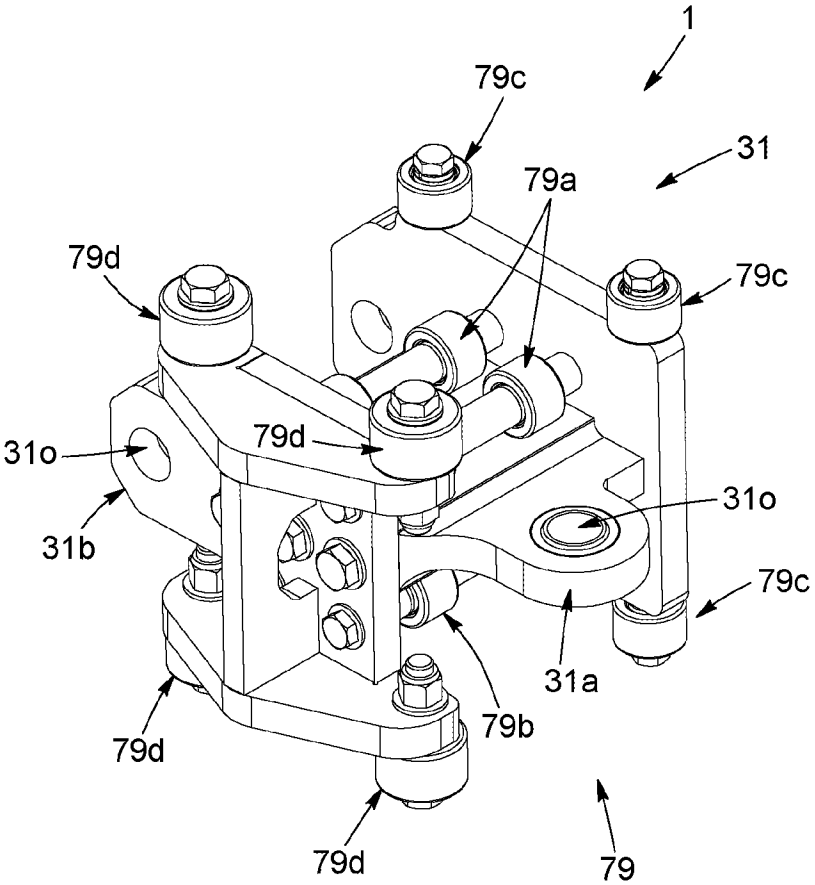
FIG. 19 is a top perspective view of the carriage component shown in FIG. 4.
Figure 21:
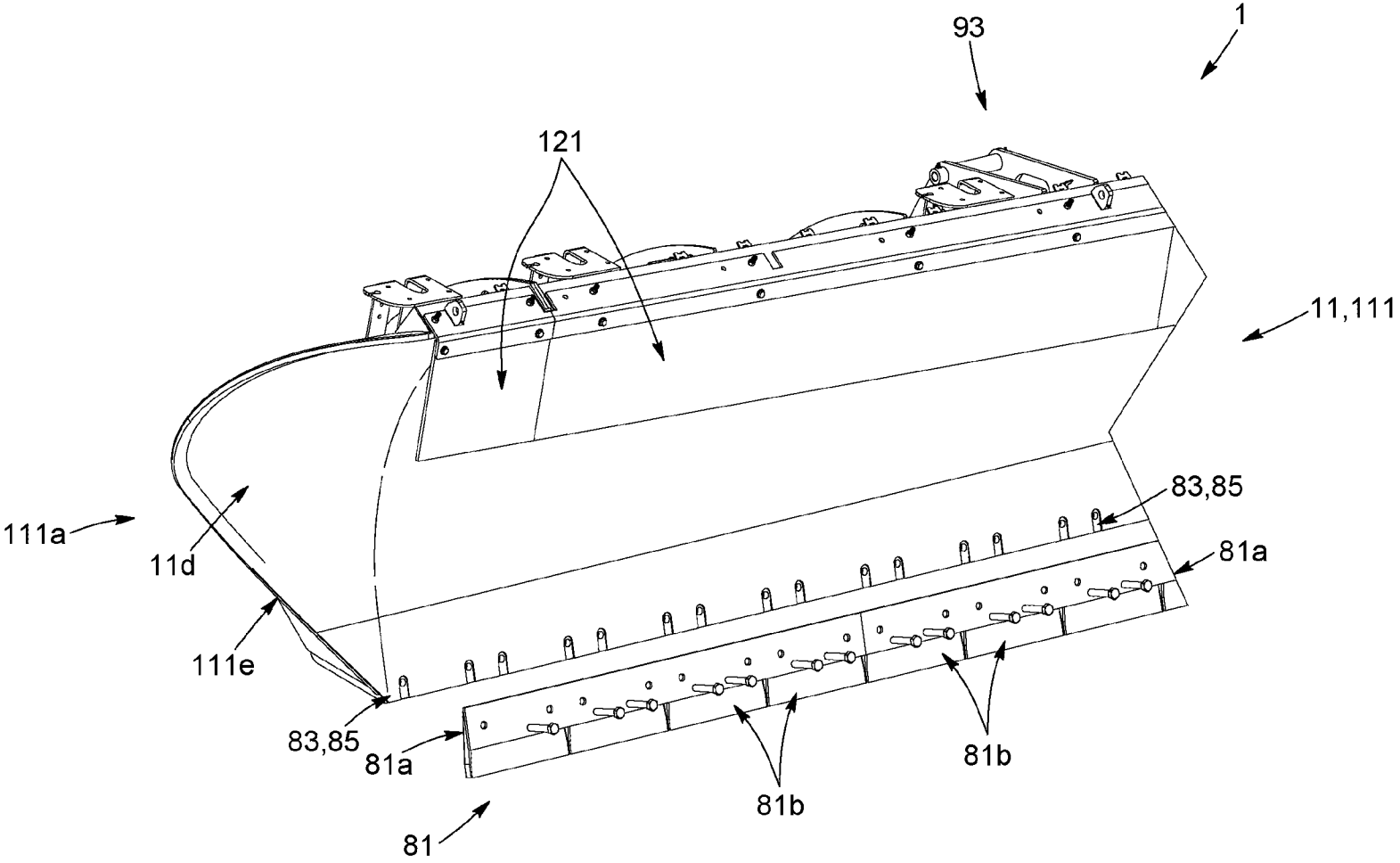
FIG. 21 is a perspective of a distal portion of the plowing assembly shown in FIG. 1, the scraping components and corresponding fasteners being shown in an exploded relation with respect to a main body of the plowing component, according to a possible embodiment of the present invention.
Figure 22:
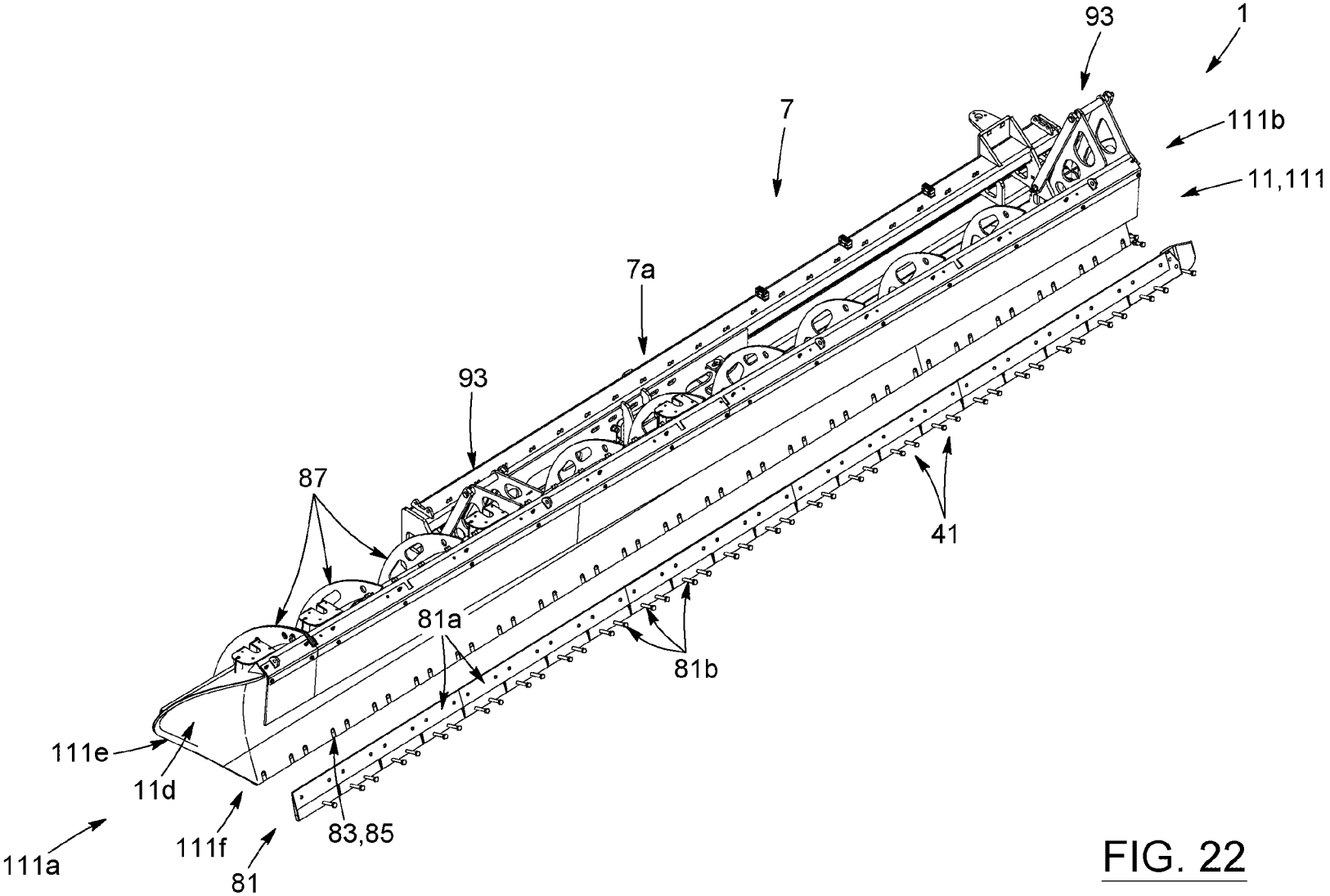
FIG. 22 is a top perspective view of the plowing assembly and associated plowing component of FIG. 9 in a retracted configuration, the scraping components and corresponding fasteners being shown in an exploded relation with respect to a main body of the plowing component, according to a possible embodiment of the present invention.
Figure 23:
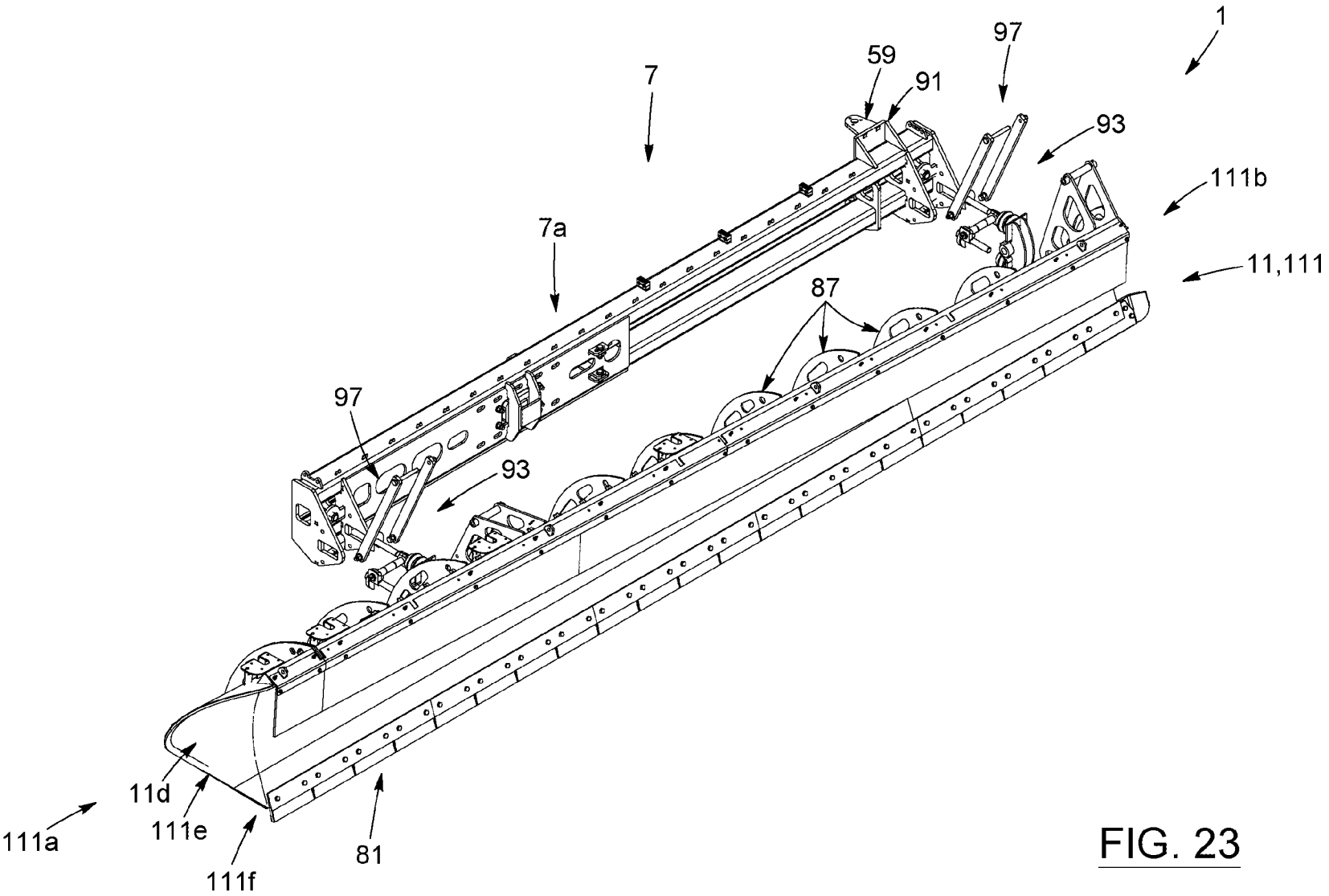
FIG. 23 is another top perspective view of what is shown in FIG. 22, the scraping components and corresponding fasteners being now shown mounted on the main body of the plowing component, and the mounting assembly and associated tilting assemblies, being shown in an exploded relation with respect to the plowing component, to better illustrate cooperation between components of the plowing system, including the presence of corresponding dampening assemblies according to a possible embodiment of the present invention.
Figure 24:
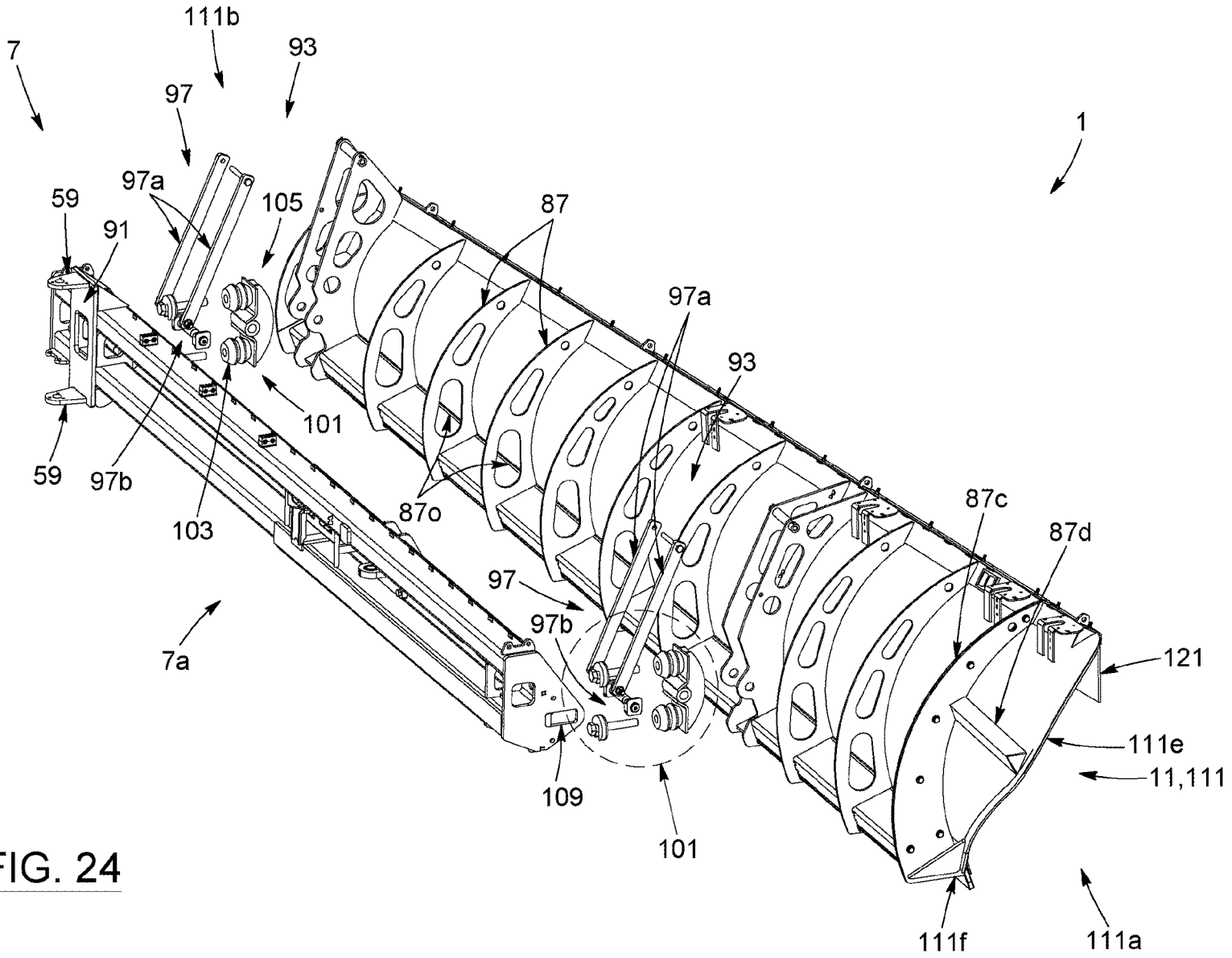
FIG. 24 is a rear perspective view of what is shown in FIG. 23.
Figure 25:
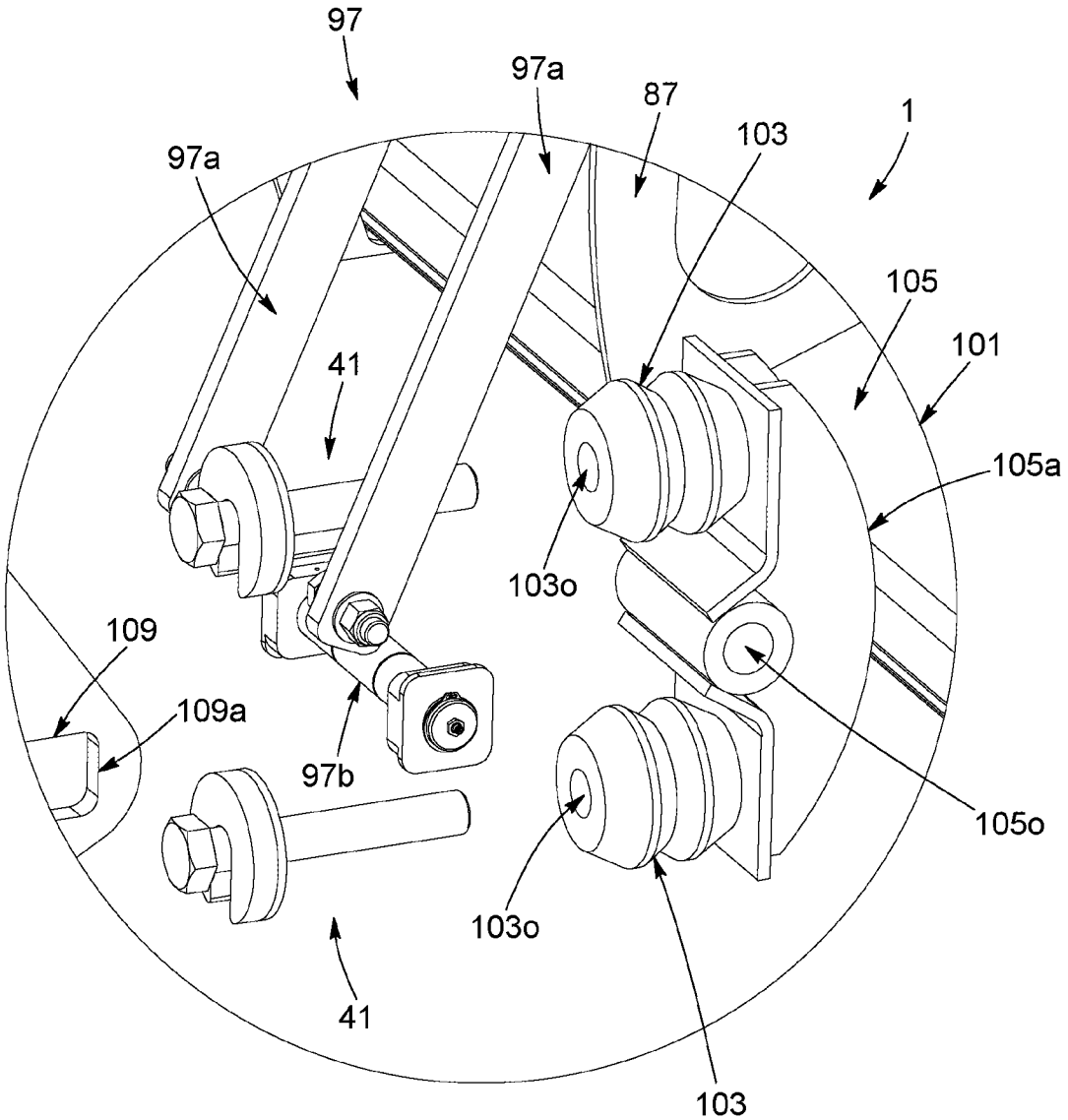
FIG. 25 is an enlarged view of a portion of what is shown in FIG. 24.
Figure 26:
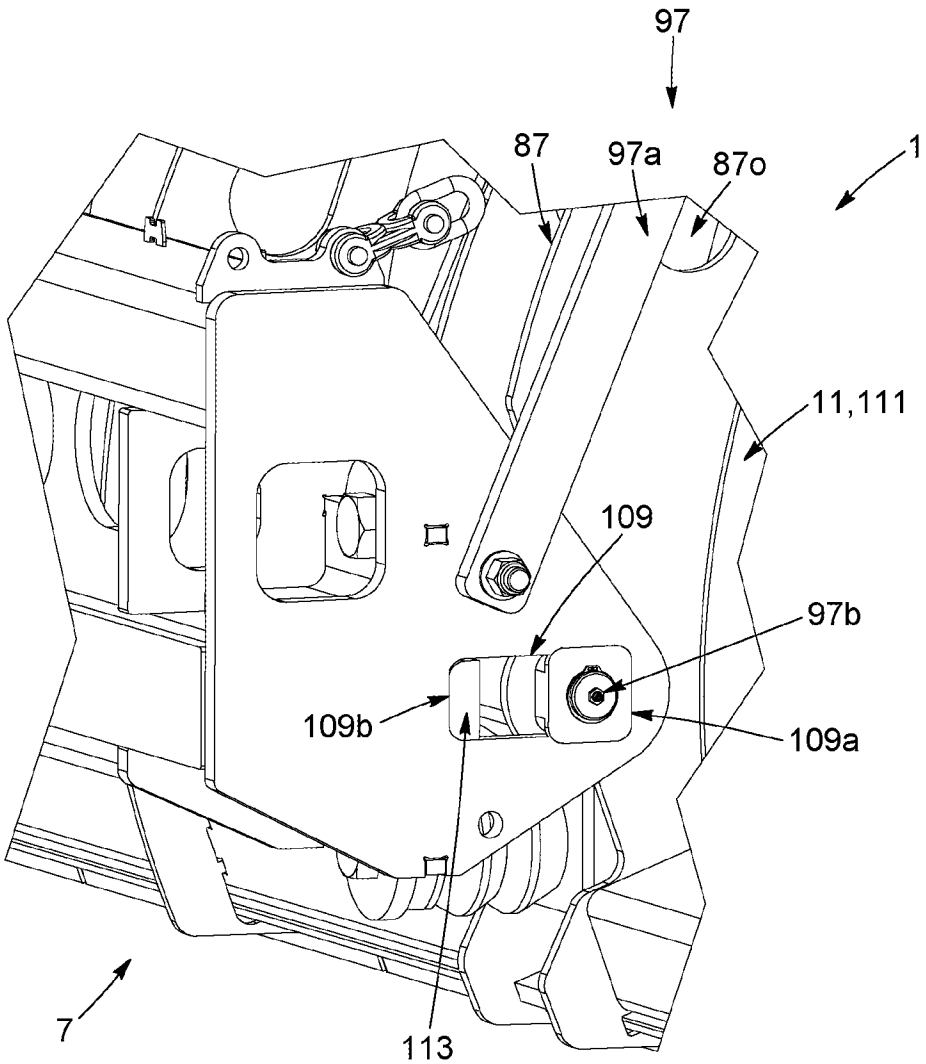
FIG. 26 is an enlarged view of a portion of what is shown in FIG. 24, the components being now shown in assembled configuration, with the tilting assembly in a configuration corresponding to a default operating configuration of the plowing assembly and associated plowing component.
Figure 28:
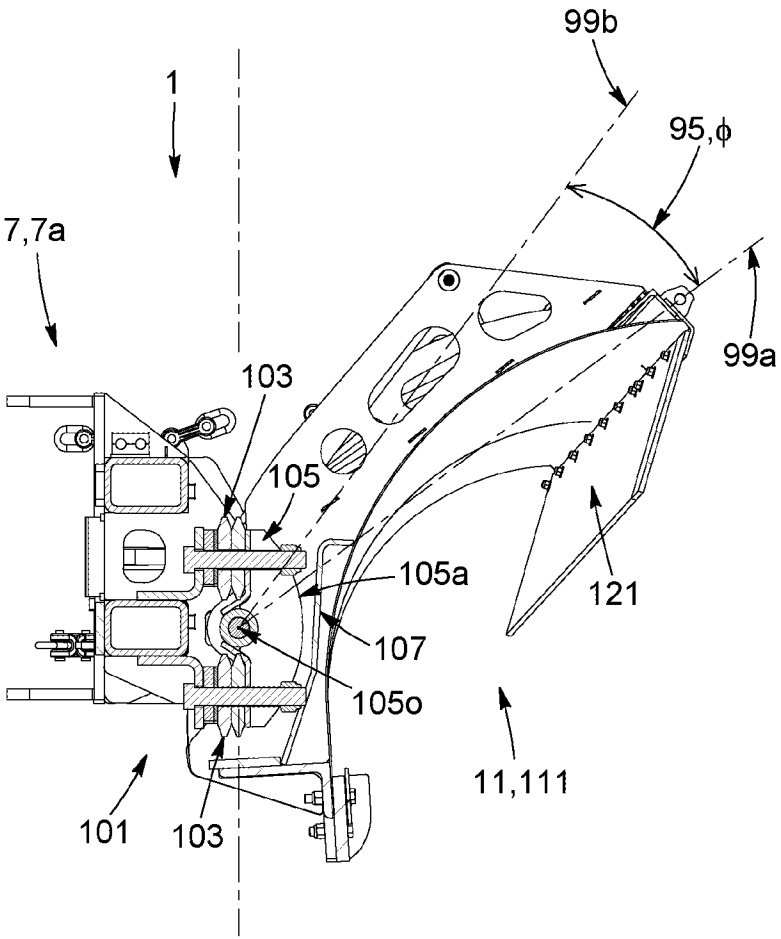
FIG. 28 is another side view of what is shown in FIG. 27, the plowing assembly and associated plowing component being shown now in a tilted operating configuration, and some of the components of the tilting assembly being shown taken along a same cross-sectional view to better illustrate cooperation between components.
Figure 27:
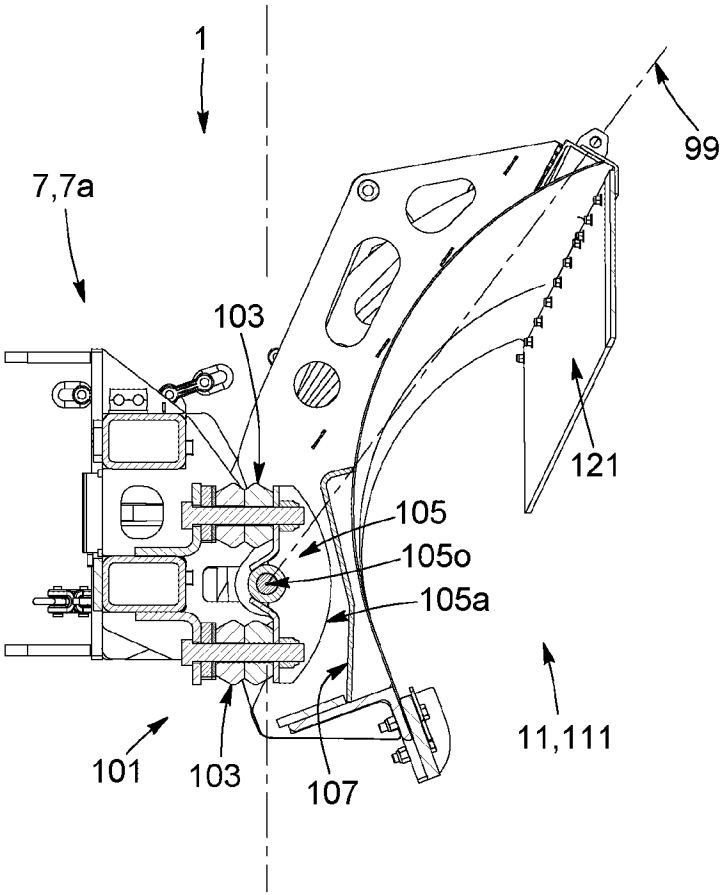
FIG. 27 is a side view of a plowing assembly and associated plowing component being provided with a tilting assembly and corresponding dampening assembly according to a possible embodiment of the present invention, the plowing assembly and associated plowing component being shown in a default operating configuration, and some of the components of the tilting assembly being shown taken along a given cross-sectional view to better illustrate cooperation between components.
Figure 29:
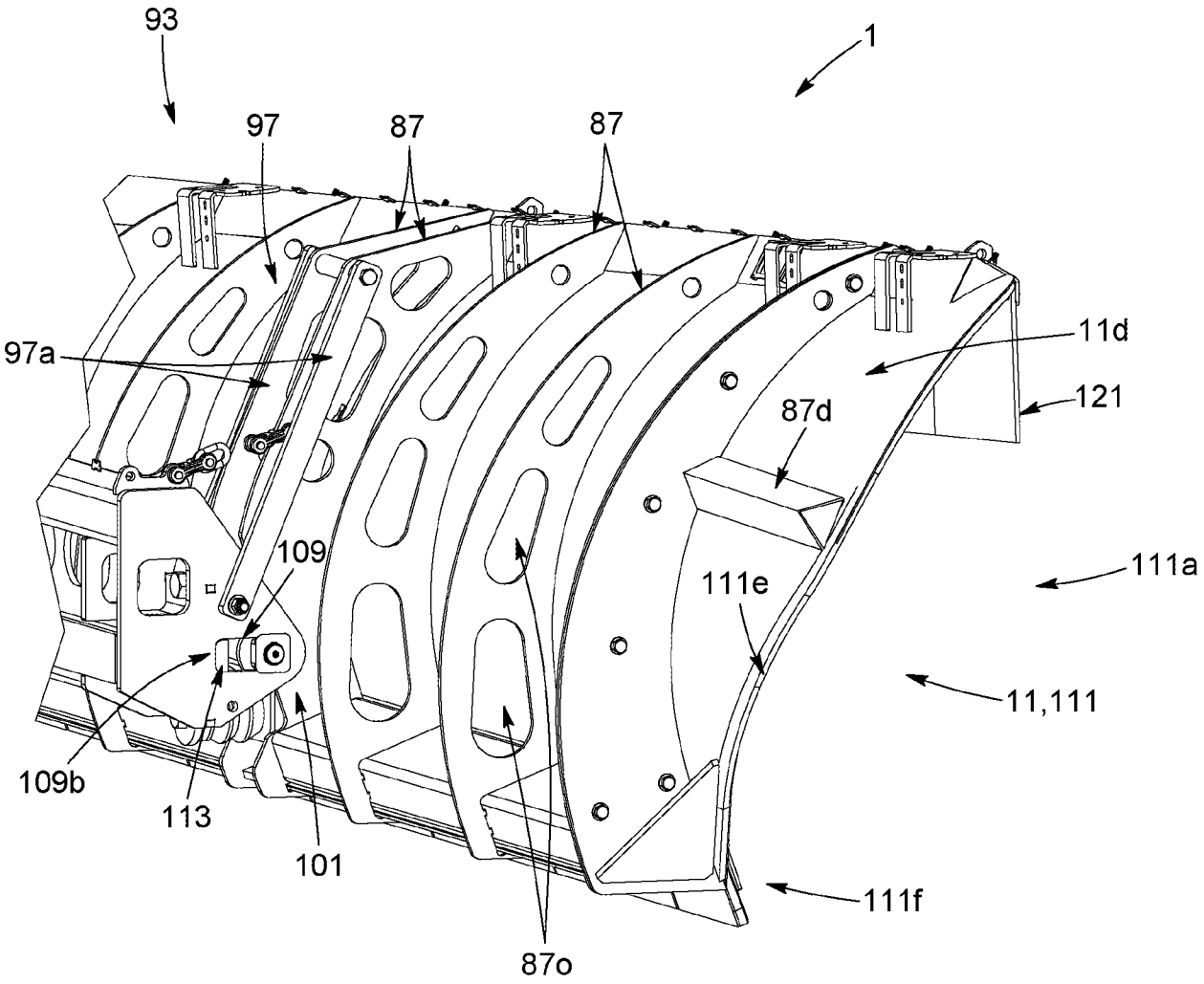
FIG. 29 is a partial perspective view of a distal portion of a plowing assembly and associated plowing component being provided with a tilting assembly and corresponding dampening assembly according to a possible embodiment of the present invention, the plowing assembly and associated plowing component being shown in a default operating configuration.
Figure 30:
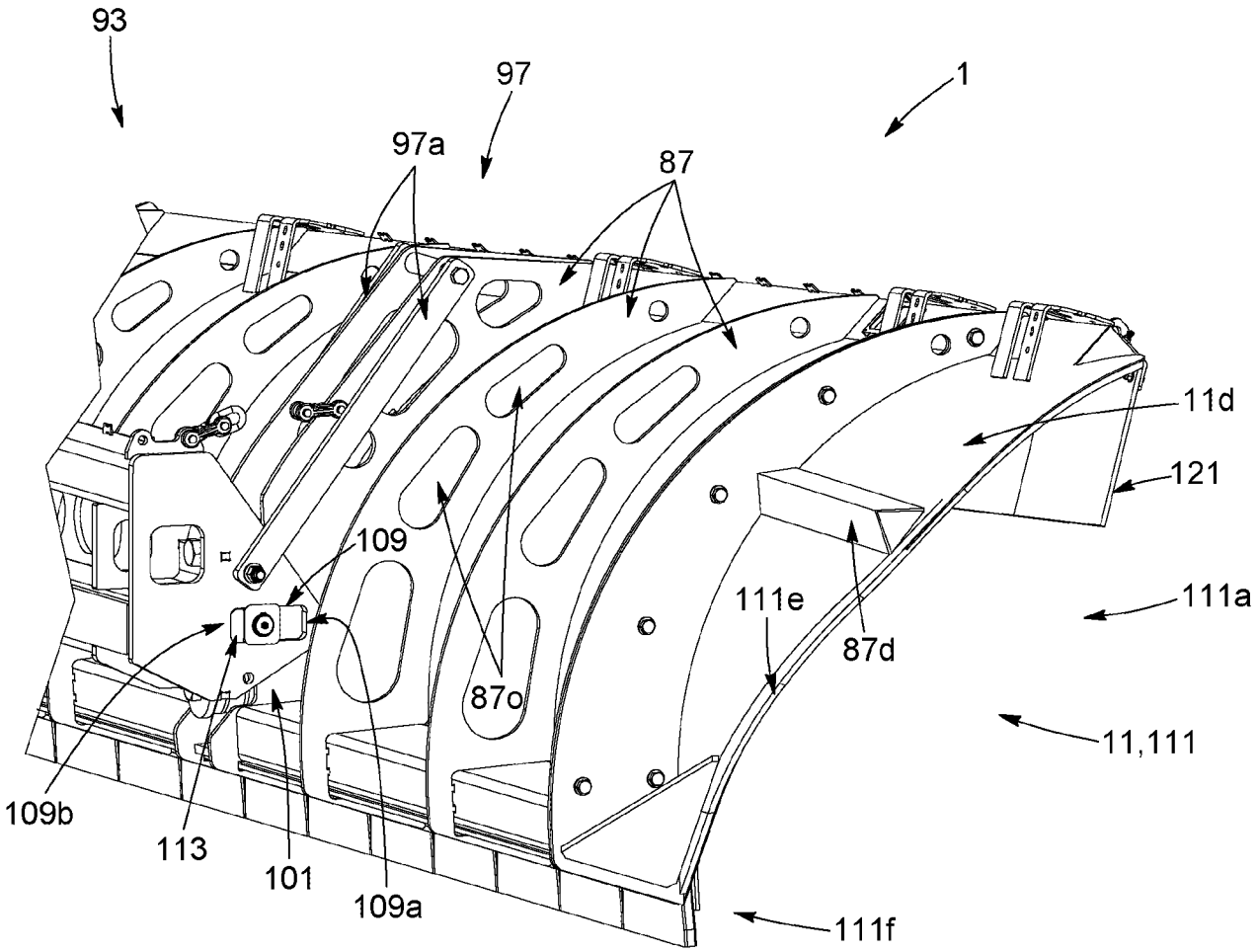
FIG. 30 is another perspective view of what is shown in FIG. 29, the plowing assembly and associated plowing component being shown now in a tilted operating configuration.
Figure 31:
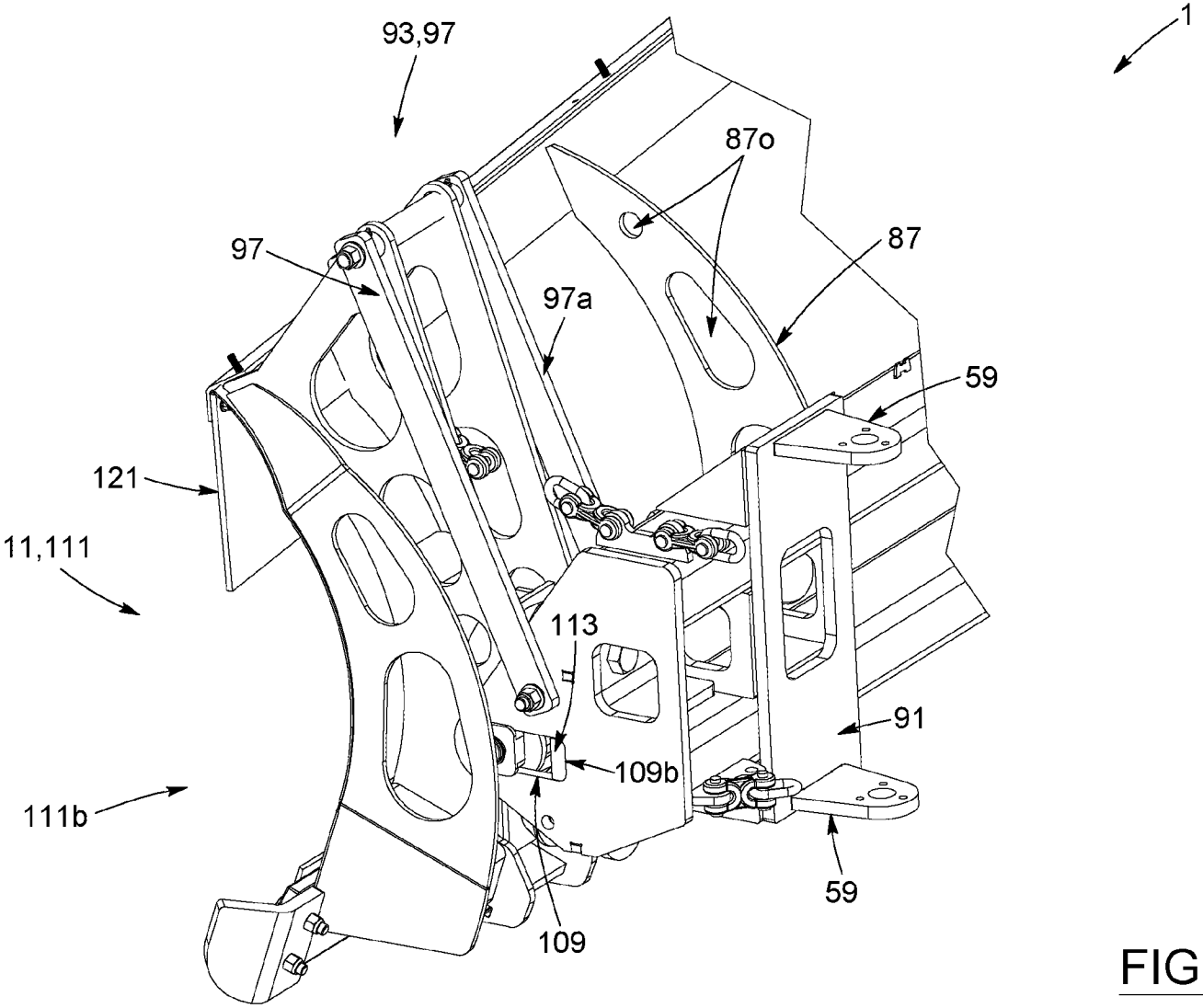
FIG. 31 is a partial perspective view of a proximate portion of a plowing assembly and associated plowing component being provided with a tilting assembly and corresponding dampening assembly according to a possible embodiment of the present invention, the plowing assembly and associated plowing component being shown in a default operating configuration.
Figure 32:
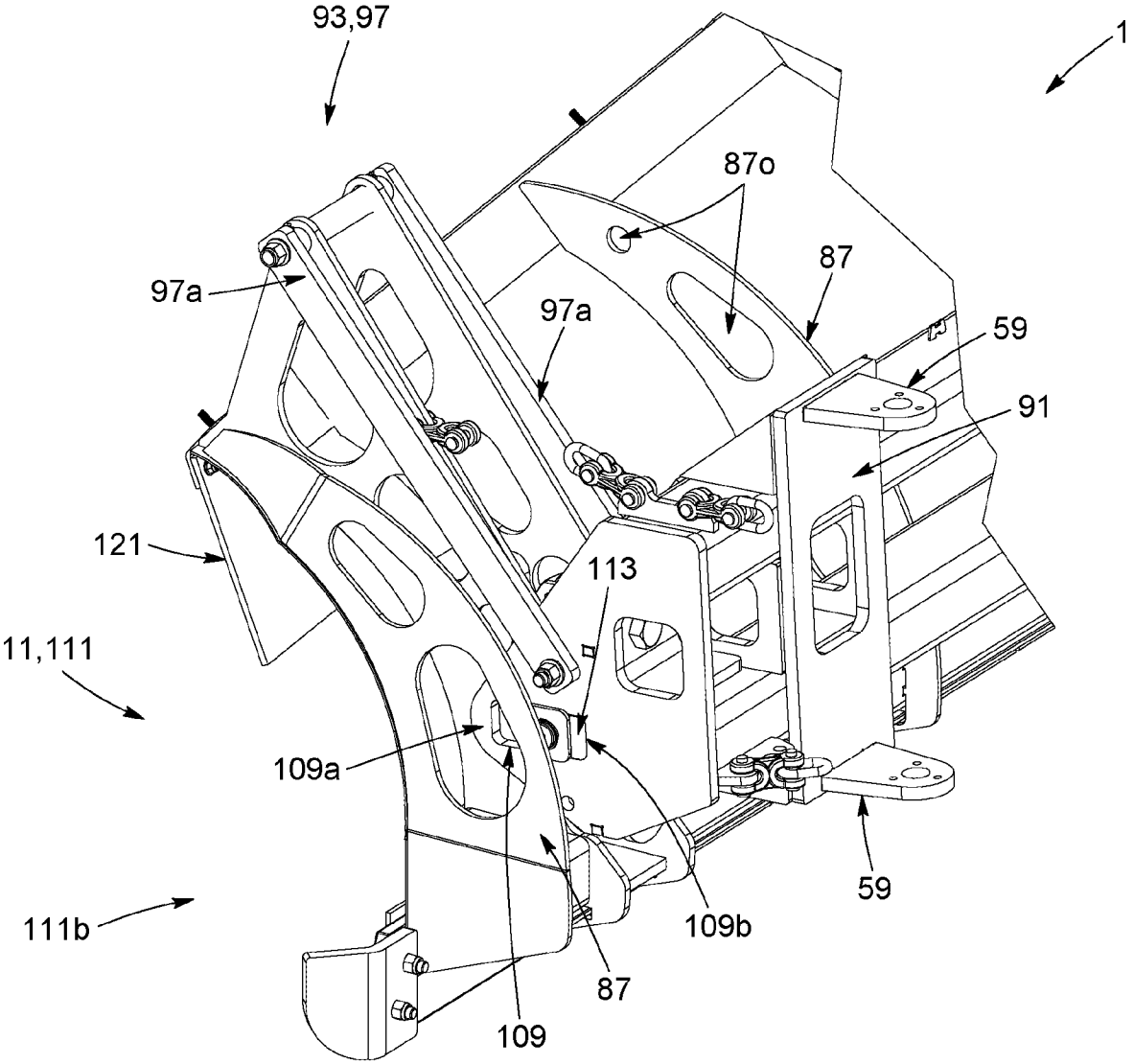
FIG. 32 is another perspective view of what is shown in FIG. 31, the plowing assembly and associated plowing component being shown now in a tilted operating configuration.
Figure 33:
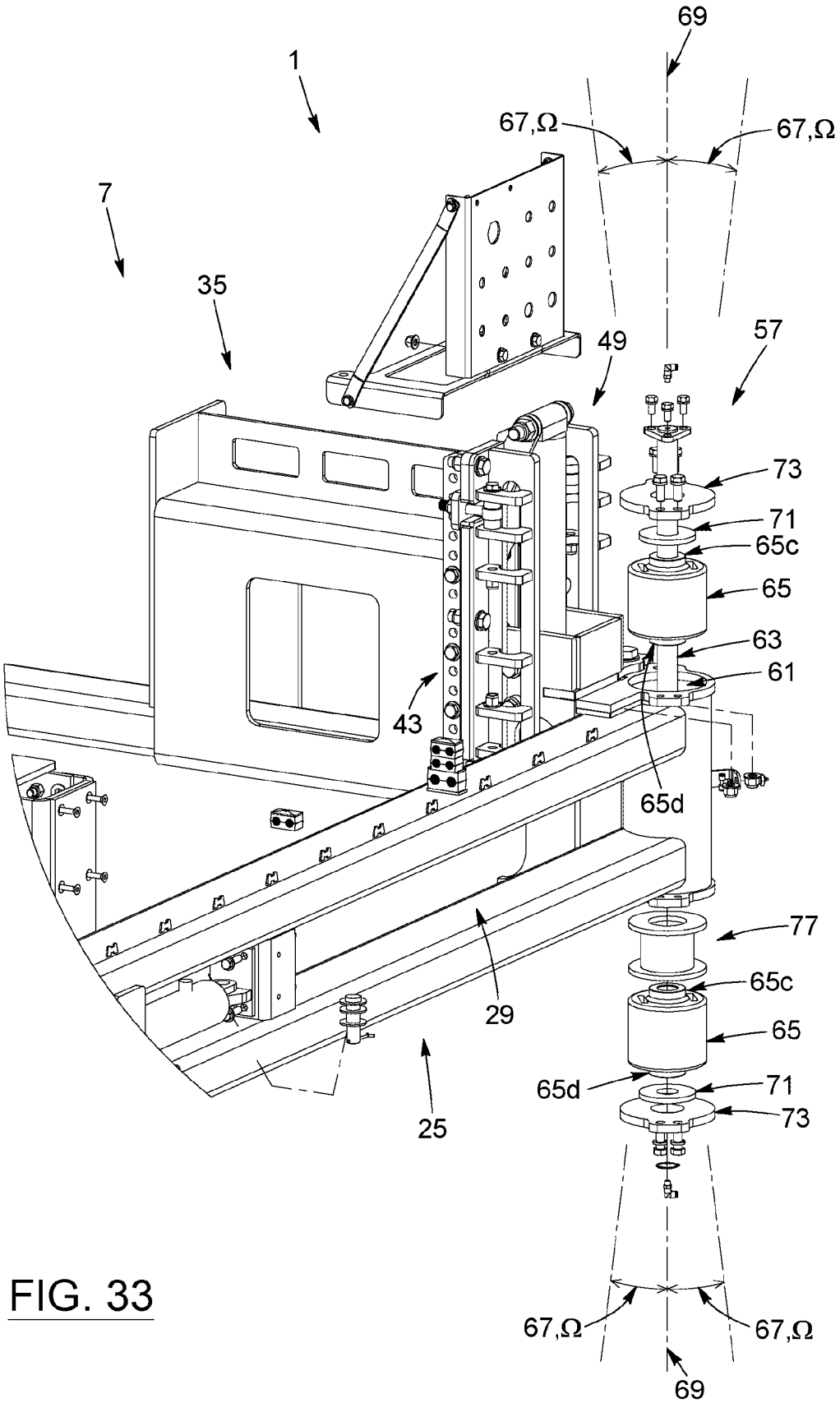
FIG. 33 is a partial perspective view of a frontward portion of a track assembly connected to a mounting component via corresponding height-adjustment and vertical-adjustment assemblies and associated components and fasteners, according to a possible embodiment of the present invention, the frontward portion of the track assembly being provided with a corresponding pivot assembly according to a possible embodiment of the present invention, the pivot assembly being shown in an exploded relation with respect to the track assembly of the plowing system, to better illustrate cooperation between components of pivot assembly.
Figure 34:
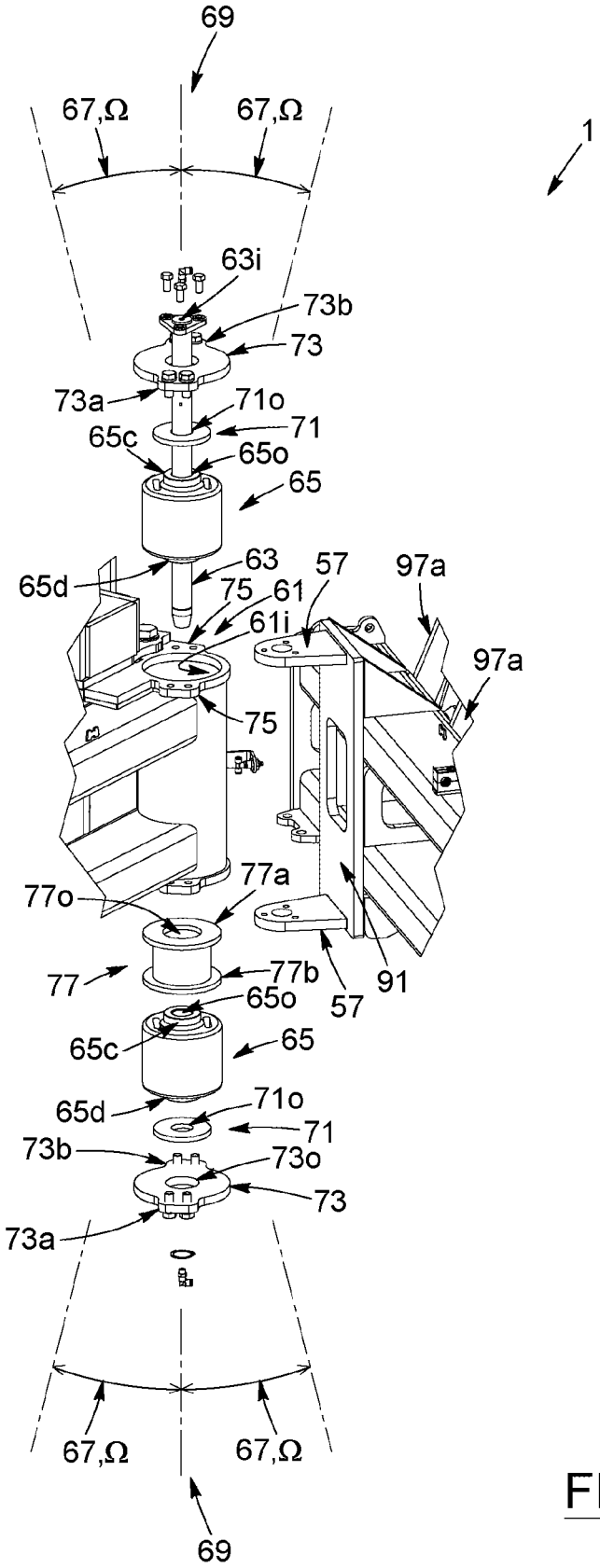
FIG. 34 is a partial perspective view of a what is shown in FIG. 33, the pivot assembly being now shown in an exploded relation with respect to a proximate end of the plowing assembly and associated plowing component, as well as corresponding hinge and bracket thereof.
Figure 35:
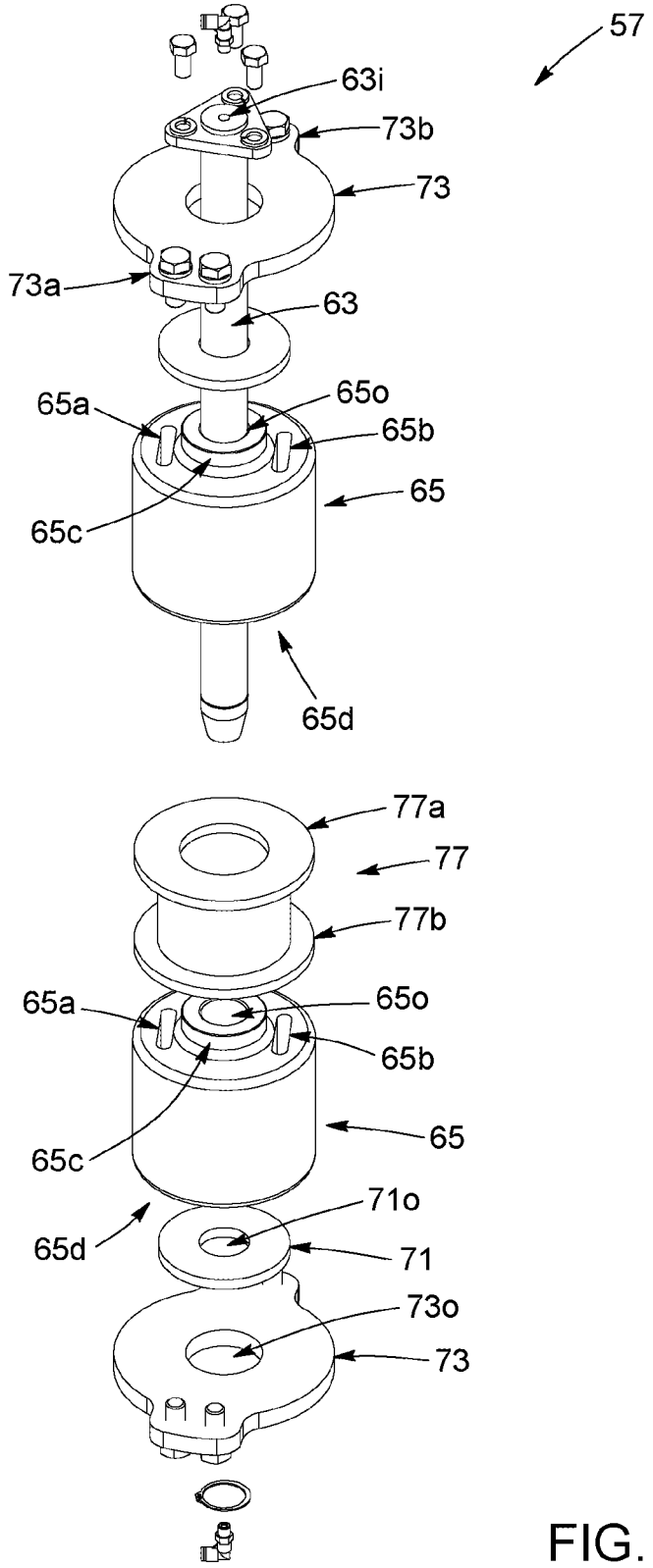
FIG. 35 is an elevational view of the components of the pivot assembly shown in FIG. 33.
Figure 36:
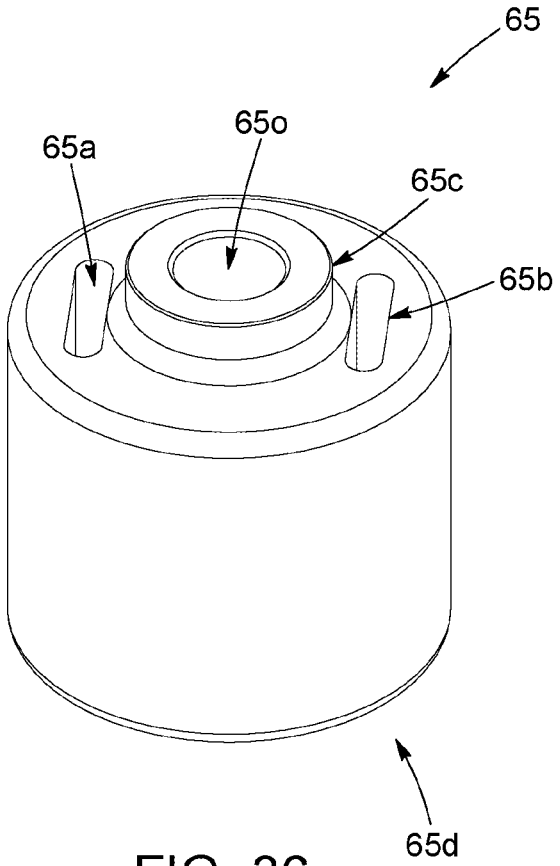
FIG. 36 is an elevational view of one of the resilient deformation components of the pivot assembly shown in FIG. 33.
Figure 37:
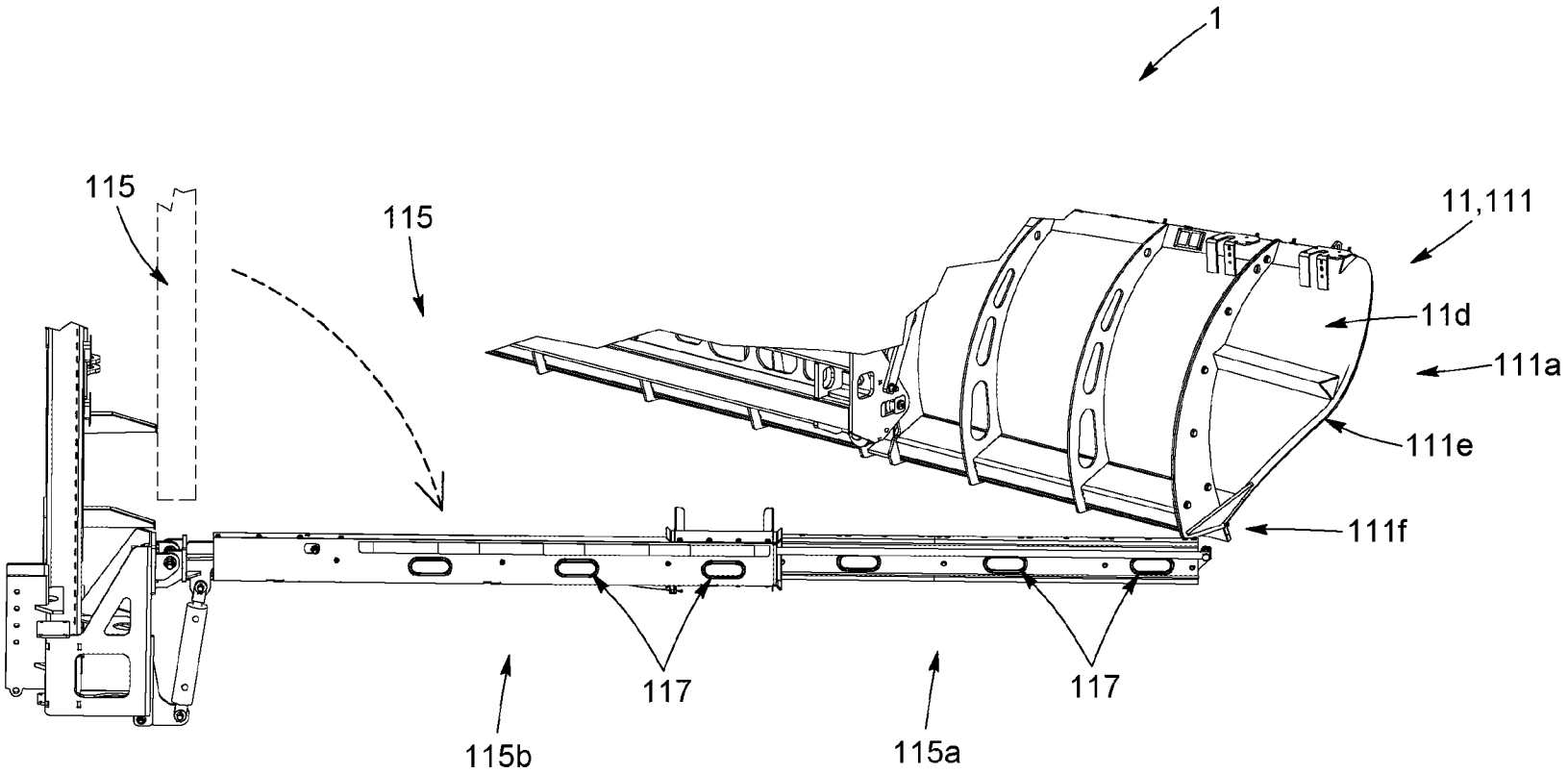
FIG. 37 is a partial rear view of a plowing system provided with a rearward blocking assembly according to a possible embodiment of the present invention, the rearward blocking assembly being shown in a lowered configuration.
Figure 38:
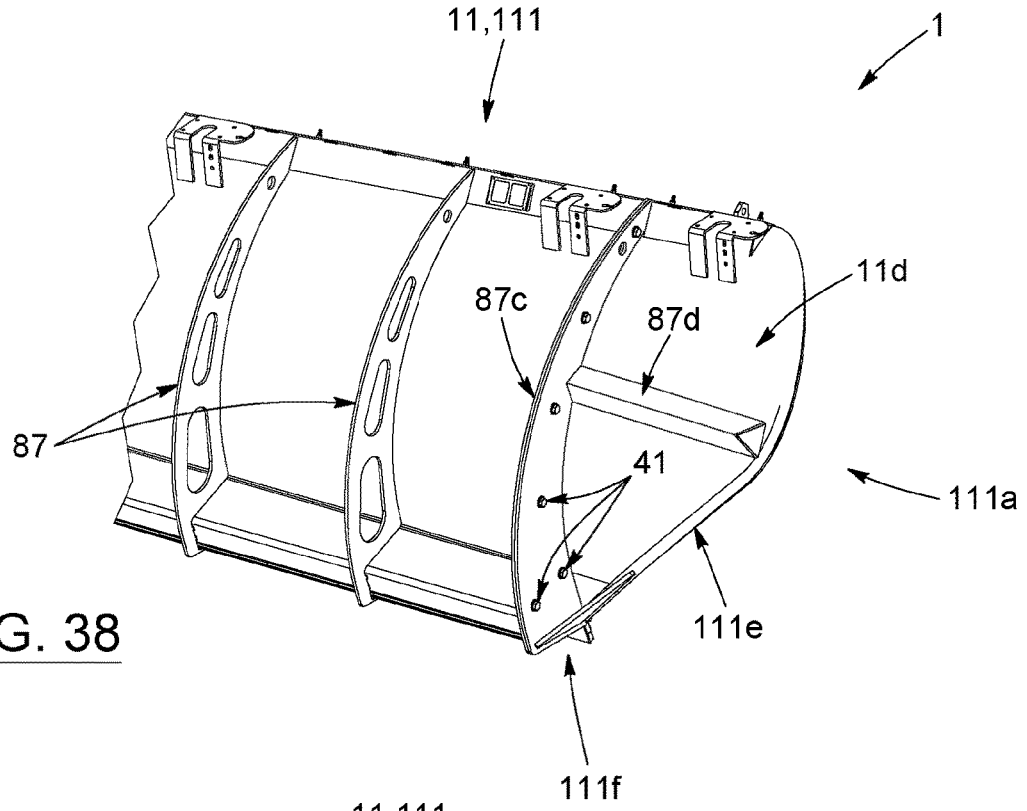
FIG. 38 is a partial rear view of a distal portion of a plowing component of the plowing system being provided with a detachable end piece according to a possible embodiment of the present invention.
Figure 39:
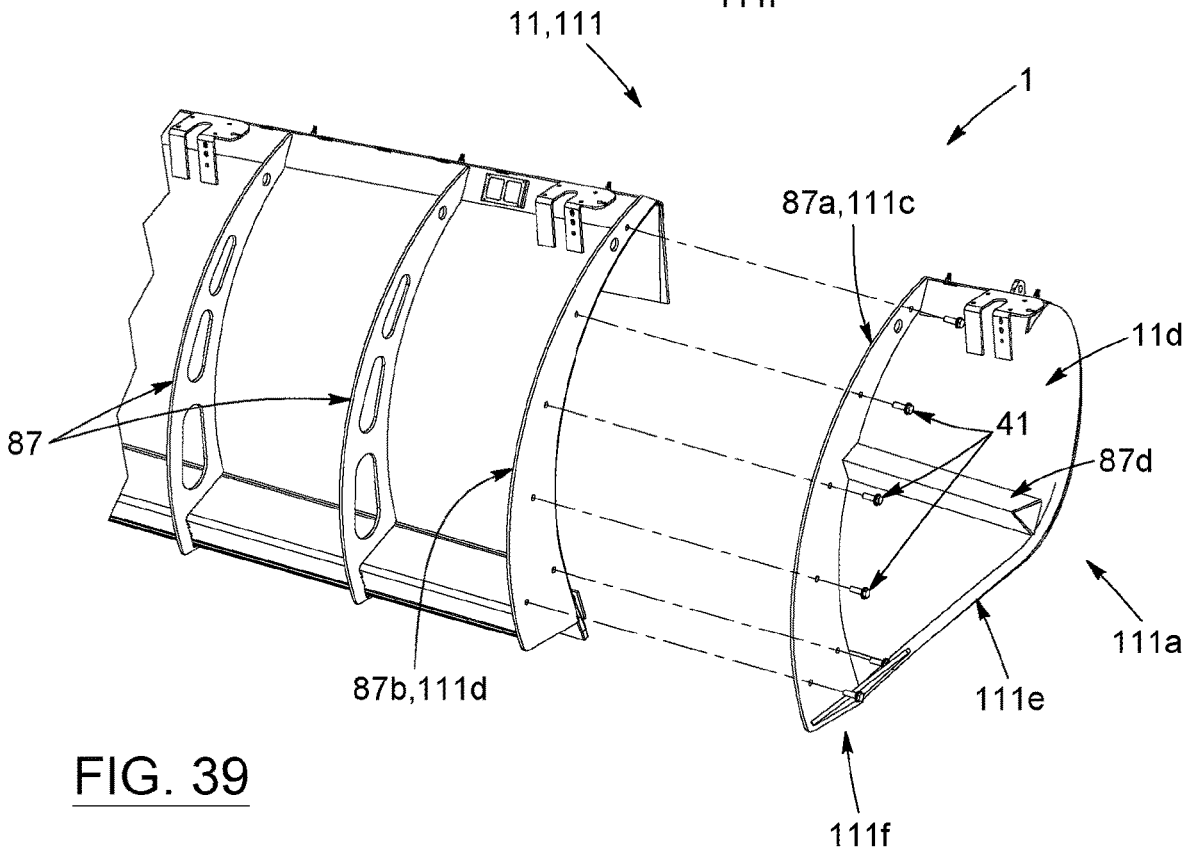
FIG. 39 is another view of what is show in FIG. 38, the detachable end piece being now shown in a removed and exploded relation with respect to the main body of the plowing component.
Figure 40:
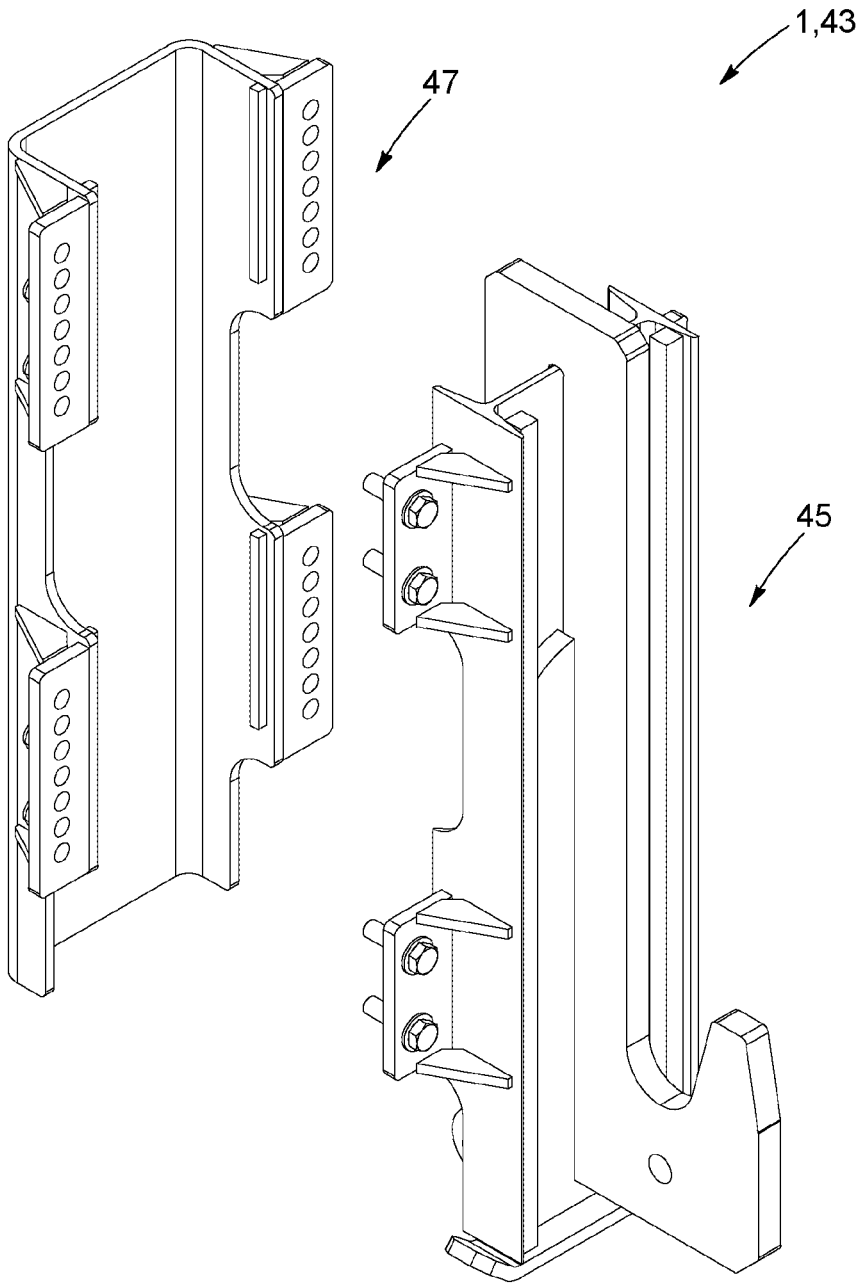
FIG. 40 is a perspective view of a height-adjustment according to another possible embodiment of the present invention.
Figure 41:
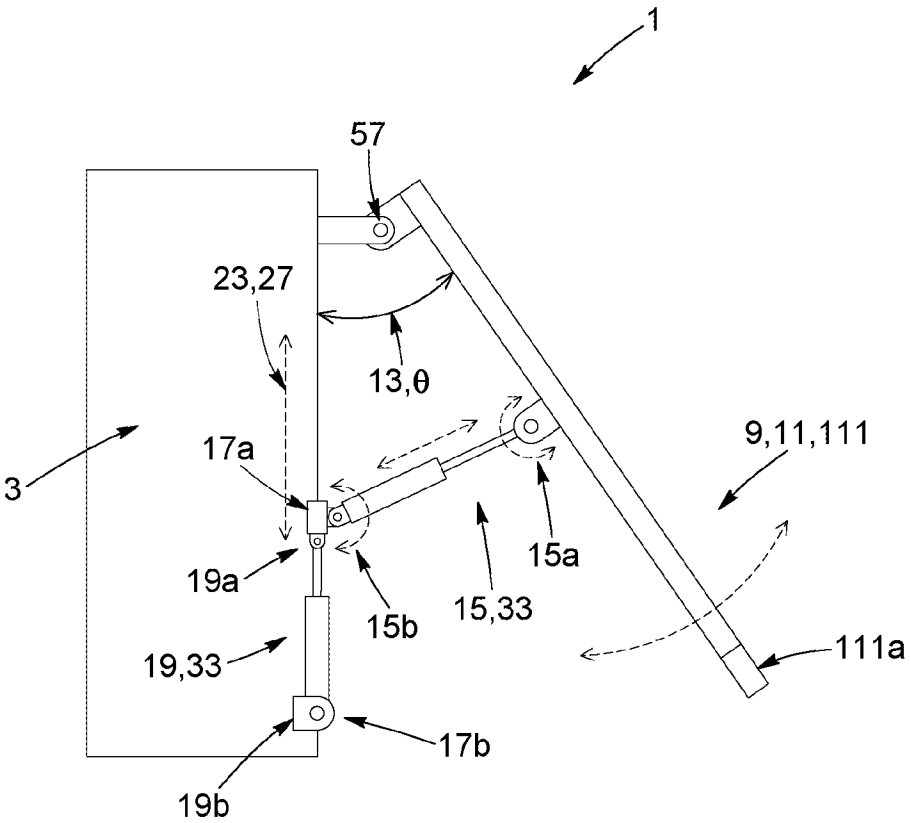
FIG. 41 is a schematic representation of one possible embodiment of the present plowing system, corresponding to the embodiment(s) illustrated in the previous figures.
Figure 42:
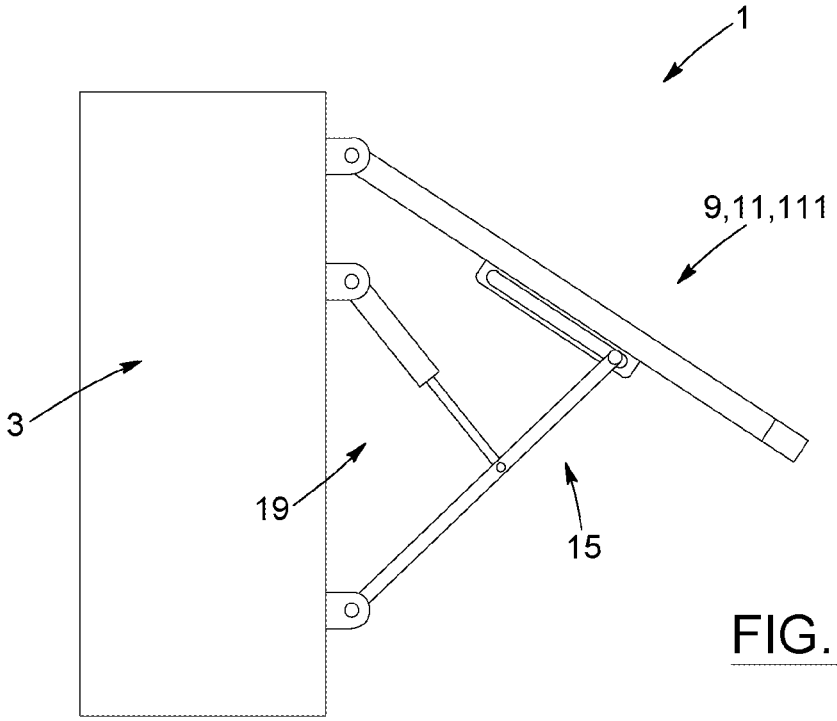
FIGS. 42-48 are schematic representations of various other possible embodiments of the present plowing system, exemplifying various other possible assortments and interactions between first and second actuating assemblies of the plowing system.
Figure 43:
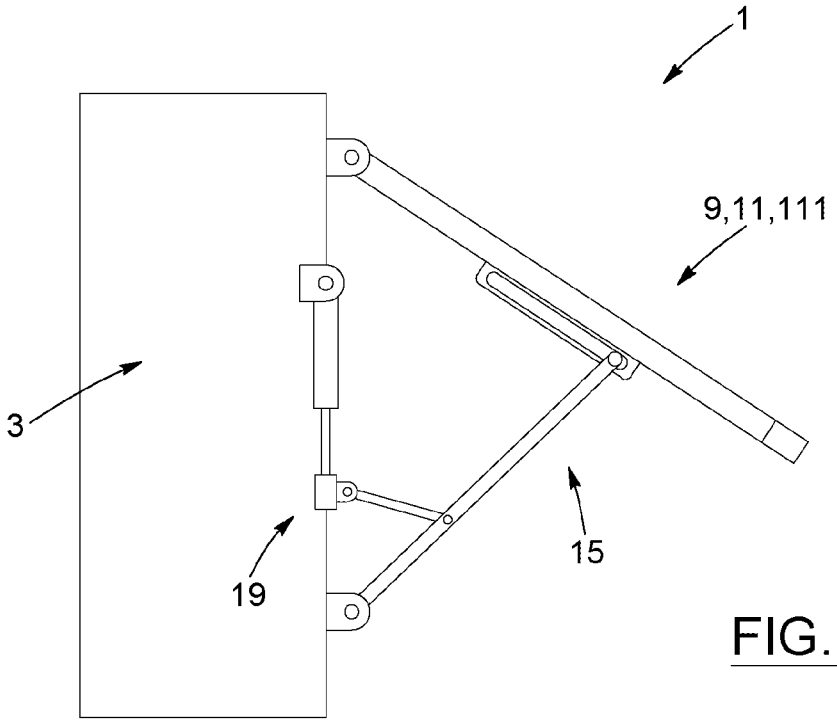
Figure 44:
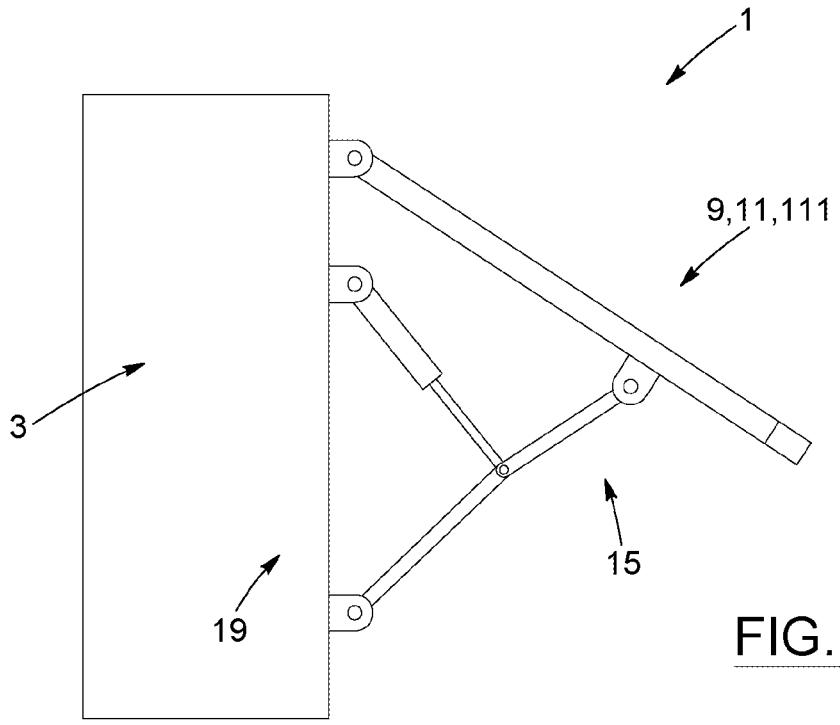
Figure 45:
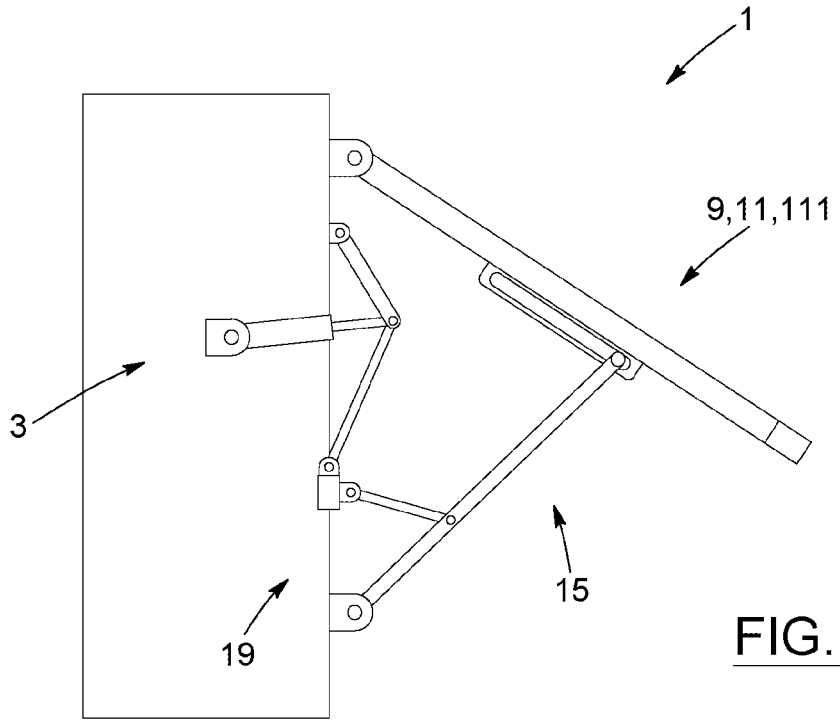
Figure 46:
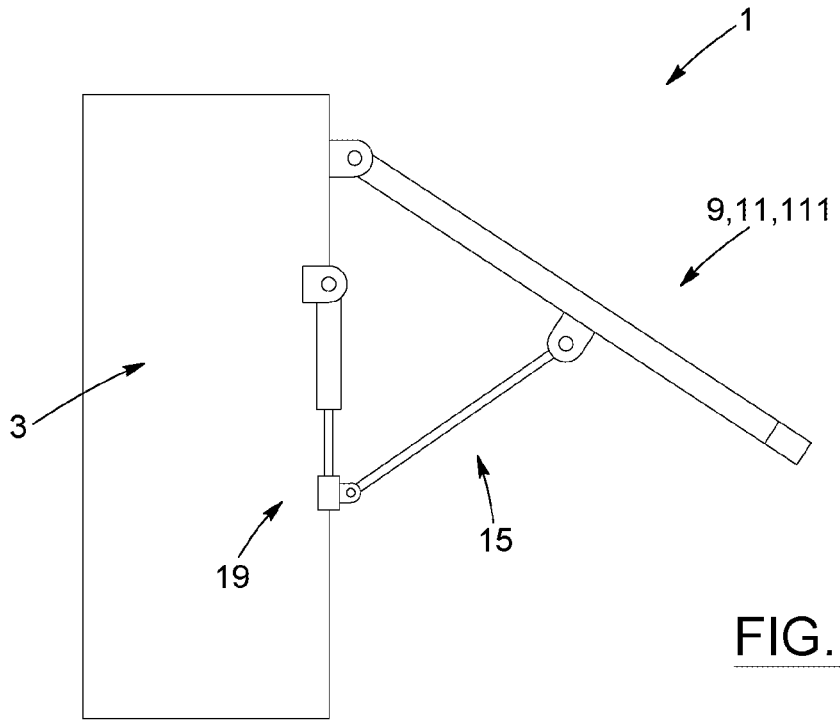
Figure 47:
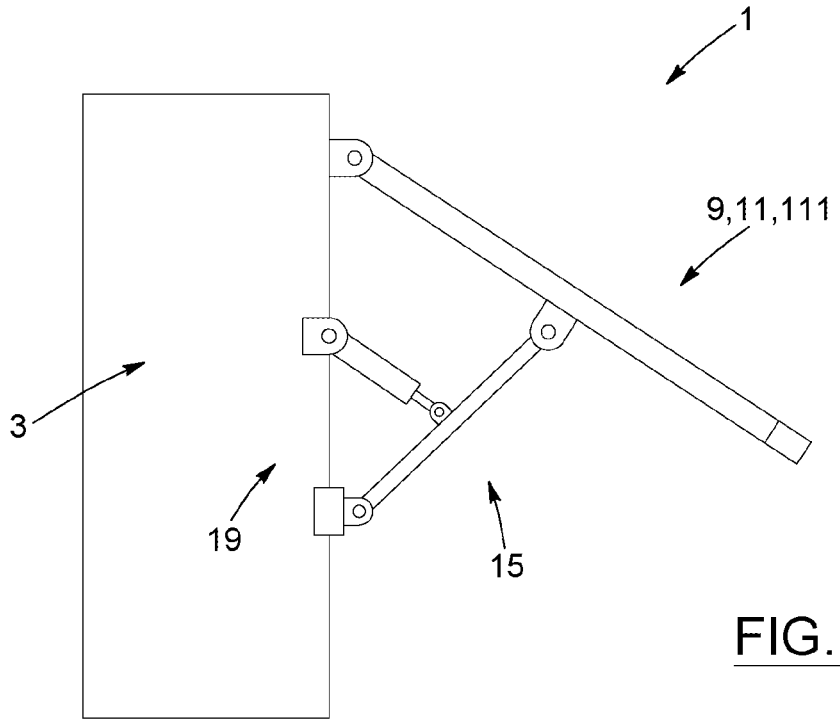
Figure 48:
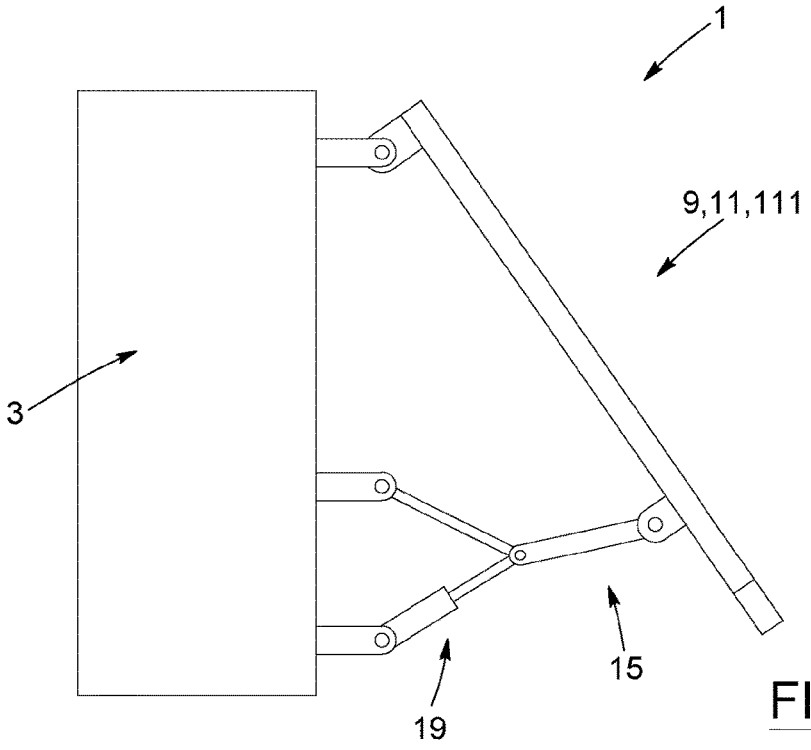
Figure 49:
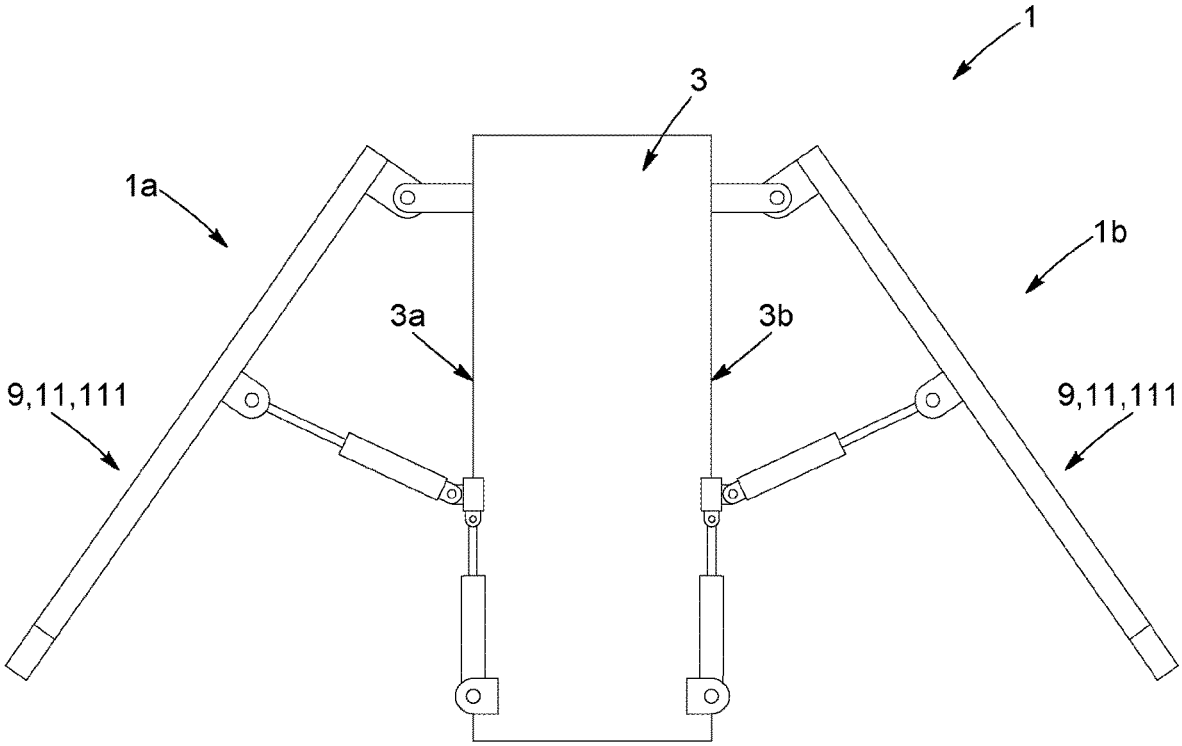
FIG. 49 is a schematic representation of another possible embodiment of the present plowing system, similar to the one of FIG. 41, but where the vehicle is now provided with a pair of plowing systems, including a left plowing system being operable along a corresponding left hand side of the vehicle and a right plowing system operable along a corresponding right hand side of the vehicle.

In the following description, the same numerical references refer to similar elements. Furthermore, for sake of simplicity and clarity, namely so as to not unduly burden the figures with several reference numbers, only some figures have been provided with reference numbers, and components and features of the present invention illustrated in other figures can be easily inferred therefrom. The embodiments, geometrical configurations, materials mentioned and/or dimensions shown in the figures are preferred, for exemplification purposes only.

Moreover, although the present invention was primarily designed for plowing purposes, in the context of using vehicles for plowing snow off roads, for example, and/or the like, it may be used with other objects and/or in other types of applications, as apparent to a person skilled in the art. For this reason, expressions such as "plowing", "snow", "vehicle", "road", etc., used herein should not be taken so as to limit the scope of the present invention and include all other kinds of objects and/or applications with which the present invention could be used and may be useful. For example, the present plowing system could also be used with and/or for various other types of vehicles (i.e. not necessarily being "wheeled" vehicles, per se, such as trucks and/or the like, but also, the present system could ultimately be used with "nonwheeled" vehicles, such as trains and/or the like, etc.), as can be easily understood by a person skilled in the art. Indeed, instead of using for "plowing" purposes, the present system could ultimately be used for "clearing" and/or "cutting" undesirable vegetation (ex. grass, bushes, etc.) growing on left and/or rights side(s) of a given train track, for example, as can also be easily understood by a person skilled in the art.

Moreover, in the context of the present invention, the expressions "plowing system", "system", "product", "device", "assembly", "apparatus", "unit", "equipment", "method" and "kit", as well as any other equivalent expression(s) and/or compound word(s) thereof known in the art will be used interchangeably, as apparent to a person skilled in the art. This applies also for any other mutually equivalent expressions, such as, for example: a) "plowing", "pushing", "deviating", "urging", "clearing", "moving", "removing", "scraping", etc.; b) "plowing material", "undesirable material", "unwanted material", "snow", "ice", "debris", "sand", "leaves", "rocks", "pebbles", "obstacle(s)", etc.; c) "link", "arm", "member", "actuator", "rod", "cylinder", "piston", etc. (whether of "fixed" length and/or "variable" length); d) "moving", "displacing", "pulling", "pushing", "translating", "rotating", "pivoting", etc. (in that the present plowing system, associated actuating assemblies and other corresponding components thereof, can move in various suitable ways other than the ones described and/or exemplified in the present patent specification); e) "effect", "interaction", "cooperation", "disposition", "collaboration", etc.; f) "operatively", "effectively", "equivalently", "practically", "directly", "mechanically", "indirectly", "interconnectedly", "remotely", etc.; g) "connected", "mounted", "affixed", "attached", "inserted", "fastened", "bolted", "riveted", "welded", "casted", etc.; h) "extended", "extendable", "disposed", "laid out", "ranging", "spanning", "connecting", "interconnecting", etc.; i) "hole", "orifice", "through-hole", "bore", "cavity", "recess", "notch", "groove", "slot", "indent", etc.; j) "axis", "pivot", "hinge", etc.; k) "blocking", "locking", "securing", "closing" "retaining", "stopping", etc. (as well as associated qualifiers, such as "blocked", "locked", "secured", "closed" and/or associated antonyms); as well as for any other mutually equivalent expressions, pertaining to the aforementioned expressions and/or to any other structural and/or functional aspects of the present invention, as also apparent to a person skilled in the art. Also, in the context of the present description, expressions such as "can", "may", "might", "will", "could", "should", "would", etc., may also be used interchangeably, whenever appropriate, as also apparent to a person skilled in the art.

Furthermore, in the context of the present description, it will be considered that all elongated objects will have an implicit "longitudinal axis" or "centerline", such as the longitudinal axis of shaft for example, or the centerline of a coiled spring, for example, and that expressions such as "connected" and "connectable", or "mounted" and "mountable", may be interchangeable, in that the present invention also relates to a kit with corresponding components for assembling a resulting fully-assembled and fully-operational plowing system.

Moreover, components of the present system(s) and/or steps of the method(s) described herein could be modified, simplified, altered, omitted and/or interchanged, without departing from the scope of the present invention, depending on the particular application(s) which the present invention is intended for, and the desired end result(s), as briefly exemplified herein and as also apparent to a person skilled in the art.

In addition, although the preferred embodiments of the present invention as illustrated in the accompanying drawings comprise various components, and although the preferred embodiments of the present plowing system and corresponding portion(s)/part(s)/component(s) as shown consist of certain geometrical configurations, as explained and illustrated herein, not all of these components and geometries are essential to the invention and thus should not be taken in their restrictive sense, i.e. should not be taken so as to limit the scope of the present invention. It is to be understood, as also apparent to a person skilled in the art, that other suitable components and cooperation there in between, as well as other suitable geometrical configurations may be used for the present plowing system and corresponding portion(s)/part(s)/component(s) according to the present invention, as will be briefly explained herein and as can be easily inferred here from by a person skilled in the art, without departing from the scope of the present invention.

LIST OF NUMERICAL REFERENCES FOR SOME OF THE CORRESPONDING POSSIBLE COMPONENTS ILLUSTRATED IN THE ACCOMPANYING DRAWINGS

1. plowing system
1*a*. left plowing system
1*b*. right plowing system
3. vehicle
3*a*. left side (of vehicle, and/or left-side "portion" of vehicle)
3*b*. right side (of vehicle, and/or right-side "portion" of vehicle)
3*c*. bottom portion (of vehicle)
3*d*. top portion (of vehicle)
3*f*. front portion (of vehicle)
3*e*. rear portion (of vehicle)
5. lateral/side range (of plowing system)
7. mounting assembly
7*a*. distal mounting sub-assembly (ex. for operatively receiving moldboard)
7*b*. proximate mounting sub-assembly (ex. mountable onto vehicle)
9. plowing assembly
11. plowing component
11*a*. plowing surface (of plowing component)
11*b*. rearward surface (of plowing component)
11*c*. frontal profile (of plowing component)
11*d*. detachable end piece (of plowing component)
13. plowing angular range (e)
15. first actuating assembly (of plowing system)
15*a*. distal end (of first actuating assembly)
15*b*. proximate end (of first actuating assembly)
17. base component (of plowing system)
17*a*. first base component (of plowing system)
17*b*. second base component (of plowing system)
19. second actuating assembly (of plowing system)
19*a*. distal end (of second actuating assembly)
19*b*. proximate end (of second actuating assembly)
21. pivot component
23. path (of base component)
25. track assembly
27. track path
29. sidetrack
31. carriage component
31*a*. first flange (of carriage component)
31*b*. second flange (of carriage component)
31*o*. hole (of carriage component)
33. cylinder
35. mounting component
35*a*. first flange (of mounting component)
35*b*. second flange (of mounting component)
35*c*. U-shaped portion (of mounting component)
35*o*. hole (of mounting component)
37. supporting component
37*a*. first portion (of supporting component)
37*b*. second portion (of supporting component)
39. beam (ex. longitudinal beam(s) of vehicle)
41. fastener(s) (ex. bolt(s), rivet(s), screw(s), pin(s), etc.)
43. height-adjustment assembly
45. accessory component
47. height-adjustment bracket
47*a*. first row of holes (of height-adjustment bracket)
47*b*. second row of holes (of height-adjustment bracket)
47*o*. hole(s) (of height-adjustment bracket)
49. vertical-adjusting assembly
51. mounting bracket
51*c*. recessed area (of mounting bracket)
53. actuator
53*a*. distal end (of actuator)
53*b*. proximate end (of actuator)
55. connecting component (of mounting assembly)
55*a*. first row of holes (of connecting component)
55*b*. second row of holes (of connecting component)
55*o*. hole(s) (of connecting component)
57. pivot assembly
59. hinge component
61. bore (of pivot assembly)
61*i*. inner wall (of bore of pivot assembly)
63. pivot shaft
63*i*. channel (ex. inner channel of pivot shaft)
65. resiliently deformable component (ex. elastomeric ring and/or cylinder)
65*a*. first through-hole (of resiliently deformable component)
65*b*. second through-hole (of resiliently deformable component)
65*c*. first protruding portion (of resiliently deformable component)
65*d*. second protruding portion (of resiliently deformable component)
65*o*. axial hole (of resiliently deformable component)
67. range (of "angular degree-of-freedom") (Q)
69. vertical axis (and/or "pivot axis" of pivot assembly)
71. abutment plate (of pivot assembly)
71*o*. center hole (of pivot assembly)
73. cover (of pivot assembly)
73*a*. first affixing tab (of cover of pivot assembly)
73*b*. first affixing tab (of cover of pivot assembly)
73*o*. hole (of cover of pivot assembly)
75. securing component (of mounting assembly)
77. inner spacer component (of pivot assembly)
77*a*. first abutment rim (of inner spacer component)
77*b*. second abutment rim (of inner spacer component)
77*o*. axial hole (of inner spacer component)
79. wheel (of carriage component)
79*a*. upper wheel (of carriage component)
79*b*. lower wheel (of carriage component)
79*c*. inner wheel (of carriage component)
79*d*. outer wheel (of carriage component)
81. scraping component
81*a*. connecting portion (of scraping component)
81*b*. scraper (of scraping component)
83. range of travel (of scraping component)
85. oblong orifice
87. reinforcement rib
87*o*. orifice(s) (of reinforcement rib)
87*a*. reinforcement rib (of detachable end piece)
87*b*. reinforcement rib (of moldboard)
87*c*. combined reinforcement assembly
87*d*. reinforcement rib (ex. transversal one, on detachable end piece)
89. supporting assembly
91. connecting bracket
93. tilting assembly
95. range of pitch)
97. linking assembly
97*a*. linking arm(s) (of linking assembly)
97*b*. linking pivot (of linking assembly)
99. reference axis (ex. imaginary reference axis of plowing component)
99*a*. reference axis (ex. in a given "tilted" configuration)
99*b*. reference axis (ex. in a given "normal/default" configuration)

101. dampening assembly
103. dampening component (of dampening assembly)
103*o*. channel (of dampening component)
105. swivelling component
105*a*. frontal side (of swivelling component)
105*o*. pivot point (of swivelling component)
107. deflecting component
109. range of travel (ex. provided about mounting assembly)
109*a*. distal end (of range of travel provided about mounting assembly)
109*b*. proximate end (of range of travel provided about mounting assembly)
111. moldboard (ex. a possible embodiment of plowing component)
111*a*. distal end (of moldboard)
111*b*. proximate end (of moldboard)
111*c*. attachment component (of moldboard)
111*d*. receiving component (of moldboard)
111*e*. distal contour (of moldboard)
111*f*. bottom distal point (of moldboard)
113. abutment component
115. rearward blocking assembly
115*a*. sub-gate (of rearward blocking assembly)
115*b*. main gate (of rearward blocking assembly)
115*c*. actuator (ex. cylinder, etc.) (of rearward blocking assembly)
117. light (and/or "reflector" of rearward blocking assembly)
119. wheel component (of plowing system)
121. deflector (ex containment panel of moldboard)
135. frontward mounting component
235. rearward mounting component
311. complementary frontal plowing component (of vehicle)
335. intermediate mounting component Broadly described, and as better exemplified in the accompanying drawings, the present invention relates to a plowing system designed to be easily, conveniently and securely mounted onto a corresponding conventional vehicle, such as a truck, for example, for converting said vehicle into a corresponding "plowing" vehicle, while providing the plowing assembly of the present system and associated vehicle with an increased plowing resistivity (ex. increased resistance to force loads, higher load-bearing tolerance, increased plowing capability/capacity, increased plowing/deployment force/action, and/or etc.) and/or with an increased plowing flexibility (ex. wider and longer plowing angular ranges, capability of using moldboards of much longer lengths, increased range(s) of motion and degree(s) of freedom, and/or etc.), within lateral side(s) of the vehicle, thanks to the innovative nature of the different components and features of the plowing system, as detailed hereinbelow, and as exemplified in the accompanying drawings.

Indeed, the present plowing system may come in the form of a plowing system including one and/or several of the following possible components and features (and/or different possible combination(s) and/or permutation(s) thereof):

i.) A plowing system for removably mounting onto a vehicle in order to provide said vehicle with lateral plowing capability along a given lateral range (5) of the vehicle, the plowing system comprising:

a mounting assembly for removably and operatively mounting the plowing system onto the vehicle;

a plowing assembly operatively mountable onto the vehicle via the mounting assembly, the plowing assembly comprising a plowing component pivotably mountable about a frontward portion of the mounting assembly, and being operable between retracted and deployed configurations within a given plowing angular range (13) extending into the lateral range (5) of the vehicle;

a first actuating assembly operatively extendable between the plowing component and the mounting assembly, for selectively operating the plowing component between the retracted and deployed configurations, a proximate end (15*b*) of the first actuating assembly being operatively connectable onto a first base component (17*a*) of the plowing system, and a distal end (15*a*) of the first actuating assembly being operatively connectable to a rear portion of the plowing component, so that a corresponding movement of the first actuating assembly in turn operates the plowing component within the plowing angular range (13); and a second actuating assembly (19) operatively extendable between the first actuating assembly and the mounting assembly, for cooperating with the first actuating assembly in order to selectively operate the first actuating assembly between the retracted and deployed configurations, a proximate end (19*b*) of the second actuating assembly (19) being operatively connectable onto a second base component (17*b*) of the plowing system, and a distal end (19*a*) of the second actuating assembly (19) being operatively connectable to a corresponding pivot component of the first actuating assembly, so as to provide the plowing system and associated plowing assembly and corresponding plowing component with an increased plowing resistivity within the lateral range (5) of the vehicle, due to a combined effect of the first and second actuating assemblies (15,19).

ii.) A plowing system according to any one of the preceding combination(s), wherein the first base component (17*a*) of the first actuating assembly is relatively moveable with respect to the second base component (17*b*) of the second actuating assembly (19).

iii.) A plowing system according to any one of the preceding combination(s), wherein at least one base component (17) of said first and second base components (17*a*, 17*b*) is positioned, shaped and shaped to move along a corresponding path of the plowing system.

iv.) A plowing system according to any one of the preceding combination(s), wherein said at least one base component (17) is configured to angularly move along the corresponding path of the plowing system.

v.) A plowing system according to any one of the preceding combination(s), wherein said at least one base component (17) is configured to slidably move along the corresponding path of the plowing system.

vi.) A plowing system according to any one of the preceding combination(s), wherein the corresponding path of the plowing system includes an arched path.

vii.) A plowing system according to any one of the preceding combination(s), wherein the corresponding path of the plowing system includes a rectilinear path.

viii.) A plowing system according to any one of the preceding combination(s), wherein the first base component (17*a*) of the plowing system is positioned, shaped and shaped to slidably move along a corresponding path extending along a rearward portion of the plowing component.

ix.) A plowing system according to any one of the preceding combination(s), wherein the second base component (17*b*) of the plowing system is positioned, shaped and shaped to slidably move along a corresponding path extending along the mounting assembly.

x.) A plowing system according to any one of the preceding combination(s), wherein the first actuating assembly includes an actuating assembly of fixed length.

xi.) A plowing system according to any one of the preceding combination(s), wherein the first actuating assembly includes an actuating assembly of variable length.

xii.) A plowing system according to any one of the preceding combination(s), wherein the second actuating assembly (19) includes an actuating assembly (19) of fixed length.

xiii.) A plowing system according to any one of the preceding combination(s), wherein the second actuating assembly (19) includes an actuating assembly (19) of variable length.

xiv.) A plowing system according to any one of the preceding combination(s), wherein the first and second actuating assemblies (15, 19) include respectively at least one actuating assembly of variable length and at least one actuating assembly (19) of fixed length.

xv.) A plowing system according to any one of the preceding combination(s), wherein the first and second actuating assemblies (15, 19) include respectively at least one actuating assembly of fixed length and at least one actuating assembly (19) of variable length.

xvi.) A plowing system according to any one of the preceding combination(s), wherein the first and second actuating assemblies (15, 19) include respectively at least one actuating assembly of fixed length and at least one actuating assembly (19) of fixed length.

xvii.) A plowing system according to any one of the preceding combination(s), wherein the first and second actuating assemblies (15, 19) include respectively at least one actuating assembly of variable length and at least one actuating assembly (19) of variable length.

xviii.) A plowing system according to any one of the preceding combination(s), wherein the first and second actuating assemblies (15, 19) are respectively first and second actuating assemblies (15, 19) of fixed length.

xix.) A plowing system according to any one of the preceding combination(s), wherein the first and second actuating assemblies (15, 19) are respectively first and second actuating assemblies (15, 19) of variable length.

xx.) A plowing system according to any one of the preceding combination(s), wherein the first and second actuating assemblies (15, 19) include a combination of actuating assemblies (15, 19) of both fixed and variable lengths.

xxi.) A plowing system according to any one of the preceding combination(s), wherein the plowing system comprises a track assembly (25) operatively extendable about the mounting assembly, for removably and operatively mounting said track assembly (25) onto a given side (3*a*, 3*b*) of the vehicle, and for defining a corresponding track path (27) of the plowing system xxii.) A plowing system according to any one of the preceding combination(s), wherein the first actuating assembly is extendable between the plowing component and the mounting assembly for selectively operating the plowing component between the retracted and deployed configurations, the proximate end (15*b*) of the first actuating assembly being positioned, shaped and shaped to slidably move along a corresponding sidetrack (29) of the track assembly (25) via a corresponding and moveable carriage component (31) acting as the pivot component, and the distal end (15*a*) of the first actuating assembly being operatively connectable to a rear portion of the plowing component, so that an activation of the first actuating assembly in turn deploys the plowing component within the plowing angular range (13).

xxiii.) A plowing system according to any one of the preceding combination(s), wherein the second actuating assembly (19) is extendable between the carriage component (31) and a rearward portion of the track assembly (25) for selectively operating the carriage component (31) along the sidetrack (29) of the mounting assembly, the proximate end (19*b*) of the second actuating assembly (19) being operatively mountable about the rearward portion of the mounting assembly, and the distal end (19*a*) of the second actuating assembly (19) being operatively mountable onto the carriage component (31) being configured for travelling along the corresponding sidetrack (29) of the track assembly (25) so as to provide with the plowing system with the increased plowing resistivity extending along the lateral range (5) of the vehicle, due to a combination of the first and second actuating assemblies (15, 19).

xxiv.) A plowing system according to any one of the preceding combination(s), wherein the first and second actuating assemblies (15, 19) are operatively disposed in series between the plowing component and a rearward portion of the mounting assembly, so that a displacement of the distal end (19*a*) of the second actuating assembly (19) in turns generates a corresponding displacement and different positioning of the proximate end (15*b*) of the first actuating assembly operatively acting on the plowing component.

xxv.) A plowing system according to any one of the preceding combination(s), wherein the first actuating assembly extends in a substantially parallel manner with respect to the track assembly (25) when the plowing component is in the retracted configuration.

xxvi.) A plowing system according to any one of the preceding combination(s), wherein the second actuating assembly (19) extends in a substantially parallel manner with respect to the track assembly (25) when the plowing component is operated between the retracted and deployed configurations.

xxvii.) A plowing system according to any one of the preceding combination(s), wherein the second actuating assembly (19) is substantially contained within the mounting assembly (ex. within the track assembly (25)).

xxviii.) A plowing system according to any one of the preceding combination(s), wherein the second actuating assembly (19) is substantially contained within the sidetrack (29) of the mounting assembly (ex. within the sidetrack (29) of the track assembly (25)).

xxix.) A plowing system according to any one of the preceding combination(s), wherein the second actuating assembly (19) is substantially contained within a rearward portion of the sidetrack (29) of the mounting assembly (ex. within a rearward portion of the sidetrack (29) of the track assembly (25)).

xxx.) A plowing system according to any one of the preceding combination(s), wherein the first and second actuating assemblies (15, 19) are each extendable independently of one another.

xxxi.) A plowing system according to any one of the preceding combination(s), wherein the first and second actuating assemblies (15, 19) are each extendable in a synchronized manner with respect to one another.

xxxii.) A plowing system according to any one of the preceding combination(s), wherein the first and second actuating assemblies (15, 19) are each extendable simultaneously with respect to one another.

xxxiii.) A plowing system according to any one of the preceding combination(s), wherein each actuating assembly (15, 19) includes a corresponding cylinder (33) selectively operable between extended and compressed configurations.

xxxiv.) A plowing system according to any one of the preceding combination(s), wherein the mounting assembly includes at least one mounting component for removably and operatively mounting the mounting assembly onto a corresponding portion (3*a*,3*b*,3*c*,3*d*) of the vehicle.

xxxv.) A plowing system according to any one of the preceding combination(s), wherein said corresponding portion (3*a*,3*b*,3*c*,3*d*) of the vehicle includes a bottom portion (3*c*) of the vehicle.

xxxvi.) A plowing system according to any one of the preceding combination(s), wherein said bottom portion (3*c*) of the vehicle includes at least one corresponding supporting component (37).

xxxvii.) A plowing system according to any one of the preceding combination(s), wherein the at least one mounting component includes first and second flanges (35*a*,35*b*) being removably and operatively mountable respectively onto corresponding first and second portions (37*a*,37*b*) of the at least one corresponding supporting component (37).

xxxviii.) A plowing system according to any one of the preceding combination(s), wherein said at least one corresponding supporting component (37) includes a pair of first and second longitudinal beams (39), and wherein the first and second flanges (35*a*,35*b*) of the at least one mounting component are removably and operatively mountable respectively onto the first and second beams (39) of said at least one corresponding supporting component (37) via corresponding fasteners (41).

xxxix.) A plowing system according to any one of the preceding combination(s), wherein the at least one mounting component includes a substantially U-shaped portion (35*c*), and wherein the first and second flanges (35*a*,35*b*) of the at least one mounting component are part of the substantially U-shaped portion (35*c*).

xl.) A plowing system according to any one of the preceding combination(s), wherein the first and second flanges (35*a*,35*b*) of the at least one mounting component are removably and operatively mountable onto outer sides of the first and second beams (39) of the at least one corresponding supporting component (37).

xli.) A plowing system according to any one of the preceding combination(s), wherein the least one mounting component includes frontward and rearward mounting components (135,235).

xlii.) A plowing system according to any one of the preceding combination(s), wherein the least one mounting component further includes at least one intermediate mounting component (335) mountable onto the vehicle between the frontward and rearward mounting components (135,225).

xliii.) A plowing system according to any one of the preceding combination(s), wherein the plowing system is further provided with a height-adjustment assembly for selectively adjusting a given height of the mounting assembly (7,7*b*) (ex. track assembly (25)) with respect to a ground surface of the vehicle.

xliv.) A plowing system according to any one of the preceding combination(s), wherein the height-adjustment assembly is operatively connectable to the mounting assembly.

xlv.) A plowing system according to any one of the preceding combination(s), wherein the height-adjustment assembly is operatively connectable to at least one corresponding operative mounting component (35, 135,235,335) of the mounting assembly.

xlvi.) A plowing system according to any one of the preceding combination(s), wherein the height-adjustment assembly includes a height-adjustment bracket (47) being selectively movable and securable in terms of height with respect to said at least one corresponding operative mounting component (35,135,235,335).

xlvii.) A plowing system according to any one of the preceding combination(s), wherein the height-adjustment bracket (47) is selectively and removably maintained in place with respect to the at least one corresponding operative mounting component (35,135,235, 335) via at least one fastener (41).

xlviii.) A plowing system according to any one of the preceding combination(s), wherein the height-adjustment bracket (47) is provided with a plurality of holes (47*o*) disposed at different incremental heights in order to allow a user of the plowing system to selectively establish a given positioning of the height-adjustment bracket (47) with respect to the least one corresponding operative mounting component (35,135,235,335).

xlix.) A plowing system according to any one of the preceding combination(s), wherein the height-adjustment bracket (47) is provided with first and second rows (47*a*,47*b*) of holes (47*o*) disposed on first and second sides of the height-adjustment bracket (47), said first and second rows (47*a*,47*b*) of holes (47*o*) being positioned, shaped and sized to cooperate with corresponding first and second rows of holes (35*o*) provided about the at least one corresponding operative mounting component (35,135,235,335).

l.) A plowing system according to any one of the preceding combination(s), wherein the height-adjustment assembly includes a vertical-adjustment assembly including a mounting bracket (51) being selectively and operatively mountable onto said at least one corresponding operative mounting component (35,135,235, 335).

li.) A plowing system according to any one of the preceding combination(s), wherein the vertical-adjustment assembly includes at least one actuator (53) having a proximate end (53*b*) operatively mountable about the mounting bracket (51) and a distal end (53*a*) operatively connectable to a corresponding connecting component of the mounting assembly, for selectively adjusting a given vertical displacement of the track assembly (25) with respect to the ground surface of the vehicle, via a corresponding activation of said least one actuator (53) of the vertical-adjustment assembly.

lii.) A plowing system according to any one of the preceding combination(s), wherein the connecting component is provided with a plurality of holes (55*o*) disposed at different incremental heights in order to allow a user of the plowing system to selectively establish a given connection point of the distal end (53*a*) of the at least one actuator (53) onto the connecting component.

liii.) A plowing system according to any one of the preceding combination(s), wherein the connecting component is provided with first and second rows (55*a*,55*b*) of holes (55*o*) disposed on first and second sides of the connecting component, said first and second rows (55*a*,55*b*) of holes (55*o*) of the connecting component being positioned, shaped and sized to provide the distal end (53*a*) of the at least one actuator (53) with different pivot axes.

liv.) A plowing system according to any one of the preceding combination(s), wherein the connecting component is positioned, shaped and sized so as to be removably and selectively nestable within a recessed area (51*c*) of the mounting bracket (51) when the at least one actuator (53) is operated into a corresponding drawn-in configuration.

lv.) A plowing system according to any one of the preceding combination(s), wherein the at least one corresponding operative mounting component (35,135, 235,335) is selected from a group consisting of frontward and rearward mounting components (135,235) of the mounting assembly.

lvi.) A plowing system according to any one of the preceding combination(s), wherein the at least one corresponding operative mounting component (35,135, 235,335) is selected from a group consisting of frontward, intermediate and rearward mounting components (135,335,235) of the mounting assembly.

lvii.) A plowing system according to any one of the preceding combination(s), wherein the plowing component is pivotably mountable to the frontward portion of the mounting assembly via a corresponding flexible pivot assembly and corresponding hinge component (59), and wherein in addition to allowing the plowing component to be moved along a given rotational degree-of-freedom, the pivot assembly is further shaped, positioned and sized to allow the plowing component to be displaced along at least one additional degree-of-freedom.

lviii.) A plowing system according to any one of the preceding combination(s), wherein the at least one additional degree-of-freedom includes a slidable degree-of-freedom, and thus, wherein the pivot assembly is shaped, positioned and sized to allow the plowing component to be displaced in a vertical manner with respect to the pivot assembly.

lix.) A plowing system according to any one of the preceding combination(s), wherein the pivot assembly includes a bore (61) for receiving a corresponding pivot shaft, and wherein the pivot shaft is vertically displaceable with respect to the bore (61) of the pivot assembly, so as to provide the plowing component with said slidable degree-of-freedom.

lx.) A plowing system according to any one of the preceding combination(s), wherein the at least one additional degree-of-freedom includes an angular degree-of-freedom, and thus, wherein the pivot assembly is shaped, positioned and sized to allow the plowing component to be displaced in an angular manner with respect to the pivot assembly.

lxi.) A plowing system according to any one of the preceding combination(s), wherein the pivot assembly includes at least one resiliently deformable component, and wherein said at least one resiliently deformable component is resiliently compressible with respect to the bore (61) of the pivot assembly, so as to provide the plowing component with said angular degree-of-freedom.

lxii.) A plowing system according to any one of the preceding combination(s), wherein the angular degree-of-freedom includes a range extending between about 0° and about 10° with respect to a vertical axis (69) of the pivot assembly.

lxiii.) A plowing system according to any one of the preceding combination(s), wherein the angular degree-of-freedom includes a range of about 5° degrees with respect to a vertical axis (69) of the pivot assembly.

lxiv.) A plowing system according to any one of the preceding combination(s), wherein the at least one resiliently deformable component is mountable about a corresponding pivot axis (69) of the pivot assembly so as to provide the plowing component with both vertical and angular degree-of-freedoms.

lxv.) A plowing system according to any one of the preceding combination(s), wherein the at least one resiliently deformable component is positioned, shaped and sized for containment inside the bore (61) of the pivot assembly.

lxvi.) A plowing system according to any one of the preceding combination(s), wherein the at least one resiliently deformable component is further positioned, shaped and sized for vertical displacement of the at least one resiliently deformable component inside the bore (61) of the pivot assembly, in order to provide the pivot assembly with a vertical displacement capability so as to enable the plowing component to be displaced accordingly with respect to said pivot assembly about a given range of travel (ex. with respect to a ground surface of the vehicle).

lxvii.) A plowing system according to any one of the preceding combination(s), wherein the at least one resiliently deformable component is an elastomeric ring.

lxviii.) A plowing system according to any one of the preceding combination(s), wherein the at least one resiliently deformable component includes at least one corresponding axial hole (65*o*) for allowing passage of the pivot shaft through said axial hole (65*o*) of the at least one resiliently deformable component.

lxix.) A plowing system according to any one of the preceding combination(s), wherein the at least one resiliently deformable component includes at least one corresponding through-hole (65*a*,65*b*) for facilitating a resilient compression of said at least one resiliently deformable component.

lxx.) A plowing system according to any one of the preceding combination(s), wherein the at least one resiliently deformable component includes a pair of through-holes (65*a*,65*b*) provided about the axial hole (65*o*) of the least one resiliently deformable component for facilitating an inwardly resilient compression of said at least one resiliently deformable component.

lxxi.) A plowing system according to any one of the preceding combination(s), wherein the at least one resiliently deformable component includes at least one protruding portion (65*c*,65*d*) being positioned, shaped and sized for removably inserting into a corresponding adjacent component of the pivot assembly.

lxxii.) A plowing system according to any one of the preceding combination(s), wherein the at least one resiliently deformable component includes top and bottom protruding portions (65*c*,65*d*) being positioned, shaped and sized for removably inserting into corresponding top and bottom adjacent components (71,77) of the pivot assembly.

lxxiii.) A plowing system according to any one of the preceding combination(s), wherein the pivot assembly includes at least one abutment plate (71) being operatively restable against a given side of the at least one resiliently deformable component, the at least one abutment plate (71) being positioned, shaped and sized inside the bore (61) of the pivot assembly for removably abutting against an inner wall (61*i*) of the bore (61) of the pivot assembly when the plowing component is displaced with respect to said pivot assembly beyond a given range.

lxxiv.) A plowing system according to any one of the preceding combination(s), wherein the at least one abutment plate (71) is substantially circular and includes a corresponding center hole (71*o*) for allowing passage of the pivot shaft through said center hole (71*o*).

lxxv.) plowing system according to any one of the preceding combination(s), wherein the corresponding center hole (71*o*) of the at least one abutment plate (71) is further positioned, shaped and sized for receiving therein a corresponding protruding portion (65*c*,65*d*) of the at least one resiliently deformable component.

lxxvi) A plowing system according to any one of the preceding combination(s), wherein the pivot shaft includes at least one channel (63*i*) for receiving a lubrication material destined to be inserted into the bore (61) of the pivot assembly.

lxxvii.) A plowing system according to any one of the preceding combination(s), wherein the at least one channel (63*i*) extends internally within the pivot shaft.

lxxviii.) A plowing system according to any one of the preceding combination(s), wherein the at least one channel (63*i*) extends longitudinally within the pivot shaft.

lxxix.) A plowing system according to any one of the preceding combination(s), wherein the pivot assembly is provided with at least one cover (73) for substantially closing off the bore (61) and for selectively containing inner components of the pivot assembly inside said bore (61).

lxxx.) A plowing system according to any one of the preceding combination(s), wherein the at least one cover (73) includes at least one corresponding hole (73*o*) for allowing passage of the pivot shaft through said hole (73*o*) of the at least one cover (73).

lxxxi.) A plowing system according to any one of the preceding combination(s), wherein the at least one cover (73) includes at least one corresponding affixing tab (73*a*,73*b*) for removably cooperating with a corresponding securing component (75) of the mounting assembly so as to selectively and securely affix said at least one corresponding affixing tab (73*a*,73*b*) onto the securing component (75) of the mounting assembly via at least one fastener (41).

lxxxii. A plowing system according to any one of the preceding combination(s), wherein the at least one cover (73) includes a pair of distally-apart affixing tabs (73*a*,73*b*) for removably cooperating with the corresponding securing component (75) of the mounting assembly.

lxxxiii.) A plowing system according to any one of the preceding combination(s), wherein the at least one resiliently deformable component includes a pair of upper and lower resiliently deformable components.

lxxxiv.) A plowing system according to any one of the preceding combination(s), wherein the upper and lower resiliently deformable components are provided with corresponding upper and lower abutment plates (71) each being operatively restable against a corresponding given side of the upper and lower resiliently deformable components respectively, each of said abutment plates (71) being positioned, shaped and sized inside the bore (61) of the pivot assembly for removably abutting against a corresponding position of an inner wall of the bore (61) of the pivot assembly when the plowing component is displaced with respect to said pivot assembly beyond a corresponding given range.

lxxxv.) A plowing system according to any one of the preceding combination(s), wherein the upper and lower abutment plates (71) are operatively restable against outer sides of the upper and lower resiliently deformable components respectively.

lxxxvi.) A plowing system according to any one of the preceding combination(s), wherein both the upper and lower resiliently deformable components, and associated abutment plates (71), are positioned, shaped and sized for containment inside the bore (61) of the pivot assembly.

lxxxvii.) A plowing system according to any one of the preceding combination(s), wherein the pivot assembly is provided with upper and lower covers (73) for substantially closing off the bore (61) and for selectively containing inner components of the pivot assembly inside said bore (61).

lxxxviii.) A plowing system according to any one of the preceding combination(s), wherein each of the upper and lower covers (73) includes a corresponding hole (73*o*) for allowing passage of the pivot shaft through said hole (73*o*) of each cover (73).

lxxxix.) A plowing system according to any one of the preceding combination(s), wherein the upper and lower resiliently deformable components are separated by a corresponding inner spacer component being positioned, shaped and sized for containment inside the bore (61) of the pivot assembly.

xc.) A plowing system according to any one of the preceding combination(s), wherein the inner spacer component includes an axial hole (77*o*) being positioned, shaped and sized for allowing passage of the pivot shaft through said axial hole (77*o*) of the inner spacer component.

xci.) A plowing system according to any one of the preceding combination(s), wherein the axial hole (77*o*) of the inner spacer component is further positioned, shaped and sized for allowing deflection of the pivot shaft within said axial hole (77*o*) of the inner spacer component when the plowing component is displaced with respect to the pivot assembly along the angular degree-of-freedom.

xcii.) A plowing system according to any one of the preceding combination(s), wherein the axial hole (77*o*) of the inner spacer component has a cross-sectional area being greater than that of corresponding holes of other associated inner components (63,73,77) of the pivot assembly.

xciii.) A plowing system according to any one of the preceding combination(s), wherein the inner spacer component includes upper and lower abutment rims (77*a*,77*b*) for abutting against inward sides of the upper and lower resiliently deformable components respectively.

xciv.) A plowing system according to any one of the preceding combination(s), wherein the upper and lower resiliently deformable components each have first and second protruding portions (65*c*,65*d*) being positioned, shaped and sized for removably inserting into a corresponding abutment plate (71) and the inner spacer component respectively of the pivot assembly.

xcv.) A plowing system according to any one of the preceding combination(s), wherein the upper and lower resiliently deformable components, and corresponding inner spacer component, are further positioned, shaped and sized with respect to one another so as to selectively and adjustably provide the upper and lower resiliently deformable components with corresponding preloads in order to offer an additional resistance to a possible angular deflection of the pivot assembly.

xcvi.) A plowing system according to any one of the preceding combination(s), wherein a common pivot shaft is used for both the upper and lower resiliently deformable components.

xcvii.) A plowing system according to any one of the preceding combination(s), wherein the sidetrack (29) of the mounting assembly is a longitudinal and recessed sidetrack (29).

xcviii.) A plowing system according to any one of the preceding combination(s), wherein the carriage component (31) is configured for travelling along said longitudinal and recessed sidetrack (29) of the mounting assembly.

xcix.) A plowing system according to any one of the preceding combination(s), wherein the carriage component (31) includes at least one wheel (79) for traveling along a given surface of the sidetrack (29) of the mounting assembly.

c.) A plowing system according to any one of the preceding combination(s), wherein the carriage component (31) includes at least one wheel (79*d*) for traveling along an outer surface of the sidetrack (29) of the mounting assembly.

ci.) A plowing system according to any one of the preceding combination(s), wherein the carriage component (31) includes at least one pair of wheels (79*d*) for traveling along the outer surface of the sidetrack (29) of the mounting assembly.

cii.) A plowing system according to any one of the preceding combination(s), wherein the carriage component (31) includes at least one wheel (79*i*) for traveling along an inner surface of the sidetrack (29) of the mounting assembly.

ciii.) A plowing system according to any one of the preceding combination(s), wherein the carriage component (31) includes at least one pair of wheels (79*i*) for traveling along the inner surface of the sidetrack (29) of the mounting assembly.

civ.) A plowing system according to any one of the preceding combination(s), wherein the carriage component (31) includes at least one wheel (79*a*) for traveling along an upper surface of the sidetrack (29) of the mounting assembly.

cv.) A plowing system according to any one of the preceding combination(s), wherein the carriage component (31) includes at least one pair of wheels (79*a*) for traveling along the upper surface of the sidetrack (29) of the mounting assembly.

cvi.) A plowing system according to any one of the preceding combination(s), wherein the carriage component (31) includes at least one wheel (79*b*) for traveling along a bottom surface of the sidetrack (29) of the mounting assembly.

cvii.) A plowing system according to any one of the preceding combination(s), wherein the carriage component (31) includes at least one pair of wheels (79*b*) for traveling along a bottom surface of the sidetrack (29) of the mounting assembly.

cviii.) A plowing system according to any one of the preceding combination(s), wherein the carriage component (31) includes a first connecting flange (31*a*) for removably and operatively connecting the carriage component (31) to the proximate end (15*b*) of the first actuating assembly.

cix.) A plowing system according to any one of the preceding combination(s), wherein the carriage component (31) includes a second connecting flange (31*b*) for removably and operatively connecting the carriage component (31) to the distal end (19*a*) of the second actuating assembly (19).

cx.) A plowing system according to any one of the preceding combination(s), wherein the first connecting flange (31*a*) includes a corresponding hole (31*o*) being positioned, shaped and sized to cooperate with the distal end (15*a*) of the first actuating assembly, and wherein the second connecting flange (31*b*) includes a corresponding hole (31*o*) being positioned, shaped and sized to cooperate with the distal end (19*a*) of the second actuating assembly (19).

cxi.) A plowing system according to any one of the preceding combination(s), wherein the hole (31*o*) of the first connecting flange (31*a*) and the hole (31*o*) of the second connecting flange (31*b*) are disposed within a given longitudinal axis of the carriage component (31).

cxii.) A plowing system according to any one of the preceding combination(s), wherein the hole (31*o*) of the first connecting flange (31*a*) is angularly offset with respect to the hole (31*o*) of the second connecting flange (31*b*).

cxiii.) A plowing system according to any one of the preceding combination(s), wherein the hole (31*o*) of the first connecting flange (31*a*) is substantially disposed about a vertical plane.

cxiv.) A plowing system according to any one of the preceding combination(s), wherein the hole (31*o*) of the second connecting flange (31*a*) is substantially disposed about a horizontal plane.

cxv.) A plowing system according to any one of the preceding combination(s), wherein the plowing component including a plurality of bottom scraping components (81) for traveling over a surface to be plowed by the plowing system and corresponding vehicle.

cxvi.) A plowing system according to any one of the preceding combination(s), wherein a plurality of said bottom scraping components (81) are independently moveable with respect to one another.

cxvii.) A plowing system according to any one of the preceding combination(s), wherein each bottom scraping component (81) is removably mountable onto a bottom portion of the plowing component via at least one corresponding fastener (41).

cxviii.) A plowing system according to any one of the preceding combination(s), wherein said at least one corresponding fastener (41) is vertically movable along a corresponding range of travel (83) provided about the plowing component.

cxix.) A plowing system according to any one of the preceding combination(s), wherein the corresponding range of travel (83) provided about the plowing component includes an oblong orifice (85).

cxx.) A plowing system according to any one of the preceding combination(s), wherein each bottom scraping component (81) includes a connecting portion (81*a*) and a plurality of associated scrapers (81*b*), and wherein the connecting portion (81*a*) of each bottom scraping component (81) is removably mountable onto the plowing component via a plurality of fasteners (41).

cxxi.) A plowing system according to any one of the preceding combination(s), wherein the plowing component is elongated along a given length (111).

cxxii.) A plowing system according to any one of the preceding combination(s), wherein the plowing component has a substantially curved cross-sectional profile along said length (111).

cxxiii.) A plowing system according to any one of the preceding combination(s), wherein the plowing component has a substantially C-shaped cross-sectional profile along said length (111).

cxxiv.) A plowing system according to any one of the preceding combination(s), wherein the plowing component is provided with a plurality of reinforcement ribs (87) provided about a rearward surface (11*b*) of the plowing component, opposite to a plowing surface (11*a*) of the plowing component.

cxxv.) A plowing system according to any one of the preceding combination(s), wherein the reinforcement ribs (87) extend in a substantially perpendicular manner with respect to a contour of the rearward surface (11*b*) of the plowing component.

cxxvi.) A plowing system according to any one of the preceding combination(s), wherein the reinforcement ribs (87) are provided with corresponding orifices (87*o*) for reducing an overall weight of said reinforcement ribs (87) and associated plowing component.

cxxvii.) A plowing system according to any one of the preceding combination(s), wherein the plowing component has a frontal profile (11*c*) being positioned, shaped and sized for plowing material out from a distal end of the plowing component in a spiraling manner.

cxxviii.) A plowing system according to any one of the preceding combination(s), wherein plowing component is a moldboard (111).

cxxix.) A plowing system according to any one of the preceding combination(s), wherein the plowing angular range (13) of the moldboard (111) extends between about 0° to about 60° with respect to a given longitudinal axis of the vehicle.

cxxx.) A plowing system according to any one of the preceding combination(s), wherein the length (111) of the moldboard (111) (ex. the length of its bottom scraping edge) is more than five and a half meters (i.e. greater than 5.5 m, for example).

cxxxi.) A plowing system according to any one of the preceding combination(s), wherein the moldboard (111) includes a detachable end piece (11*d*) being removably and selectively mountable onto a distal end (111*a*) of the moldboard (111).

cxxxii.) A plowing system according to any one of the preceding combination(s), wherein the detachable end piece (11*d*) is provided with a corresponding attachment component (111*c*) being positioned, shaped and sized for attachment onto a corresponding receiving component (111*d*) of the moldboard (111).

cxxxiii.) A plowing system according to any one of the preceding combination(s), wherein the detachable end piece (11*d*) is provided with a corresponding reinforcement rib (87*a*) being positioned, shaped and sized for attachment onto a corresponding reinforcement rib (87*b*) of the distal end (111*a*) of the moldboard (111) via corresponding fasteners (41).

cxxxiv.) A plowing system according to any one of the preceding combination(s), wherein said corresponding reinforcement rib (87*b*) of the detachable end piece (11*d*) and said corresponding reinforcement rib (87*a*) of the distal end of the moldboard (111) are complementary in shape and size to one another, so as to provide the moldboard (111) with a combined reinforcement rib assembly (87*c*) at the distal end (111*a*) of the moldboard (111).

cxxxv.) A plowing system according to any one of the preceding combination(s), wherein the detachable end piece (11*d*) includes a bottom portion being narrower in width than an upper portion of said detachable end piece (11*d*).

cxxxvi.) A plowing system according to any one of the preceding combination(s), wherein the detachable end piece (11*d*) includes a distal contour (111*e*) of variable profile, said distal contour (111*e*) having a segment tapering down towards a bottom distal point (111*f*) of the moldboard (111).

cxxxvii.) A plowing system according to any one of the preceding combination(s), wherein a frontal side of the detachable end piece (11*d*) is complementary to a corresponding frontal side of the moldboard (111), so as to further plow material out from a distal end of the detachable end piece (11*d*) in a spiraling manner.

cxxxviii.) A plowing system according to any one of the preceding combination(s), wherein the plowing system includes a supporting assembly (89) operatively connectable to the mounting assembly via a corresponding connecting bracket (91) for removably supporting the plowing component onto said mounting assembly, and for allowing to operate the plowing component between the retracted and deployed configurations.

cxxxix.) A plowing system according to any one of the preceding combination(s), wherein the plowing system includes a tilting assembly (93) operatively connectable between the mounting assembly and the plowing component for allowing said plowing component to tilt forward within a given range of pitch in response to a given road obstacle.

cxl.) A plowing system according to any one of the preceding combination(s), wherein the tilting assembly (93) includes a linking assembly (97) with corresponding linking arms (97*a*) and pivot (97*b*) operatively extendable between the mounting assembly and a rear portion of the plowing component, for allowing a tilting movement of the plowing component with respect to the mounting assembly within said given range of pitch.

cxli.) A plowing system according to any one of the preceding combination(s), wherein the given range of pitch extends between about 0° and about 30° with respect to a reference axis (99) of the plowing component.

cxlii.) A plowing system according to any one of the preceding combination(s), wherein the tilting assembly (93) includes at least one dampening assembly (101) for dampening a tilting motion of the plowing component within the given range of pitch.

cxliii.) A plowing system according to any one of the preceding combination(s), wherein the at least one dampening assembly (101) includes at least one dampening component (103) capable of resilient compression and corresponding return expansion.

cxliv.) A plowing system according to any one of the preceding combination(s), wherein the at least one dampening component (103) is provided about a corresponding swivelling component (105) of the tilting assembly (93).

cxlv.) A plowing system according to any one of the preceding combination(s), wherein the at least one dampening component (103) is operatively connectable onto the corresponding swivelling component (105) of the tilting assembly (93) via at least one corresponding fastener (41).

cxlvi.) A plowing system according to any one of the preceding combination(s), wherein the at least one dampening component (103) is provided with a corresponding channel (63*i*) being positioned, shaped and sized for receiving therein the at least one corresponding fastener (41).

cxlvii.) A plowing system according to any one of the preceding combination(s), wherein the channel (63*i*) extends longitudinally within the at least one dampening component.

cxlviii.) A plowing system according to any one of the preceding combination(s), wherein a frontal side (105*a*) of the swivelling component (105) of the tilting assembly (93) is substantially positioned, shaped and sized for operatively cooperating with a rear corresponding side of the plowing component.

cxlix.) A plowing system according to any one of the preceding combination(s), wherein a frontal side (105*a*) of the swivelling component (105) of the tilting assembly (93) is positioned, shaped and sized for operatively cooperating with a deflecting component (107) provided about a rear portion of the plowing component.

cl.) A plowing system according to any one of the preceding combination(s), wherein the at least one dampening assembly (101) includes first and second dampening components (103).

cli.) A plowing system according to any one of the preceding combination(s), wherein the first and second dampening components (103) are both provided about the corresponding swivelling component (105) of the tilting assembly (93).

clii.) A plowing system according to any one of the preceding combination(s), wherein the first and second dampening components (103) are respectively provided about first and second opposite sides of the corresponding swivelling component (105) of the tilting assembly (93).

cliii.) A plowing system according to any one of the preceding combination(s), wherein the first and second dampening components (103) are provided about a corresponding pivot point (105*o*) of the corresponding swivelling component (105).

cliv.) A plowing system according to any one of the preceding combination(s), wherein the corresponding swivelling component (105), in addition to being pivotable about its corresponding pivot point (105*o*), is further shaped, positioned, and sized for being displaceable along a given range of travel (109) defined about the mounting assembly.

clv.) A plowing system according to any one of the preceding combination(s), wherein the corresponding swivelling component (105), in addition to being pivotable about its corresponding pivot point (105*o*), is further shaped, positioned, and sized for being displaceable in a translational manner along said range of travel (109) defined about the mounting assembly.

clvi.) A plowing system according to any one of the preceding combination(s), wherein the tilting assembly (93) is further positioned, shaped and sized, so that a distal end (109*a*) of the given range of travel (109) defined about the mounting assembly corresponds to a default operating configuration of the plowing component, and wherein a proximate end (109*b*) of the given range of travel (109) defined about the mounting assembly corresponds to a tilted configuration of the plowing component.

clvii.) A plowing system according to any one of the preceding combination(s), wherein the given range of travel (109) defined about the mounting assembly is selectively variable via a placement of a corresponding abutment component (113) being removably placeable along said given range of travel (109) so as to in turn allow a user of the plowing system to selectively vary and adjust a resulting range of pitch for the tilting assembly (93).

clviii.) A plowing system according to any one of the preceding combination(s), wherein the plowing system includes a pair of tilting assemblies (93), one tilting assembly (93) being provided adjacent to proximate end (111*b*) of the plowing component (11,111) and another tiltable assembly being provided in proximity to a distal end (111*a*) of the plowing component (11, 111), so as to allow the plowing component to be tilted forwardly about at least two corresponding and spread-apart tilting points.

clix.) A plowing system according to any one of the preceding combination(s), wherein the plowing system includes a rearward blocking assembly (115) removably and operatively mountable onto the vehicle via the mounting assembly, the rearward blocking assembly (115) including a main gate (115*b*) being operable between raised and lowered configurations within a given blocking angular range extending into the lateral range (5) of the vehicle, so as to visually indicate a blocked lateral span along in which the plowing system is operated.

clx.) A plowing system according to any one of the preceding combination(s), wherein the main gate (115*b*) is configured so as to be automatically lowered when the plowing component is deployed.

clxi.) A plowing system according to any one of the preceding combination(s), wherein the main gate (115*b*) is further configured so as to be automatically raised when the plowing component is retracted.

clxii.) A plowing system according to any one of the preceding combination(s), wherein the rearward blocking assembly (115) includes a sub-gate (115*a*) being displaceable along and extendable from the main gate (115*b*) so that a maximal effective length of both the main gate (115*b*) and corresponding sub-gate (115*a*) corresponds to the blocked lateral span along which the plowing system is operated.

clxiii.) A plowing system according to any one of the preceding combination(s), wherein the rearward blocking assembly (115), including a given associated gate (115*a*,115*b*) thereof, is provided with a series of lights (117).

clxiv.) A kit with corresponding components for assembling a plowing system according to any one of the preceding combination(s).

clxv.) A vehicle being provided with a plowing system according to any one of the preceding combination(s), the plowing system being operable along a given side (3*a*,3*b*) of the vehicle.

clxvi.) A vehicle being provided with a pair of plowing systems such as the one defined in any one of the preceding combination(s), wherein said pair of plowing systems includes a left plowing system (1*a*) being operable along a corresponding left side (3*a*) of the vehicle and a right plowing system being operable along a corresponding right side (3*b*) of the vehicle.

clxvii.) A vehicle according to any one of the preceding combination(s), wherein the vehicle further includes a complementary frontal plowing complement (311).

It is worth mentioning that several modifications, alterations, replacements and/or omissions could be made to the present plowing system, without departing from the scope of the present invention, as can be easily understood by a person skilled in the art. For example, and although the plowing system has been exemplified in the accompanying drawings as being operatively "mountable" (and thus, resultingly "mounted") onto a bottom portion (3*c*) of the vehicle, as one possible embodiment, it is worth mentioning that the present plowing system and/or associated components could ultimately be operatively mountable and/or mounted onto at least one and/or various other portion(s) of the vehicle (ex. side/portion (3*b*), opposite side portion (3*a*), top portion (3*d*), front portion (3*f*), rear portion, (3*e*) etc.), depending on the particular application(s) for which the plowing system is intended for, and the desired end result(s). Furthermore, and as alluded to earlier, the present plowing system could also be used with and/or for various other types of vehicles (i.e. not necessarily being "wheeled" vehicles, per se, such as trucks and/or the like, but also, the present system could ultimately be used with "nonwheeled" vehicles, such snowmobiles, and even trains and/or the like, etc.), as can be easily understood by a person skilled in the art. Indeed, and as also explained earlier, instead of using for "plowing" purposes, the present system could ultimately be used for "clearing" and/or "cutting" undesirable vegetation (ex. grass, bushes, etc.) growing on left and/or rights side(s) of a given track (ex. snowmobile track, train track), for example, in which case the present plowing component and associated scraping components (81) could be replaced by a suitable clearing component and associated cutting components (81), for example, as can also be easily understood by a person skilled in the art. It is worth mentioning also that the present system may be provided with corresponding mechanical, electromechanical, electric, electronic, fluid (ex. oil, etc.) and/or other types of appropriate circuits and/or components, including hardware and software, if need may be, for operating one and/or several of the various components and features of the present plowing system, either directly and/or remotely, whether from the vehicle itself (ex. within the cabin of the drive) and/or from outside thereof, as can also be easily understood by a person skilled in the art.

As can now be better appreciated, the present invention is particularly advantageous in that it enables to convert a "regular" and/or "conventional" vehicle, into a corresponding and resulting "plowing" vehicle, in a substantially easy, fast and convenient manner, due to the innovative nature of the various components and features of the present plowing system. Namely, but not limitedly, these various components and features of the plowing system, including the mounting components (35,135,235,335) thereof, with optional U-shaped portion(s), provide for a simple, intuitive and straightforward assembling and corresponding operation of the plowing system. The present invention is also particularly advantageous in that, contrary to conventional systems and devices that rely solely on one single actuator having opposite ends pivotably mounted to "fixed" anchored points for a corresponding deployment and activation of the plowing component, the present plowing system offers various assortments, combinations and/or interactions of different first and second actuating assemblies (15,19) wherein, namely, but not limitedly, a proximate end (15*b*) of the first actuating assembly is operatively connectable onto a first base component (17*a*), and said first base component (17*a*) of the first actuating assembly is "relatively moveable" with respect to a second base component (17*b*) of an associated second actuating assembly (19), and/or, wherein, at least one base component (17) of said first and second base components (17*a*,17*b*) is positioned, shaped and shaped to move along a corresponding path of the plowing system, so that the present plowing system can provide a much greater plowing angular range than the one that would otherwise be possible, merely by an activation of one single actuator having opposite ends pivotably mounted to "fixed" anchored points.

Indeed, and according to certain possible embodiment(s) described and/or illustrated herein, the present plowing system enables to displace and bring the proximate end (15*b*) of the first actuating assembly "closer" (and/or "in proximity") to a corresponding frontward portion of the mounting assembly (i.e. "closer" and/or "in proximity" to a corresponding pivot axis (69) of the plowing component), during operation (ex. during a "deployment action") of the plowing system, which among other advantages, enables to provide the aforementioned greater plowing angular range due to a combined effect and disposition of the first and second actuating assemblies (15,19). Furthermore, the provision and interaction of such first and second actuating assemblies (15,19) is also advantageous in that it also enables to provide the plowing system and associated plowing assembly and corresponding plowing component with an increased structural and/or resistive soundness, given that the second actuating assembly (19) acts as some sort of corresponding "dampening assembly" and/or "complementary structural assembly", which enables the plowing system to take on higher plowing loads, and/or to be operated along with greater plowing angular range(s) and/or with much longer moldboard(s), than what is possible with conventional devices.

The present plowing system is also particularly advantageous in that the innovative nature of the flexible pivot assembly and of its associated components (ex. resiliently deformable component(s), abutment plate(s) (71), inner spacer component), in addition to allowing the plowing component to be moved along a given rotational degree-of-freedom (i.e. to be operated between retracted and deployed configurations), is further configured to moreover allow the plowing component to be displaced along at least one "additional degree-of-freedom" (either a vertically "slidable degree-of-freedom" and/or an "angular degree-of-freedom", but preferably/optionally both), which is also advantageous in that its further enables and optimizes the use of longer moldboard(s), in that a distal end of a given moldboard can better adapt itself to the curvature of a road (which are usually provided with a downwardly sloping end towards distal sides (ex. curbs) of the road, for natural drainage via gravity, etc.), in that the aforementioned flexible pivot assembly enables the moldboard (111) to better "curve itself" (i.e. "wrap itself", etc.—figuratively speaking, of course) about the natural curvature of a road due to its "slidable degree-of-freedom" (i.e. upward and downward movements, etc.) and/or "angular degree-of-freedom" (ex. similarly to a corresponding "rolling action" in a classic "yaw-pitch-roll" aeronautical configuration).

Thus, as may now be better appreciated, the pivot assembly of the present of the present plowing system allows the plowing component (ex. moldboard (111)) to move along a given "rotational degree-of-freedom" (ex. "yaw" component), as well as corresponding upward and downward movements, as well as a corresponding "angular degree-of-freedom" (ex. "roll" component), while the innovative tilting assembly (93) further allows the plowing component (ex. moldboard (111) to be tilted forward within a given range of pitch, such as in response to a given road obstacle, for example, thereby provide the plowing system with a corresponding "pitch" component as well, to further enhance the flexibility, adaptability and resulting plowing performance of the plowing system and associated plowing assembly and corresponding plowing component (ex. moldboard (111).

The present plowing system is also advantageous in that the innovative nature of its pivot assembly, in addition to the various benefits briefly discussed hereinabove, is also of simple design with few parts, thereby providing the plowing system with a pivot assembly that can be easily accessed, either for inspection, maintenance and/or repair, if need may be. Furthermore, the innovative nature of the flexible pivot assembly and of its associated components (ex. resiliently deformable component(s), abutment plate(s) (71), inner spacer component, etc.), also enables to provide the pivot assembly and associated components (ex. plowing assembly and corresponding plowing component, such as moldboard (111), for example) cooperating with such pivot assembly, with a selectively adjustable degree of "stiffness" and/or "dampening", by simply, selectively and adjustably selecting corresponding parameters of the resiliently deformable component(s) (ex. shape, dimensions, material employed, etc.), but also, by simply, selectively and adjustably selecting corresponding parameters of the inner spacer component, for providing the pivot assembly with a corresponding and selectively adjustable "preload" (due to compression of the resiliently deformable component(s)) inside the bore (61) of the pivot assembly, if such a preload is so desired, something that is believed to not be possible with conventional pivot assemblies of existing snow plowing systems.

The present plowing system is also advantageous in that the innovative nature of its height-adjustment and vertical-adjustment assemblies (43,49), are also of simple design with few parts, and enable to easily, quickly and conveniently adjust a given height of the plowing system with respect to a corresponding ground surface of the vehicle, either before, during and/or after operation of the following assembly, depending on the particular application(s) for which the plowing system is intended and the different parameters (size of tires being used, tire pressure, etc.) in cause, as apparent to a person skilled in the art.

The present plowing system is also advantageous in that the provision of a rearward blocking assembly (115) provides an additional safety, as a preventive measure, given that in most conventional snow plowing systems, any lights and/or reflectors present on the side of the vehicle are typically found on the moldboard itself, which gives little/no leeway (ex. spacing, etc.) to possible drivers nearby, etc.

The present plowing system is also advantageous in that the innovative nature of its tilting assembly (93), in addition to the above-discussed benefits, is also of simple design with few parts, thereby providing the plowing system with a tilting assembly (93) that can be easily accessed, as well (similarly to the pivot assembly), either for inspection, maintenance and/or repair, if need may be. Furthermore, the innovative nature of the tilting assembly (93) and of its associated components (ex. linking assembly (97), dampening component(s) (103), swivelling component (105), deflecting component (107), range of travel (109), abutment component (113), etc.), also enables to provide the tiling assembly (93) and associated components (ex. plowing assembly and corresponding plowing component, such as moldboard (111), for example) cooperating with such tilting assembly (93), with a selectively adjustable degree of "stiffness" and/or "dampening", by simply, selectively and adjustably selecting corresponding parameters of the dampening component(s) (103) (ex. shape, dimensions, material employed, etc.), but also, by simply, selectively and adjustably selecting corresponding parameters of the abutment component (113), for providing the tilting assembly (93) with a corresponding and selectively adjustable range of "pitch" (due to a selectively adjustable range of travel (93), etc.), something that is believed to not be possible with conventional tilting assemblies of existing snow plowing systems.

Finally, the present plowing system is also advantageous from an environmental point of view in that it enables to convert a "regular" and/or "conventional" vehicle, into a corresponding and resulting "plowing" vehicle, and thus, once assembled, said resulting "plowing" vehicle, thanks to the innovative nature of the present plowing system, as described hereinabove and as exemplified in the accompanying drawings, enables to carry out a plowing action and provide a lateral plowing range that is similar and/or superior to that of two conventional plowing vehicles/devices (thus, the present system allows for less wastage, less fuel consumption, less pollution, etc.).

The present plowing system and corresponding parts are preferably made of substantially rigid materials, such as metallic materials, hardened polymers, composite materials, polymeric materials, and/or the like, so as to ensure a proper operation thereof depending on the particular applications for which the plowing system is intended and the different parameters (weights, loads, moments, etc.) in cause, as apparent to a person skilled in the art.

Of course, and as can be easily understood by a person skilled in the art, the scope of the claims should not be limited by the possible embodiments set forth in the examples, but should be given the broadest interpretation consistent with the description as a whole.

Furthermore, although preferred embodiments of the present invention have been briefly described herein and illustrated in the accompanying drawings, it is to be understood that the invention is not limited to these embodiments and that various changes and modifications could be made without departing form the scope and spirit of the present invention, as defined in the appended claims and as apparent to a person skilled in the art.

The invention claimed is:

1. A plowing system removably mountable onto a vehicle to provide said vehicle with lateral plowing capability along a given lateral range of the vehicle, the plowing system comprising:

a mounting assembly for removably and operatively mounting the plowing system onto the vehicle;

a plowing assembly operatively mountable onto the vehicle via the mounting assembly, the plowing assembly comprising a plowing component pivotably mountable about a frontward portion of the mounting assembly, and being operable between retracted and deployed configurations within a given plowing angular range extending into the lateral range of the vehicle;

at least one actuating assembly extendable between the plowing component and the mounting assembly, for selectively operating the plowing component between the retracted and deployed configurations, a proximate end of the at least one actuating assembly being operatively connectable onto a first base component of the plowing system, and a distal end of the at least one actuating assembly being operatively connectable to a rear portion of the plowing component, so that a corresponding movement of the at least one actuating assembly in turn operates the plowing component within the plowing angular range;

a track assembly extendable about the mounting assembly and being further extendable in an elongated manner along a given side of the vehicle, adjacent to corresponding wheels of said vehicle, for removably and operatively receiving the first base component;

at least one mounting component for removably and operatively mounting the mounting assembly and the track assembly onto a corresponding portion of the vehicle, said at least one mounting component including frontward and rearward mounting components being positioned, shaped and sized for removably and operatively connecting the track assembly onto corresponding frontward and rearward portions of the given side of the vehicle, wherein the frontward and rearward mounting components, as well as the at least one actuating assembly, and associated distal and proximate ends thereof, extend along a substantially common and horizontal space being adjacent to the corresponding wheels of the vehicle and being further parallel with respect to a ground surface, for an increased plowing resistivity within the lateral range of the vehicle, due to a disposition of the track assembly and the at least one actuating assembly within said substantially common and horizontal space; and a vertical-adjustment assembly being selectively and operatively mountable between the vehicle and the mounting assembly, the vertical-adjustment assembly including at least one actuator having a proximate end operatively mountable about the vehicle and a distal end being operatively connectable to a corresponding connecting component of the mounting assembly, for selectively adjusting a given vertical displacement of the track assembly with respect to the ground surface of the vehicle, via a corresponding activation of said least one actuator of the vertical-adjustment assembly.

2. The plowing system according to claim 1, wherein the track assembly is configured for receiving the first base component of the plowing system in a fixed manner.

3. The plowing system according to claim 1, wherein the first base component is sized and shaped to slidably move along a corresponding sidetrack of the track assembly via a corresponding moveable carriage component acting as a pivot component.

4. The plowing system according to claim 1, wherein the at least one actuating assembly extends in a substantially parallel manner with respect to the track assembly when the plowing component is in the retracted configuration.

5. The plowing system according to claim 1, wherein the at least one mounting component includes first and second flanges being removably mountable onto corresponding first and second portions of a supporting component of the vehicle.

6. The plowing component of claim 1, wherein the plowing component is pivotably mountable to the frontward portion of the mounting assembly via a corresponding flexible pivot assembly and a corresponding hinge component, and wherein in addition to allowing the plowing component to be moved along a given rotational degree-of-freedom, the pivot assembly is further shaped, positioned and sized to allow the plowing component to be displaced along at least one additional degree-of-freedom.

7. The plowing component of claim 6, wherein the at least one additional degree-of-freedom includes a slidable degree-of-freedom, and thus, wherein the pivot assembly is shaped, positioned and sized to allow the plowing component to be displaced in a vertical manner with respect to the pivot assembly.

8. The plowing component of claim 7, wherein the pivot assembly includes a bore for receiving a corresponding pivot shaft, and wherein the pivot shaft is vertically displaceable with respect to the bore of the pivot assembly, so as to provide the plowing component with said slidable degree-of-freedom.

9. The plowing component of claim 6, wherein the at least one additional degree-of-freedom includes an angular degree-of-freedom, and thus, wherein the pivot assembly is shaped, positioned and sized to allow the plowing component to be displaced in an angular manner with respect to the pivot assembly.

10. The plowing component of claim 9, wherein the pivot assembly includes at least one resiliently deformable component, and wherein said at least one resiliently deformable component is resiliently compressible with respect to a bore of the pivot assembly, so as to provide the plowing component with said angular degree-of-freedom.

11. The plowing component of claim 10, wherein the at least one resiliently deformable component is mountable about a corresponding pivot axis of the pivot assembly so as to provide the plowing component with both vertical and angular degree-of-freedoms.

12. The plowing component of claim 10, wherein the at least one resiliently deformable component is an elastomeric ring.

13. The plowing component of claim 10, wherein the pivot assembly includes at least one abutment plate being positioned against a given side of the at least one resiliently deformable component.

14. The plowing component of claim 13, wherein the abutment plate is shaped to receive a corresponding protruding portion of the at least one resiliently deformable component.

15. The plowing component of claim 1, wherein the plowing component includes a plurality of bottom scraping components for traveling over a surface to be plowed by the plowing system, the plurality of bottom scraping components being independently moveable with respect to one another.

16. The plowing component of claim 15, wherein each of the plurality of bottom scraping components includes a connecting portion and a plurality of associated scrapers, the connecting portion of each of the plurality of bottom scraping component being removably mountable onto the plowing component.

17. The plowing component of claim 1, wherein the plowing component is provided with a plurality of reinforcement ribs provided about a rearward surface of the plowing component, opposite to a plowing surface of the plowing component.

18. The plowing component of claim 17, wherein the reinforcement ribs are provided with corresponding orifices for reducing an overall weight of said reinforcement ribs.

19. The plowing component of claim 1, wherein a plowing surface of the plowing component has a frontal profile being positioned, shaped and sized for plowing material out from a distal end of the plowing component in a spiraling manner.

20. The plowing component of claim 1, wherein the plowing component is a moldboard, a length of the moldboard being more than five and a half meters.

* * * * *